US007360802B2

(12) United States Patent
Schlack et al.

(10) Patent No.: US 7,360,802 B2
(45) Date of Patent: Apr. 22, 2008

(54) COMPRESSION LATCH MECHANISM

(75) Inventors: Richard E. Schlack, Rising Sun, MD (US); Frederick H. Stilwell, West Grove, PA (US); D. Dale Turner, Honeoye Falls, NY (US); David C. Milne, Lima, NY (US); Jeffrey L. Antonucci, West Chester, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/585,394

(22) Filed: Oct. 23, 2006

(65) Prior Publication Data

US 2007/0046038 A1 Mar. 1, 2007

Related U.S. Application Data

(63) Continuation of application No. PCT/US2005/027888, filed on Aug. 4, 2005, which is a continuation-in-part of application No. 10/911,817, filed on Aug. 4, 2004, now abandoned, application No. 11/585,394, which is a continuation-in-part of application No. 10/911,817.

(51) Int. Cl.
*E05C 19/02* (2006.01)
*E05C 19/00* (2006.01)

(52) U.S. Cl. ..... 292/75; 292/336.3; 292/347; 292/DIG. 31; 70/208

(58) Field of Classification Search ..... 292/75, 292/347, 336.3, DIG. 31; 70/208
See application file for complete search history.

(56) References Cited

U.S. PATENT DOCUMENTS

| | | | |
|---|---|---|---|
| 2,143,127 | A | 1/1939 | Leonard |
| 2,317,700 | A | 4/1943 | Thompson |
| 3,402,958 | A | 9/1968 | Barry |
| 4,556,244 | A | 12/1985 | Bisbing |
| 4,583,775 | A | 4/1986 | Bisbing |
| 4,689,976 | A | 9/1987 | Larsen |
| 4,693,503 | A | 9/1987 | Bisbing |
| 4,706,478 | A | 11/1987 | Swan et al. |
| 4,763,935 | A | 8/1988 | Bisbing |
| 4,893,849 | A | 1/1990 | Schlack |
| 5,267,762 | A | 12/1993 | Gromotka |
| 5,409,272 | A | 4/1995 | McCormack |
| 5,469,725 | A | 11/1995 | Yamada |
| 5,526,660 | A | 6/1996 | Bennett et al. |
| 5,609,373 | A | 3/1997 | Gromotka |
| 5,664,813 | A | 9/1997 | Gromotka |
| 5,938,248 | A | 8/1999 | Vickers et al. |

(Continued)

OTHER PUBLICATIONS

Southco, Inc. Handbook, 2003, Front and Back Covers, pp. 43, 48-59, 88-92, 154-156 and 160-162.

(Continued)

*Primary Examiner*—Carlos Lugo
(74) *Attorney, Agent, or Firm*—Paul & Paul

(57) ABSTRACT

A compression latch with a folding handle for selectively holding a door closed, includes. The latch includes a housing with a cup portion for receiving the handle in the folded down position such that the projection of the latch handle above the exterior surface of the door is minimized in the folded-down position. The handle functions to move a pawl in a combination of rotational and rectilinear movements as the pawl is moved between latched and unlatched positions.

18 Claims, 55 Drawing Sheets

U.S. PATENT DOCUMENTS

| | | | |
|---|---|---|---|
| 5,984,383 | A | 11/1999 | Parikh et al. |
| 6,039,363 | A | 3/2000 | Sugimura et al. |
| 6,086,121 | A | 7/2000 | Buckland |
| 6,152,497 | A | 11/2000 | Vickers et al. |
| 6,174,007 | B1 | 1/2001 | Schlack et al. |
| 6,298,697 | B1 | 10/2001 | Ramsauer |
| 6,427,501 | B2 | 8/2002 | Ramsauer |
| 6,668,602 | B2 | 12/2003 | Graham et al. |
| 6,840,552 | B2 | 1/2005 | Ramsauer |
| 6,971,689 | B2 | 12/2005 | Jackson |
| 2004/0056488 | A1 | 3/2004 | Jackson, Jr. et al. |
| 2006/0028027 | A1 | 2/2006 | Schlack et al. |

OTHER PUBLICATIONS

Dirak Catalog, pp. 2-070, 2-090, 2-100, 2-115, 2-124, 2-150, 2-300, 3-070, 3-158, 3-160, and 3-161, published on or prior to Jul. 22, 2004.

Emka Catalog, Excerpt 3, Locking Systems, Swing Handles, Lift Handles and EMC, published on or prior Jul. 22, 2004.

280
258
274
260
272
262
254
248
101
100
252
122
244
250
242
242
178
236
174
112
172
170
246
104
108
106
236
114
142
198
152
110
196
116
212
238
214
102

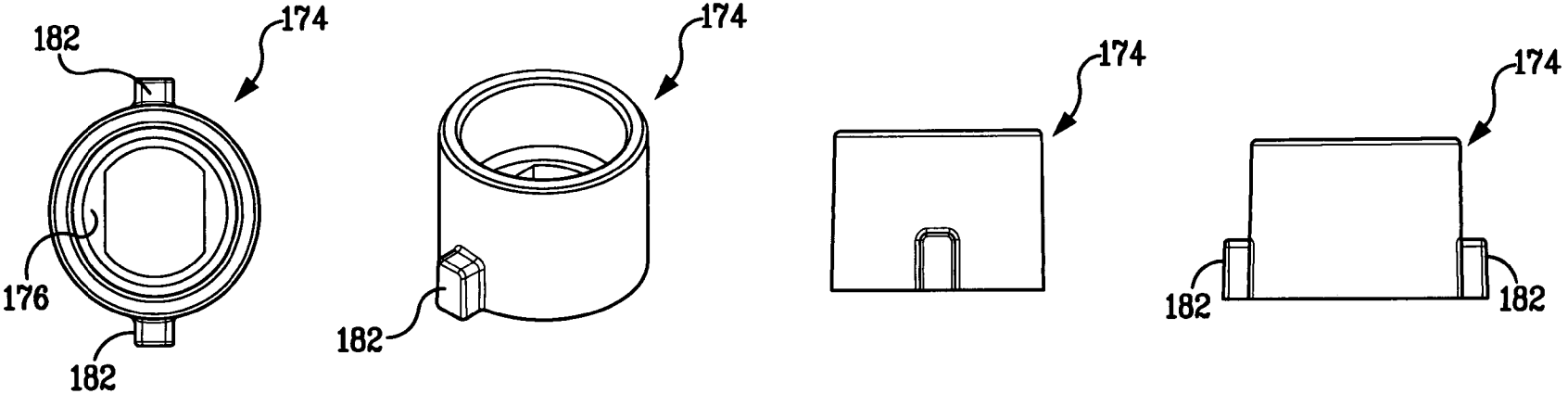
FIG. 36
FIG. 37
FIG. 38
FIG. 39
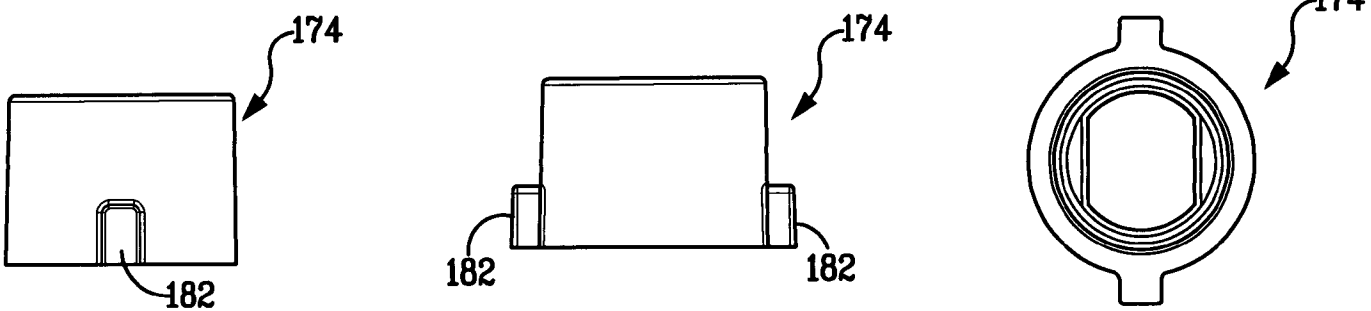
FIG. 40
FIG. 41
FIG. 42

COMPRESSION LATCH MECHANISM

BACKGROUND OF THE INVENTION

This application is a continuation of International application serial no. PCT/US2005/027888, filed on Aug. 4, 2005, which is a continuation-in-part of U.S. patent application Ser. No. 10/911,817, filed on Aug. 4, 2004 now abandoned, both of which are incorporated herein by reference in their entirety.

This application is a continuation-in-part of U.S. patent application Ser. No. 10/911,817, filed on Aug. 4, 2004 now abandoned, which is incorporated herein by reference in its entirety.

BACKGROUND OF THE INVENTION

1. Field of Invention

The present invention relates to a compression latch for selectively maintaining a panel or door in a closed position relative to a doorframe or the like.

2. Brief Description of the Related Art

In many applications the need arises to selectively maintain a panel or door in a closed position relative to a doorframe or the like, while developing a compressive force between the door or panel and the doorframe. For example, when a gasket is used to provide a seal between a door and a doorframe when the door is closed, it would be desirable for the latch holding the door closed to provide a compressive force to compress the gasket between the door and the doorframe to effectively seal the any gap or seam between the door and doorframe. Latches that develop this type of compressive force between the door and doorframe are known as compression latches. An example of a known compression latch can be seen in U.S. Pat. No. 4,763,935, issued to Robert H. Bisbing on Aug. 16, 1988, the entire disclosure of which is incorporated herein by reference.

The compression latch of U.S. Pat. No. 4,763,935 does not provide for a handle that initially kicks out to an intermediate position under spring bias without affecting the compressive force between the door and doorframe. The need persists in the art for a compression latch that has a handle that initially kicks out to an intermediate position under spring bias without affecting the compressive force between the door and doorframe.

SUMMARY OF THE INVENTION

The present invention is directed to a compression latch mechanism with a folding handle for selectively holding a door closed. The latch mechanism includes a housing with a receptacle portion for receiving the handle in the folded-down position such that the projection of the latch handle above the exterior surface of the door is minimized in the folded-down position. The latch mechanism also includes a pawl that is supported by a shaft. The shaft and the pawl move together in a combination of rotational and rectilinear movements as the pawl is moved between latched and unlatched positions. The pawl develops a compressive force between the door and doorframe as it moves from the unlatched position to the latched position. The latch mechanism handle initially kicks out or pops out to an intermediate position under spring bias for easy grasping without affecting the compressive force between the door and doorframe.

A further object of the invention is to provide a compression latch mechanism that is capable of multi-point latching.

Yet another object of the present invention is to provide a rod system with adjustable grip for use in multipoint latching systems.

BRIEF DESCRIPTION OF THE DRAWINGS

FIGS. 36-42 are views showing the bushing of the compression latch mechanism according to the present invention.

Like reference numerals indicate like elements throughout the several views.

DETAILED DESCRIPTION OF THE INVENTION

The present invention is directed to a latch for selectively maintaining a first member in a closed position relative to a second member. The first member, for example, may be a door and the second member, for example, may be a doorframe or a keeper attached to the doorframe.

Figure 1:
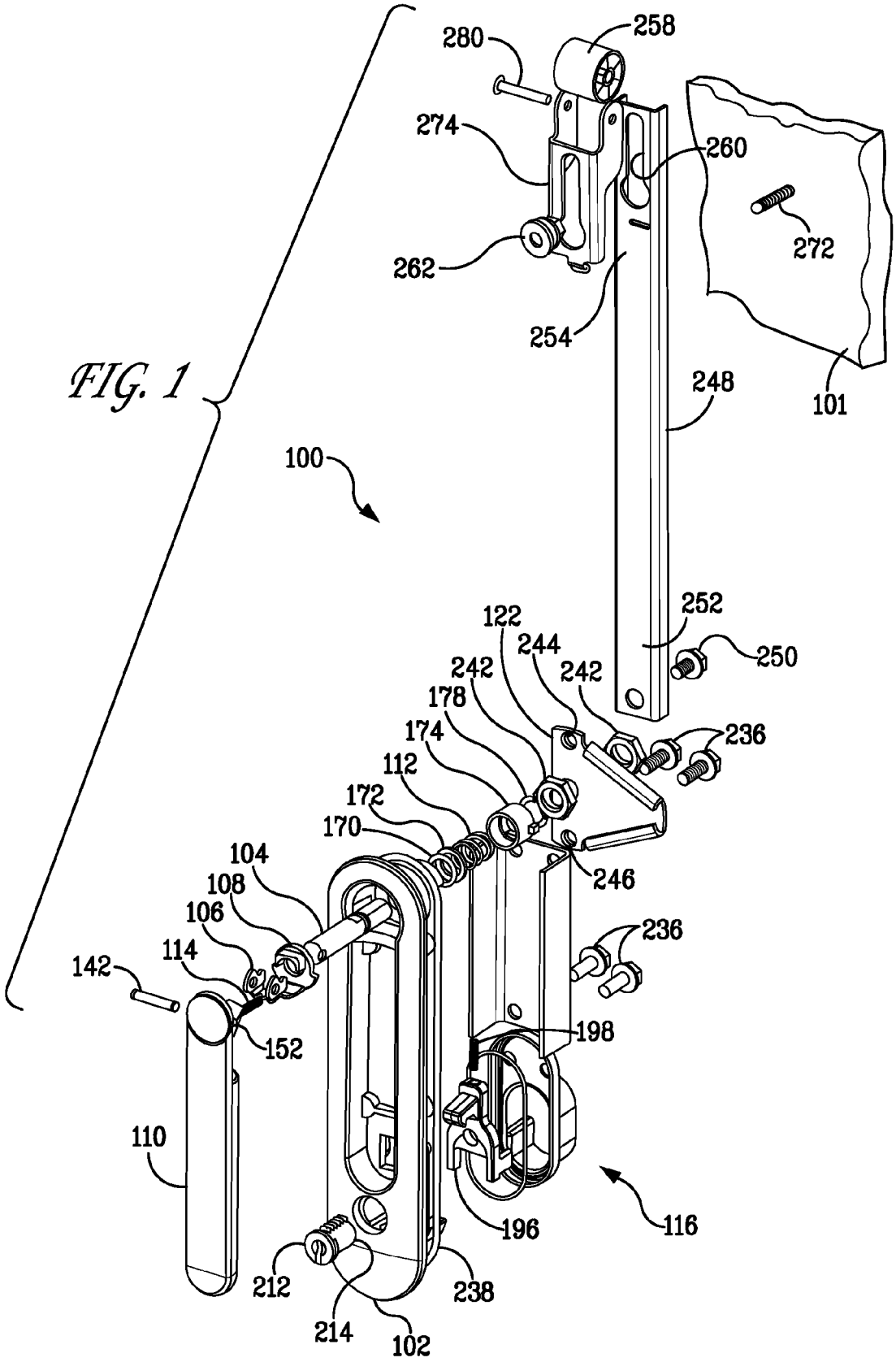
FIG. 1 is an exploded view showing the compression latch mechanism according to the present invention.
Figure 98:
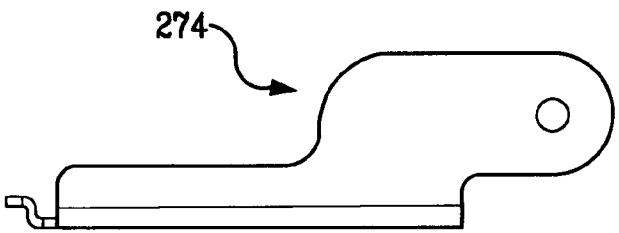
Figure 95:
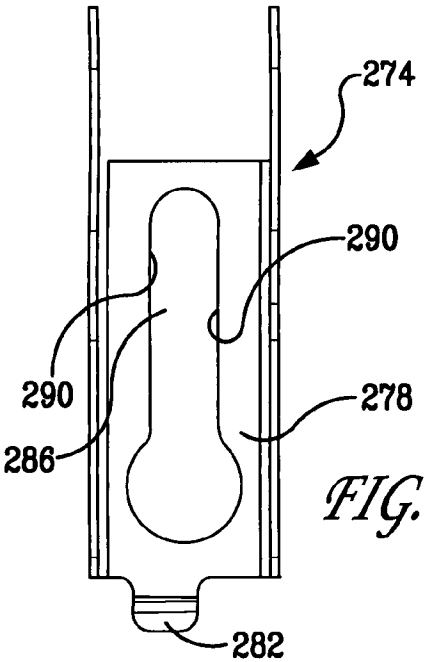
Figure 97:
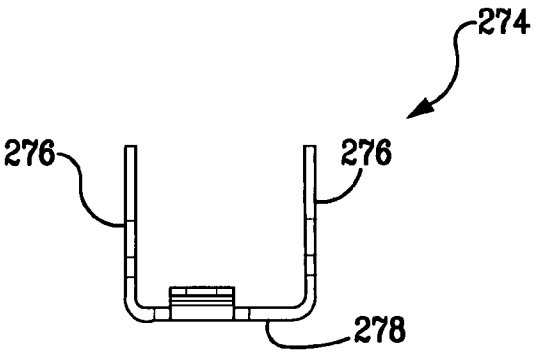

Referring to FIGS. 1-98, the compression latch mechanism 100 of the present invention in general comprises a housing 102, a shaft 104, a kickstand 106, a bearing plate 108, a handle 110, first biasing means 112, second biasing means 114, and catch means 116. The compression latch mechanism 100 is used for releasably securing a first member such as a door 101 to a second member such as a doorframe 103.

The housing 102 is adapted for attachment to the first member or door 101. The housing has a receptacle portion 118 for receiving the handle 110 in the folded down position such that the projection of the latch handle 110 above the exterior surface of the door 101 is minimized in the folded-down position. The latch housing 102 is adapted to be mounted in an opening in the door 101 such that the latch housing 102 projects to only a small height above the exterior surface of the door 101 when the latch housing is mounted in the door. This small height is equivalent to the thickness of a flange or bezel 120 that surrounds the open top of the receptacle portion 118 of the latch housing 102. Desirably, the latch handle 110 is substantially flush with the flange or bezel 120 of the receptacle portion 118 of the latch housing 102 when the latch handle 110 is in the folded-down position. The receptacle portion 118 of the latch housing 102 is roughly in the shape of a trough and is sized and shaped to correspond with the outline of the latch handle 110 in plan view such that the handle 110 can only be folded down to be received in the receptacle portion 118 when the pawl 122 is in a rotational position corresponding to the latched position of the pawl 122. Any attempt to fold down the latch handle 110 will fail when the pawl 122 is not in a rotational position corresponding to the latched position of the pawl 122, because portions of the latch handle 110 will be out of alignment with the open top of the receptacle portion 118 of the latch housing 102 and thus the latch handle 110 cannot fold down into the receptacle portion 118 of the latch housing 102.

The housing 102 has a sleeve 124 through which the shaft 104 passes and the sleeve 124 has a pair of slots 126 at an end thereof closest to the second end 128 of the shaft 104. The housing 102 also has a first bearing surface 130. In the illustrated example, the housing 102 has a partition wall 132 that separates the portion of the receptacle portion 118 immediately surrounding the sleeve 124 from the rest of the receptacle portion 118. The top surface of the partition wall 132 defines the first bearing surface 130.

The shaft 104 has a longitudinal axis, a first end 134 and a second end 128. The shaft 104 is supported for rotation about its longitudinal axis and for rectilinear motion in a direction coincident with its longitudinal axis. The shaft 104 moves between a latched position and an unlatched position as the compression latch mechanism 100 is operated between a latched configuration and an unlatched configuration. The operation of the compression latch mechanism 100 from the latched configuration to the unlatched configuration and then back to the latched configuration constitutes the operating cycle of the compression latch mechanism.

The kickstand 106 is pivotally connected to the shaft 104 proximate the first end 134 of the shaft 104. The kickstand 106 has at least one bearing surface 136 and at least one relief notch 138. In the illustrated embodiment, a pair of bearing surfaces 136 and a pair of relief notches 138 are provided, one being positioned on each side of the shaft 104. The kickstand 106 also has a pair of holes 140 that are in alignment with each other and are used to pivotally connect the kickstand 106 to the shaft 104. The kickstand 106 moves pivotally relative to the shaft 104 about a pivot axis fixed in position relative to the shaft 104 during at least a portion of the operating cycle of the compression latch mechanism. This pivot axis is defined by the pivot shaft 142 that passes through the hole 144 that passes through the shaft 104 near the first end 134 and through the holes 140 to pivotally connect the kickstand 106 to the shaft 104.

The bearing plate 108 is positioned between the first end 134 of the shaft 104 and the second end 128 of the shaft 104. The bearing plate 108 is supported by the housing 102 and in particular by the portion of the receptacle portion 118 immediately surrounding the sleeve 124. The bearing plate 108 has at least a raised bearing surface 146 and at least a lower bearing surface 148. The bearing plate 108 also has a center hole 150 that registers with the bore of the sleeve 124.

Figure 4:
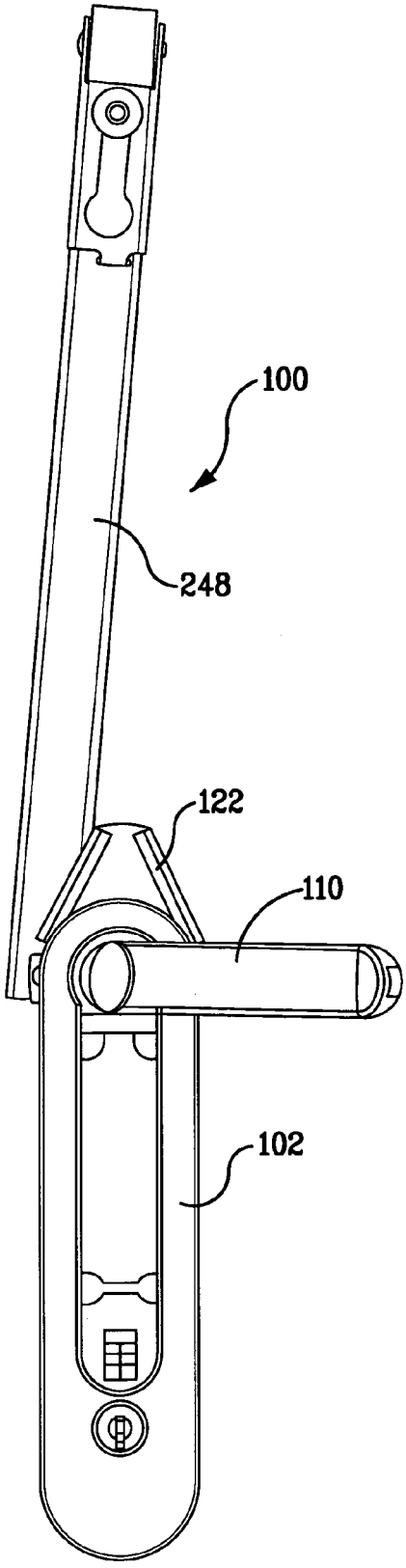
FIGS. 4-5 are views showing the compression latch mechanism according to the present invention in the unlatched configuration.
Figure 5:
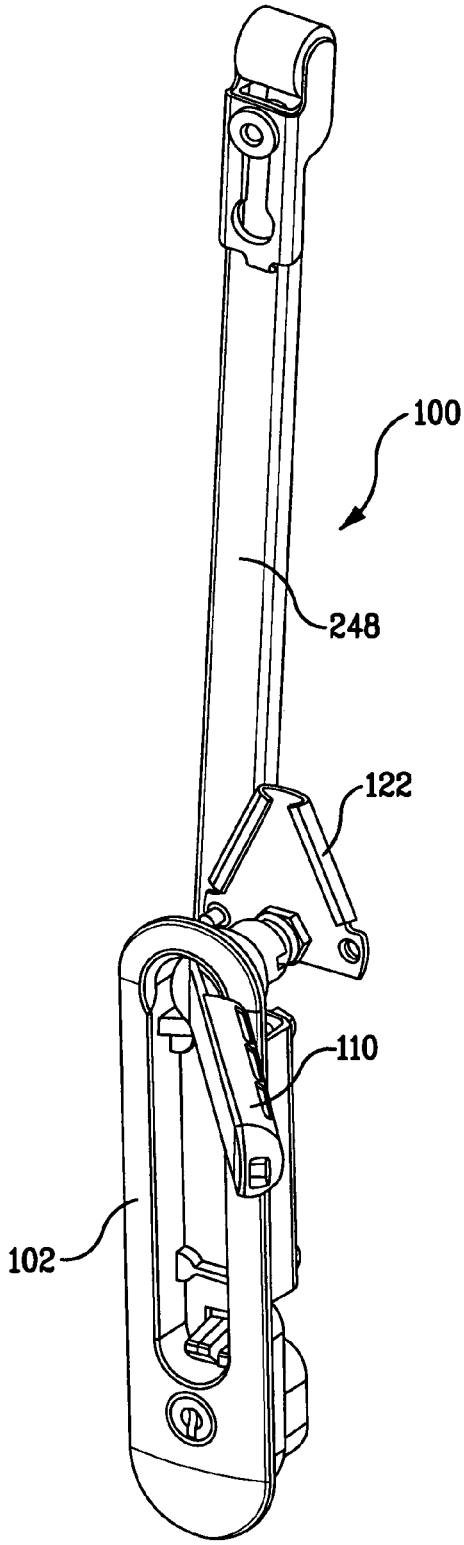
Figure 7:
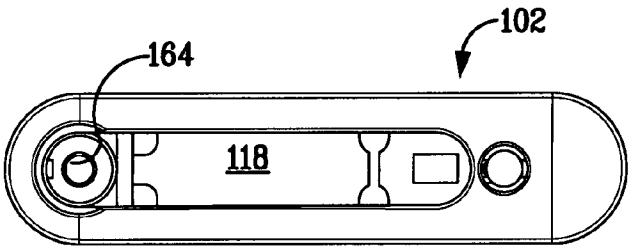
FIGS. 6-11 are views showing the housing of the compression latch mechanism according to the present invention.
Figure 10:
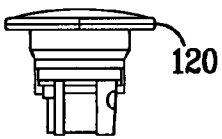
Figure 9:
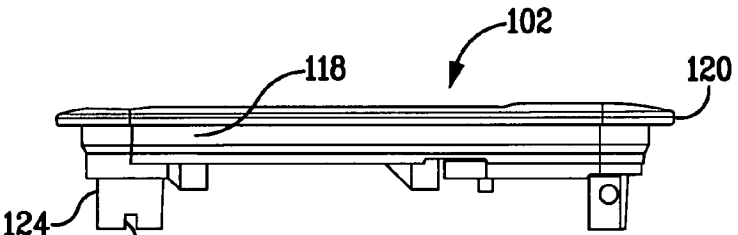
Figure 11:
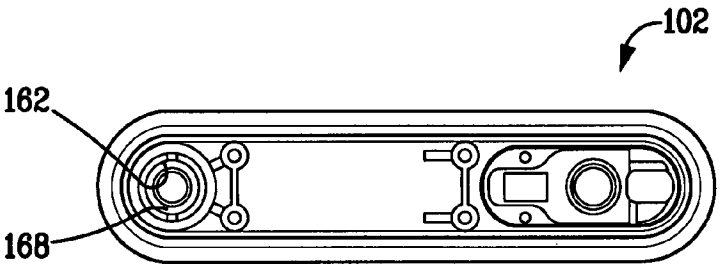
Figure 6:
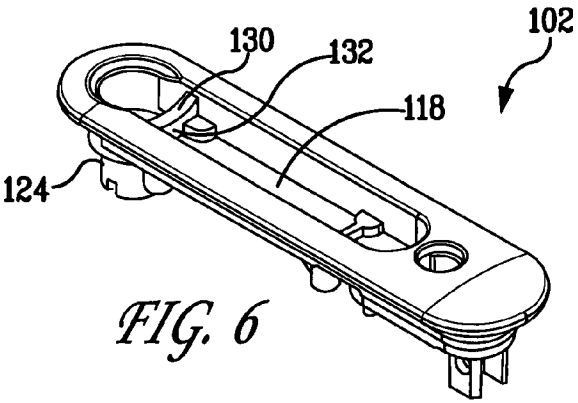
Figure 8:
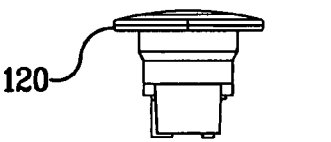
Figure 12:
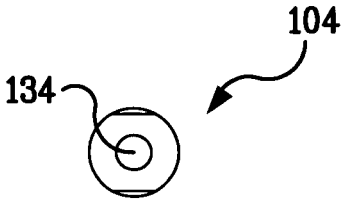
FIGS. 12-16 are views showing the shaft of the compression latch mechanism according to the present invention.
Figure 13:
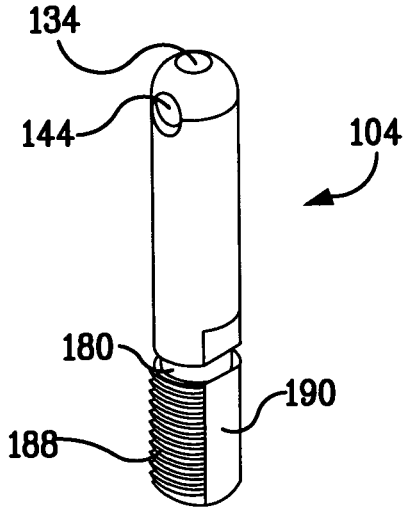
Figure 14:
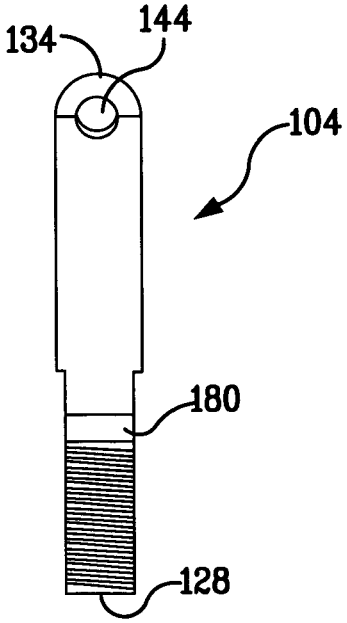
Figure 15:
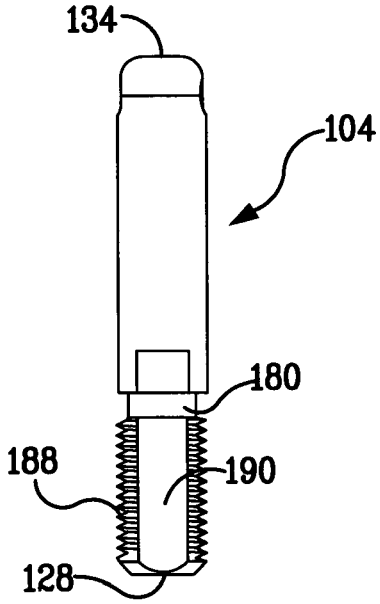
Figure 16:
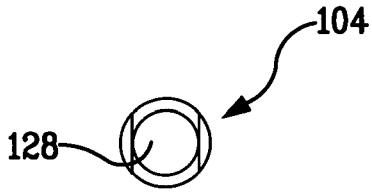
Figure 19:
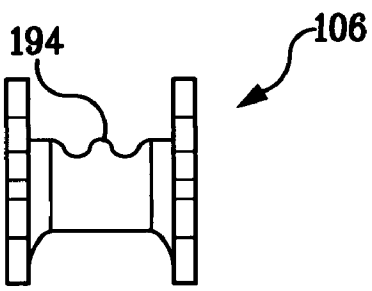
FIGS. 17-22 are views showing the kickstand of the compression latch mechanism according to the present invention.
Figure 22:
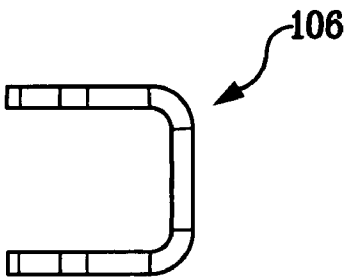
Figure 18:
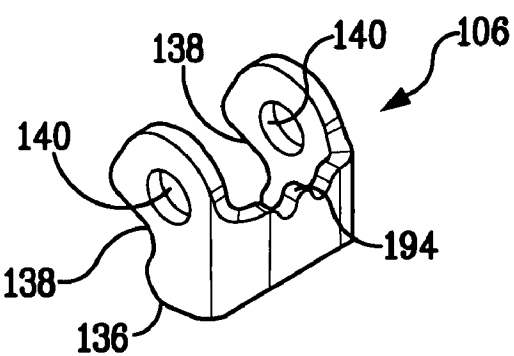
Figure 21:
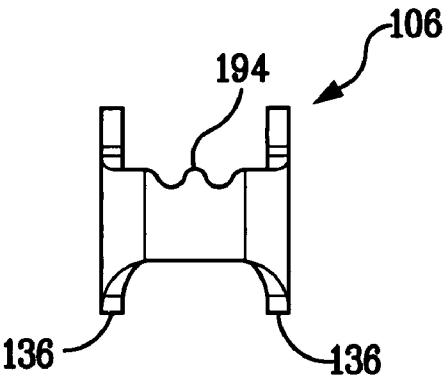
Figure 17:
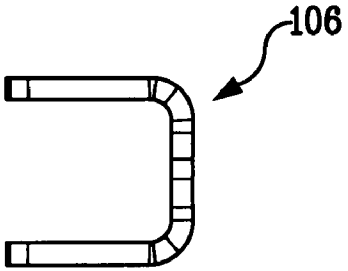
Figure 20:
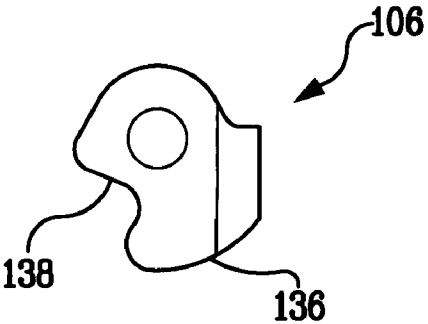
Figure 26:
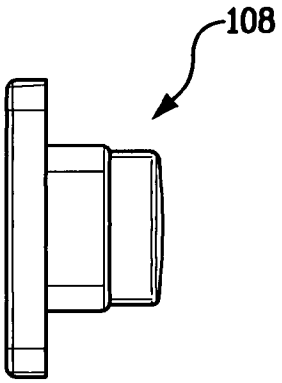
FIGS. 23-29 are views showing the bearing plate of the compression latch mechanism according to the present invention.
Figure 25:
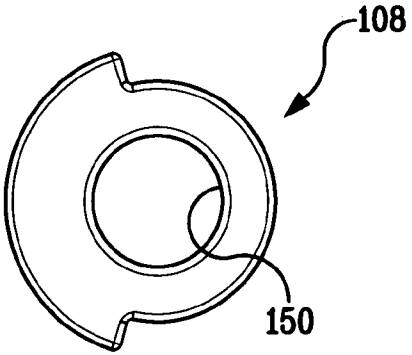
Figure 24:
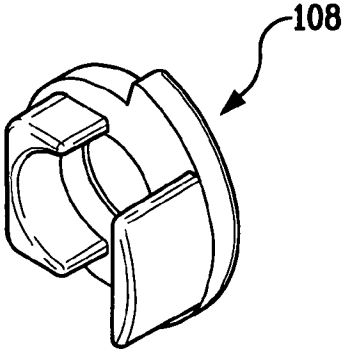
Figure 23:
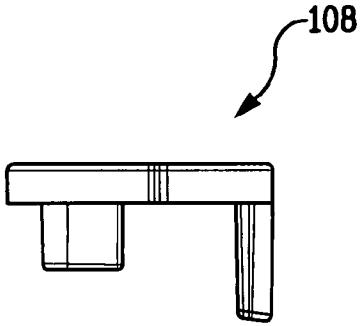
Figure 27:
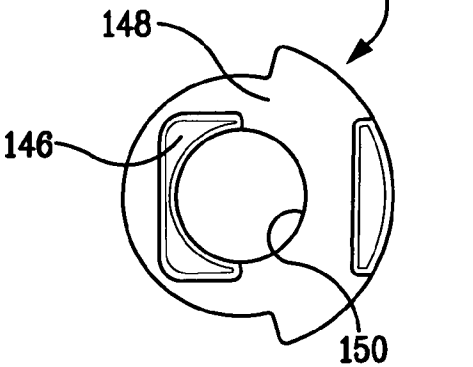
Figure 28:
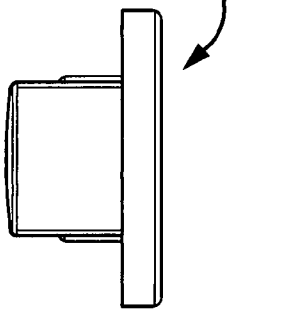
Figure 29:
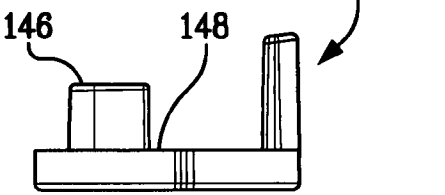
Figure 32:
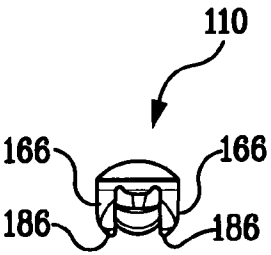
FIGS. 30-35 are views showing the handle of the compression latch mechanism according to the present invention.
Figure 31:
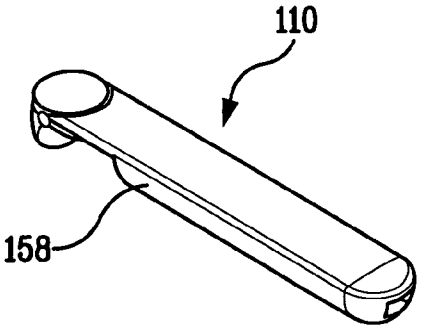
Figure 30:
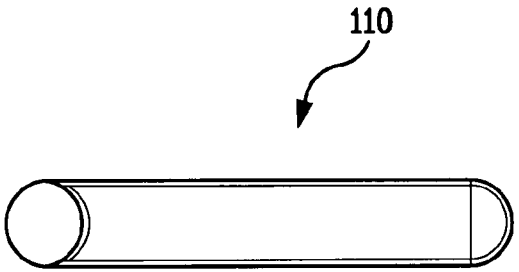
Figure 35:
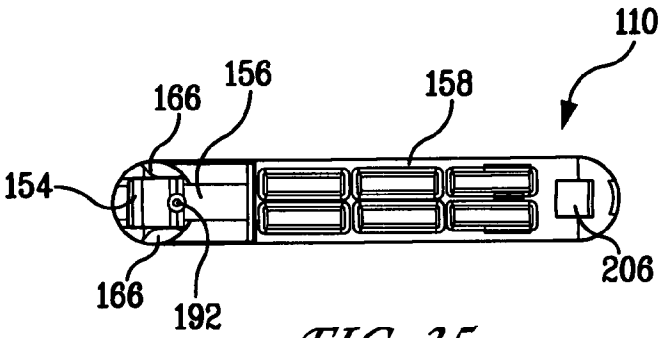
Figure 34:
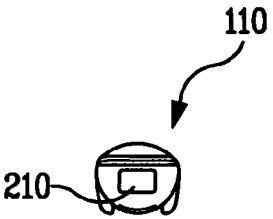
Figure 33:
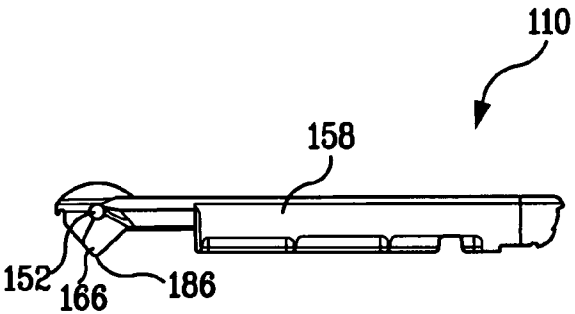
Figure 45:
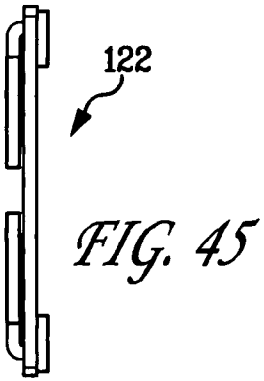
FIGS. 43-48 are views showing the pawl of the compression latch mechanism according to the present invention.
Figure 48:
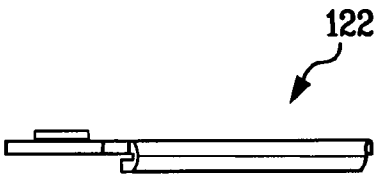
Figure 44:
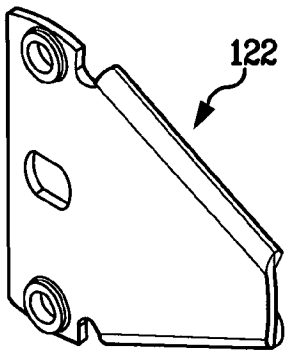
Figure 47:
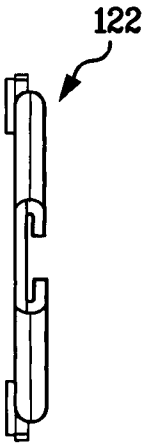
Figure 43:
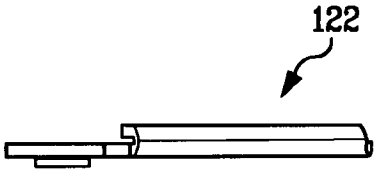
Figure 46:
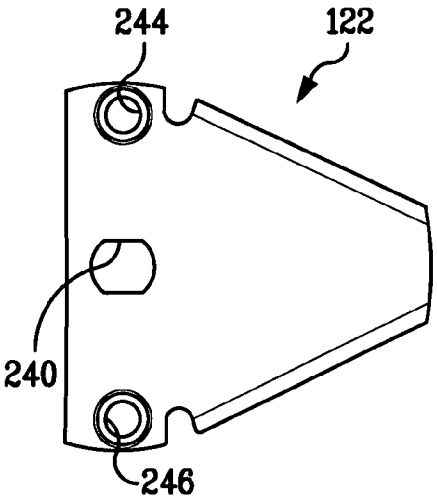
Figure 51:
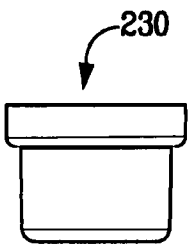
FIGS. 49-55 are views showing the handle lock mechanism cover of the compression latch mechanism according to the present invention.
Figure 54:
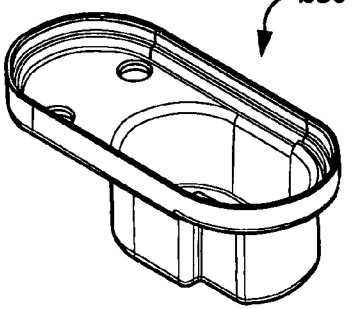
Figure 50:
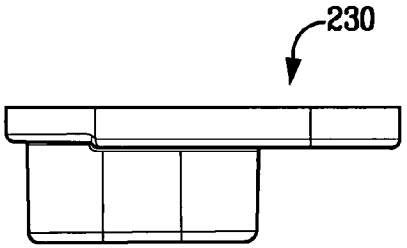
Figure 53:
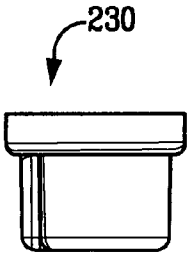
Figure 55:
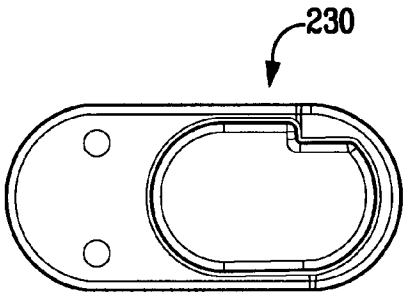
Figure 49:
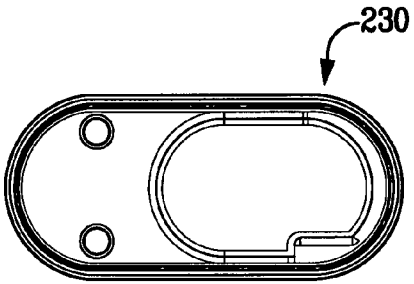
Figure 52:
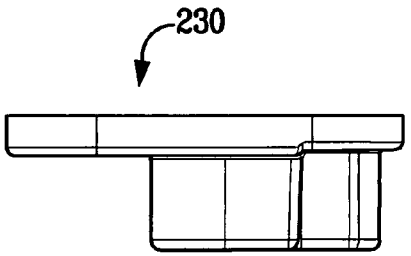
Figure 57:
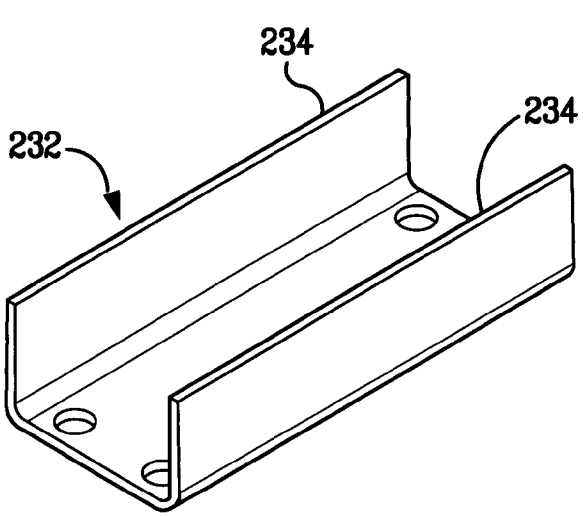
FIGS. 56-59 are views showing the mounting bracket of the compression latch mechanism according to the present invention.
Figure 59:
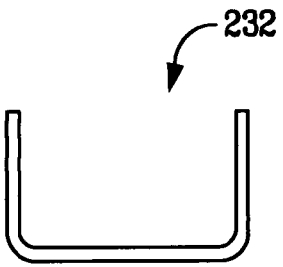
Figure 56:
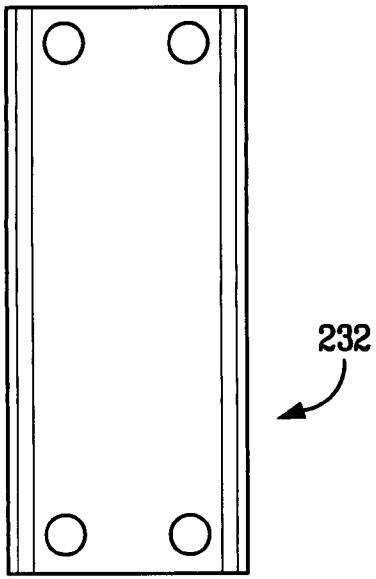
Figure 58:
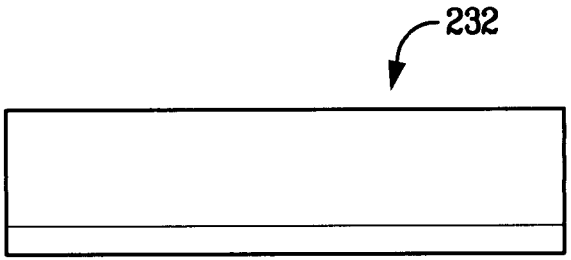
Figure 60:
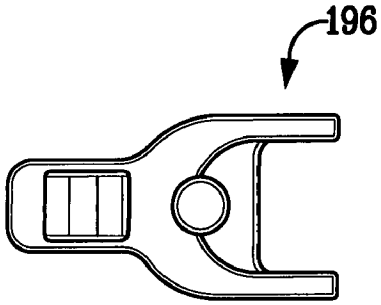
FIGS. 60-65 are views showing the handle retaining claw of the compression latch mechanism according to the present invention.
Figure 61:
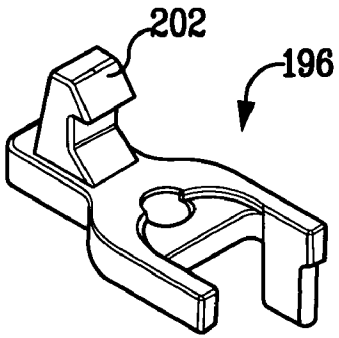
Figure 62:
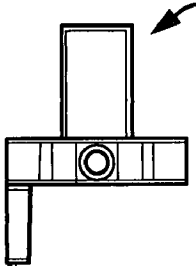
Figure 63:
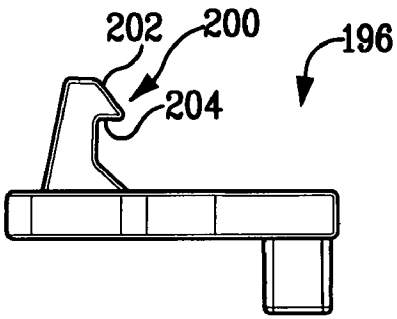
Figure 64:
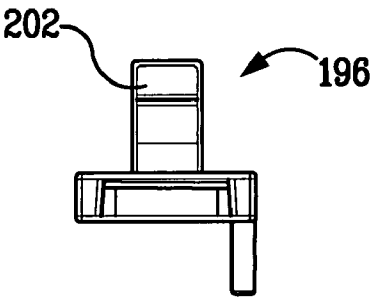
Figure 65:
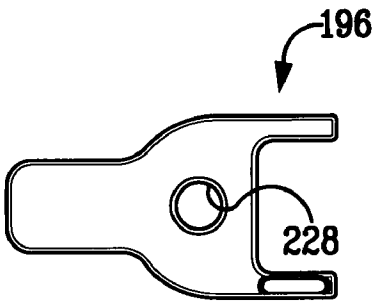
Figure 68:
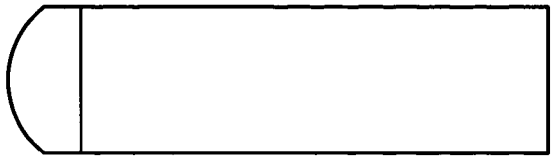
FIGS. 66-71 are views showing the hasp for use with a padlock of an alternative embodiment of the compression latch mechanism according to the present invention.
Figure 67:
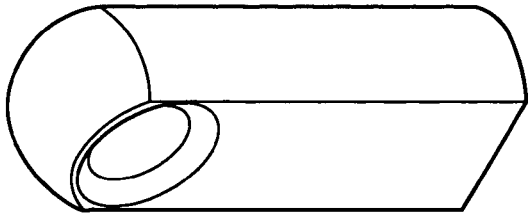
Figure 71:
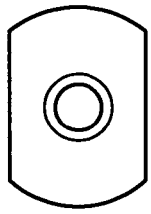
Figure 70:
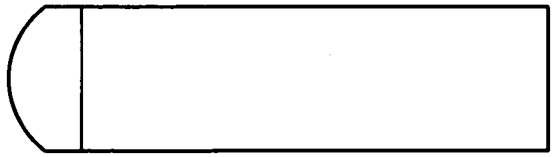
Figure 66:
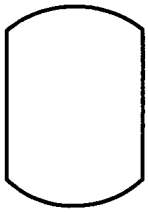
Figure 69:
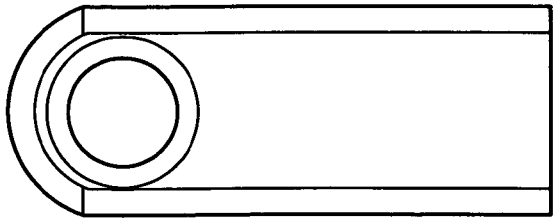
Figure 74:
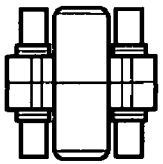
FIGS. 72-77 are views showing the claw catch of an alternative embodiment of the compression latch mechanism according to the present invention.
Figure 77:
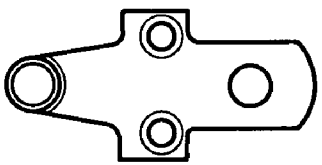
Figure 73:
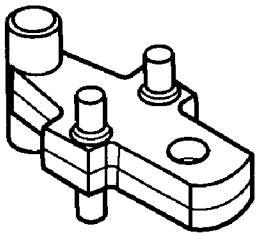
Figure 76:
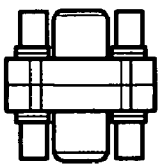
Figure 72:
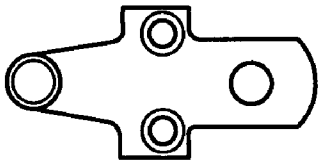
Figure 75:
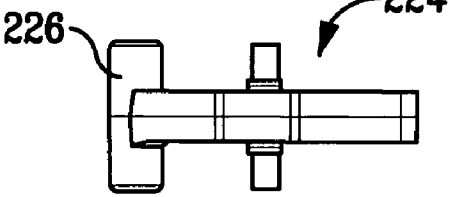
Figure 78:
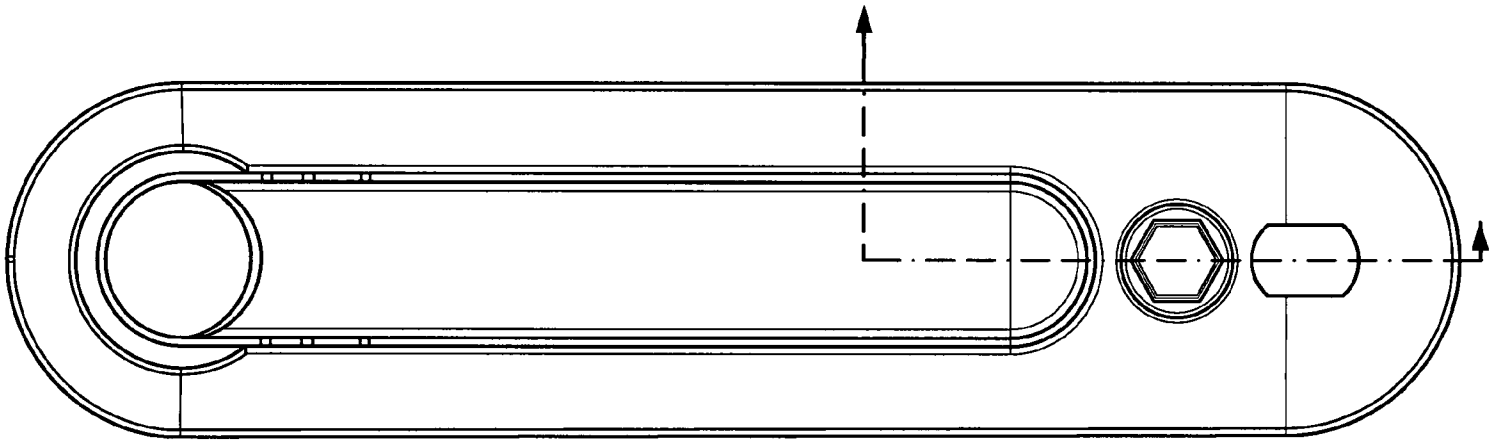
FIGS. 78-80 are views showing the handle lock mechanism of an alternative embodiment of the compression latch mechanism according to the present invention.
Figure 80:
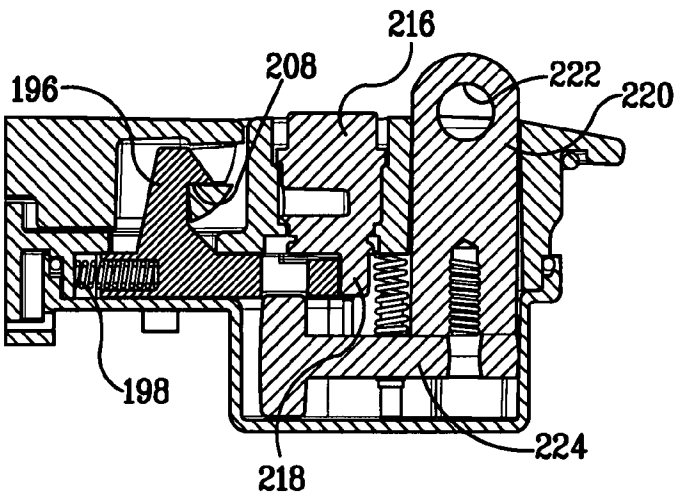
Figure 79:
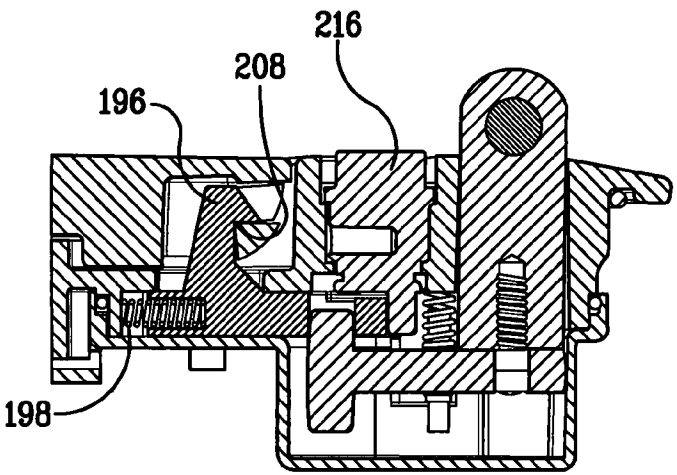
Figure 81:
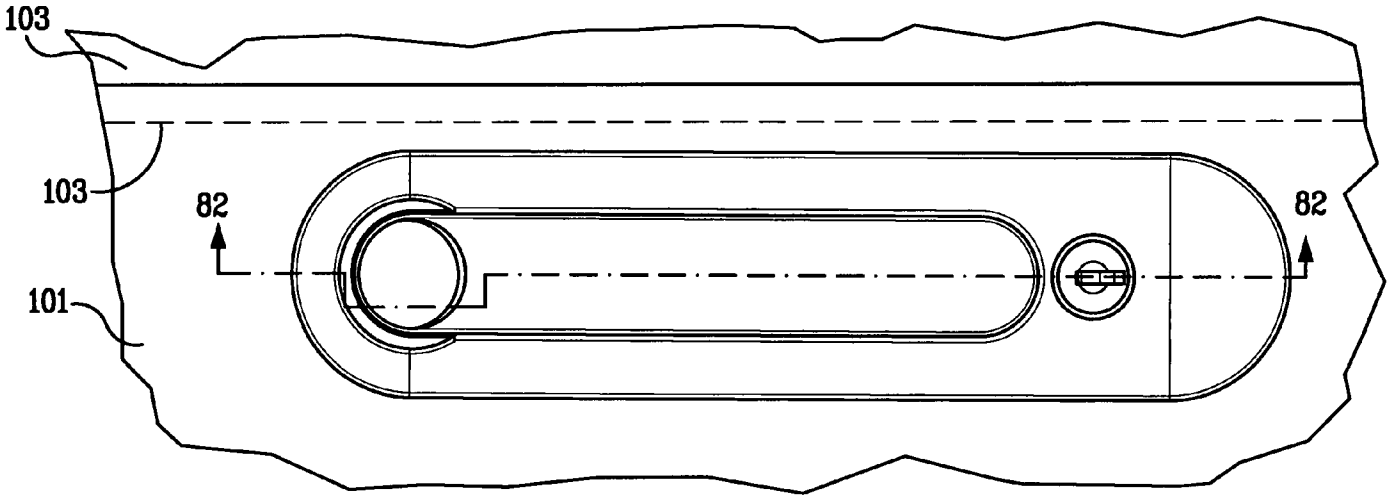
FIGS. 81-88 are views showing the operation of the compression latch mechanism according to the present invention.

The handle 110 is pivotally connected to the shaft 104 proximate the first end 134 of the shaft 104. The handle 110 also has a pair of holes 152 that are in alignment with each other and are used to pivotally connect the handle 110 to the shaft 104 to form the pivotal connection between the handle 110 and the shaft 104. The same pivot pin 142 that passes through the holes 144 and 140 also passes through the holes 152 to pivotally connect the kickstand 106, the handle 110 and the shaft 104 to one another about the same common pivot axis. The handle 110 moves pivotally relative to the shaft 104 about the pivot axis defined by the pivot pin 142 as the handle 110 is moved between the folded-down position and the first raised position. The handle 110 has a kickstand contact surface 154. The kickstand 106 and the handle 110 are pivotally movable relative to one another over a predetermined range of pivotal movement that is limited on one side of the pivot pin 142 by the kickstand contact surface 154. The handle 110 is also capable of being turned to a second raised position, as shown in FIGS. 4 and 5, to place the compression latch mechanism 100 in the unlatched configuration. The handle 110 also has an underside 156 and a grasping portion 158.

As best seen in FIGS. 12-16, the shaft 104 has a portion 188 that has threads that are interrupted by flat sides 190 on either side of the threaded portion 188. The threaded portion 188 includes the second end 128 of the shaft 104. The shaft 104 is provided with a hole 144 that passes through the shaft 104, transverse to the longitudinal axis of the shaft 104, at a location near the first end 134 of the shaft 104. The shaft 104 is provided with an annular groove 180 for engagement by the C-clip 178. The annular groove 180 is located near the top end of the threaded portion 188 of the shaft 104.

Figure 82:
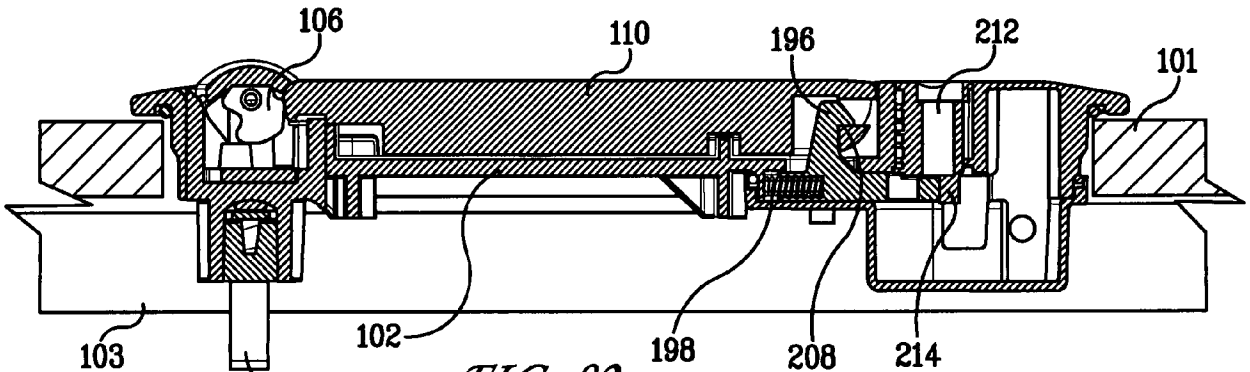
Figure 83:
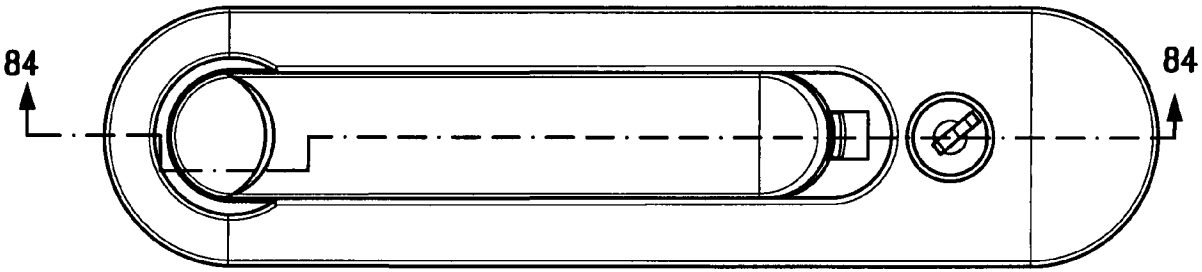
Figure 84:
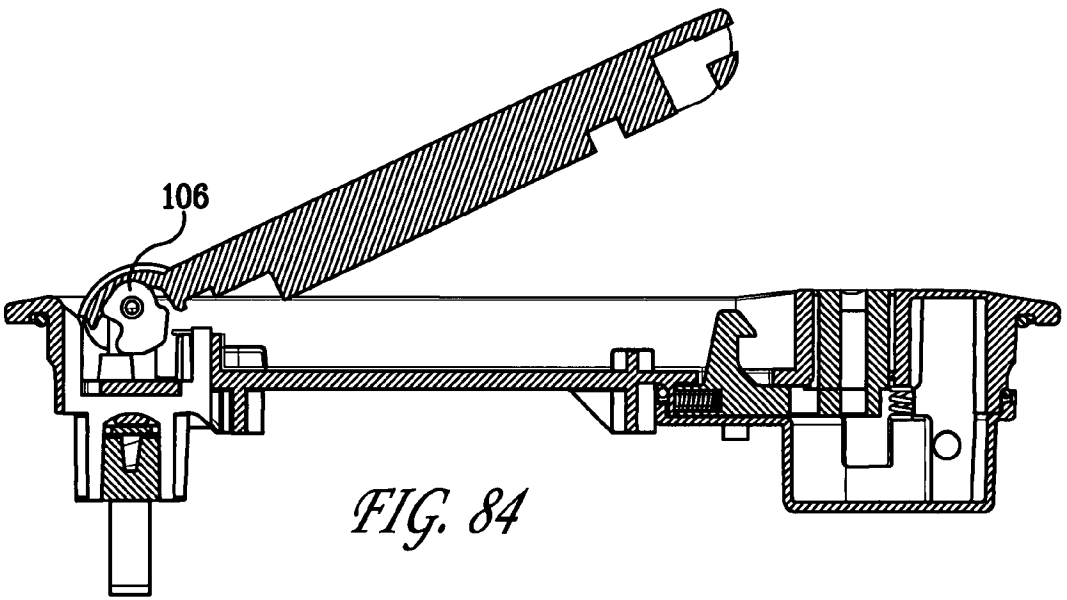
Figure 85:
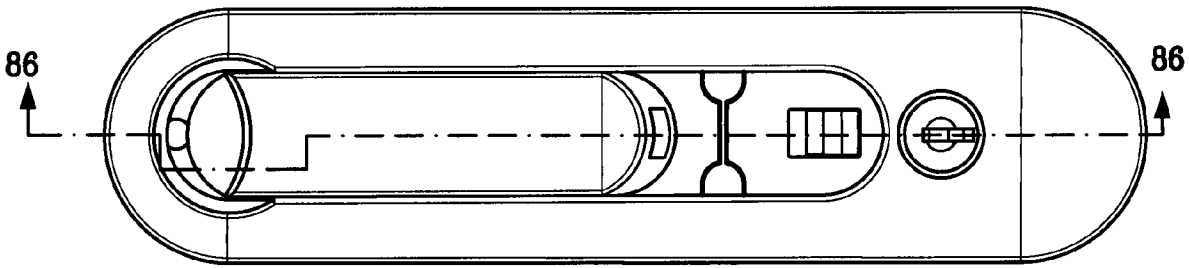
Figure 86:
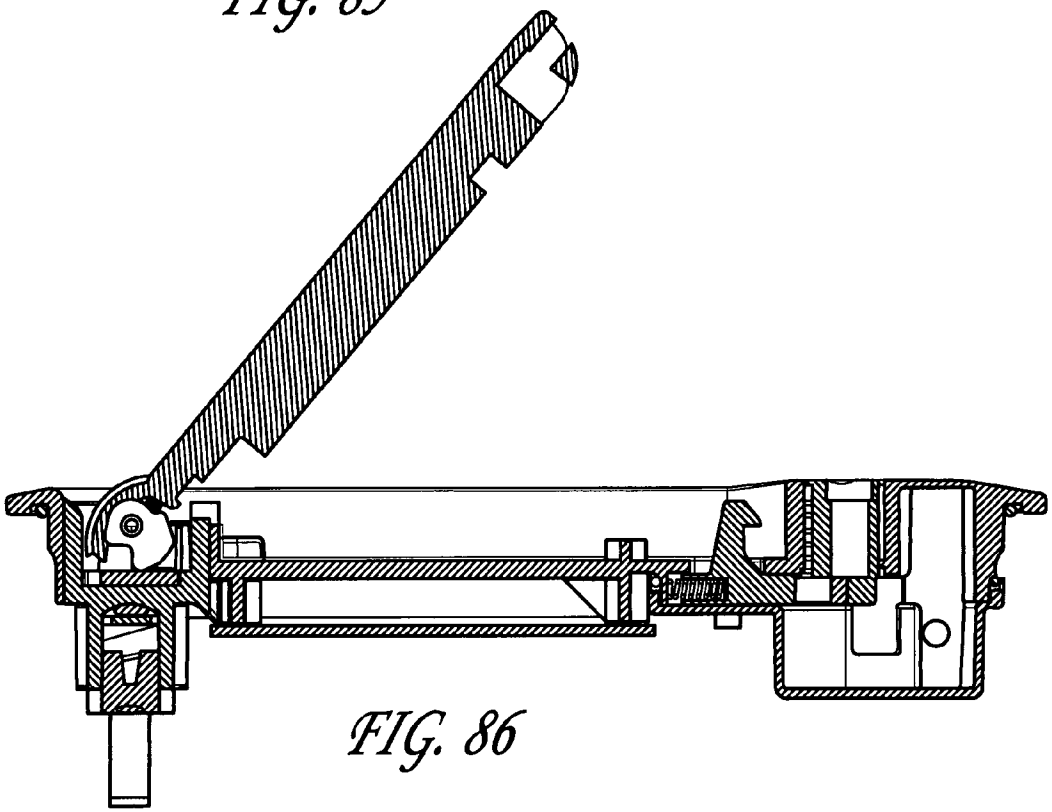
Figure 87:
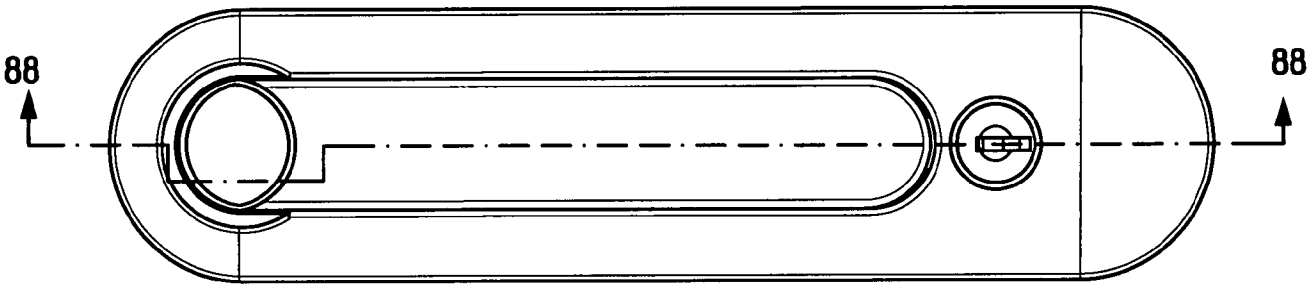
Figure 88:
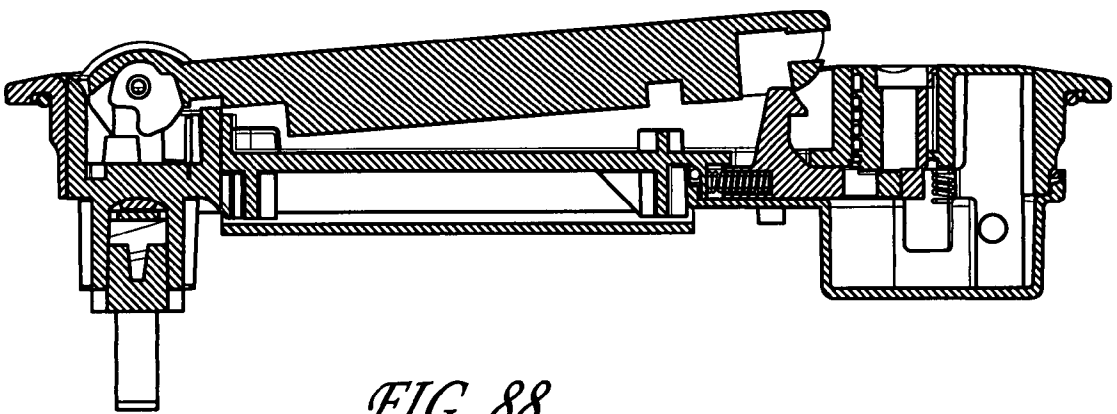
Figures 89, 90, 91:
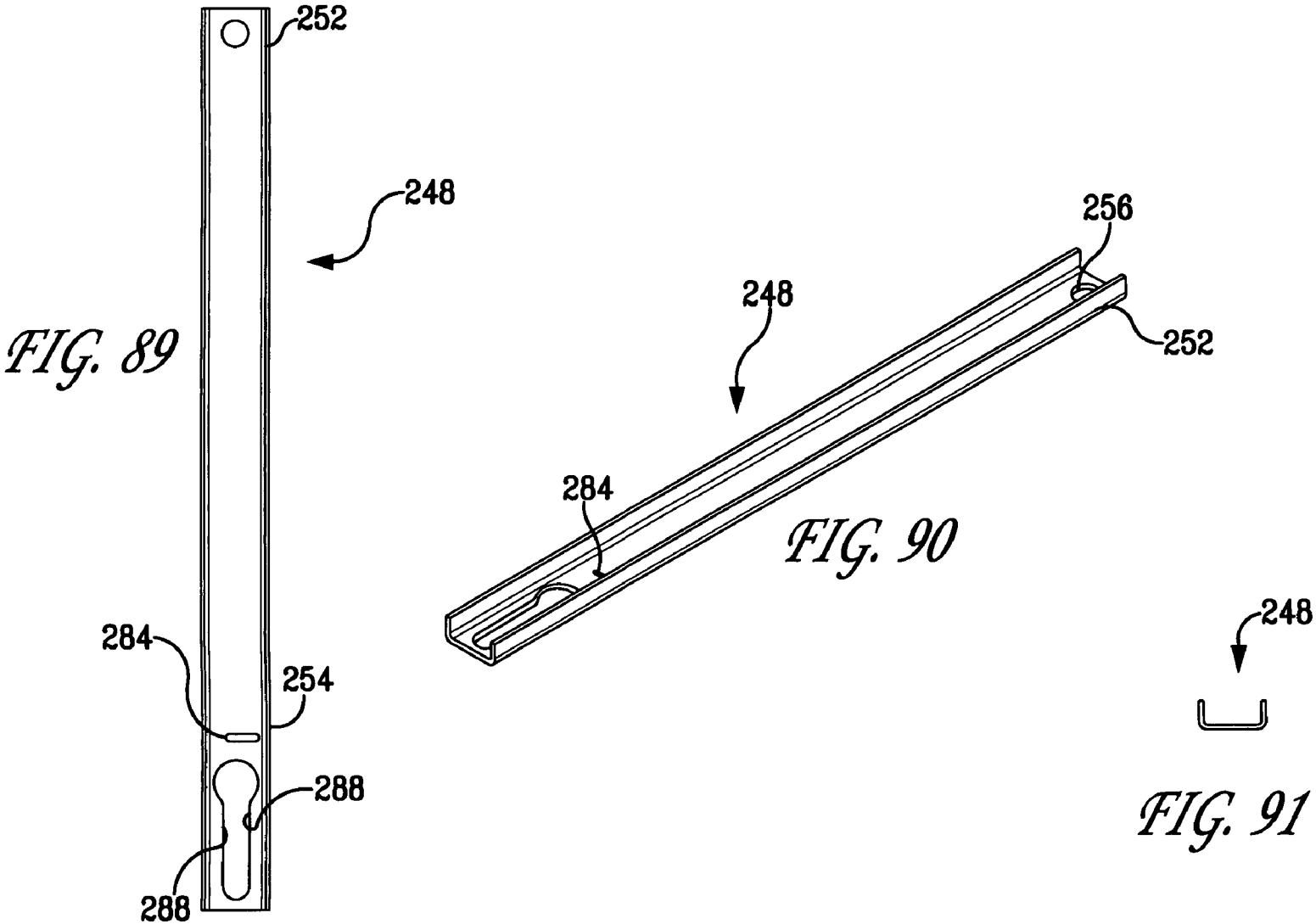
FIGS. 89-91 are views showing the remote latching rod of the compression latch mechanism according to the present invention.
Figure 92:
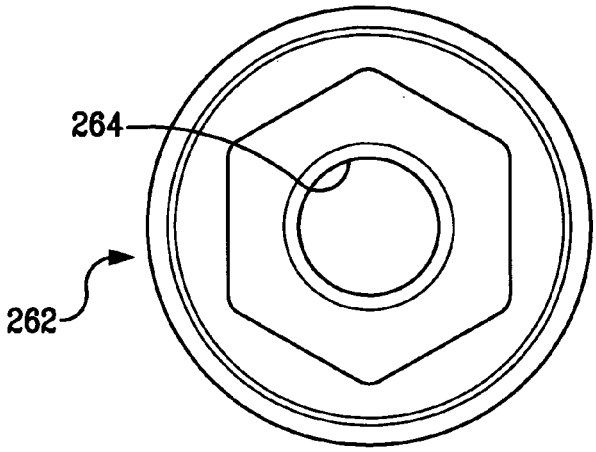
FIGS. 92-94 are views showing the rod guide of the compression latch mechanism according to the present invention.
Figure 93:
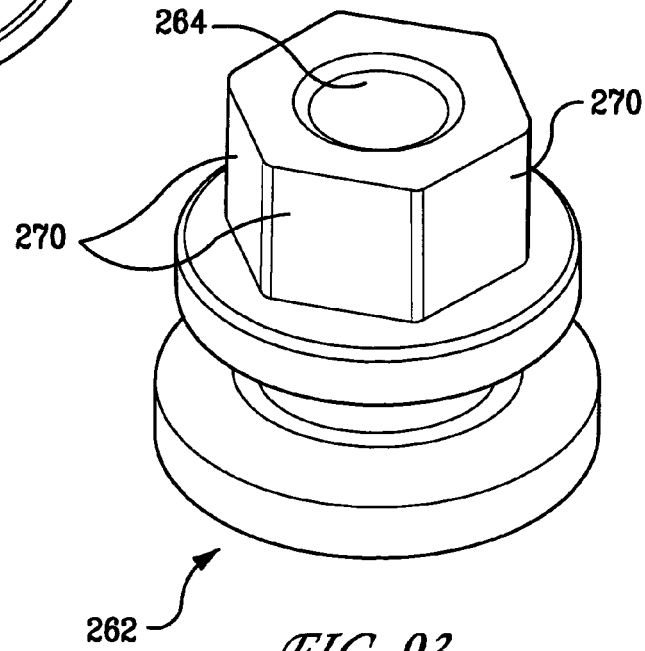
Figure 94:
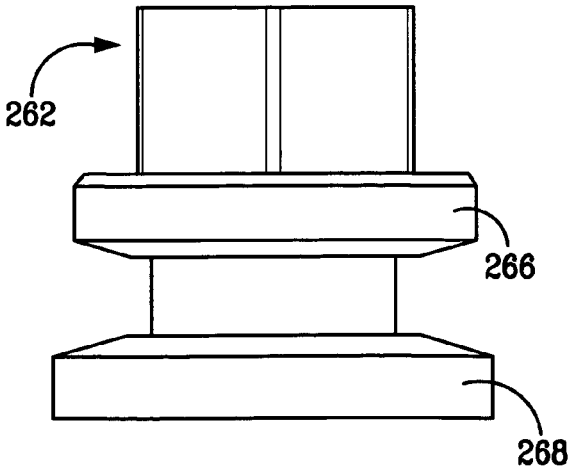
Figure 96:
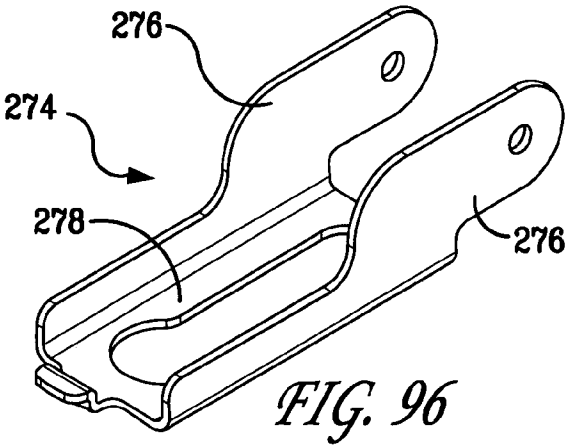
FIGS. 95-98 are views showing the rod end stamping of the compression latch mechanism according to the present invention.

A pawl 122 is provided for engaging the doorframe 103 to thereby secure the door 101 in the closed position and apply a compressive force between the door and the door frame as the shaft 104 is moved from the unlatched position to the latched position. The pawl 122 is mounted to the shaft 104 intermediate the second end of the shaft 104 and the housing 102. More particularly, the pawl 122 is mounted to the shaft 104 along the threaded portion 188 of the shaft 104. The pawl 122 is mounted to the shaft 104 such that at least a portion of the pawl 122 is positioned behind a structure fixed to or forming a part of the doorframe 103 when the compression latch mechanism is mounted to the door 101 and the shaft 104 is in one of the latched position (shown in FIG. 82) and the intermediate extended position (shown in FIG. 86). The pawl 122 moves between latched and unlatched positions (shown in FIGS. 2 and 3 and FIGS. 4 and 5, respectively) that correspond to the latched and unlatched positions of the shaft 104, respectively. The pawl 122 moves with the shaft 104 as a unit.

The first biasing means 112 is in the form of a compression coil spring and is provided for biasing the shaft 104 such that the second end 128 of the shaft 104 tends to project to a greater distance from the housing 102, and in particular from the sleeve 124, under the bias imparted to the shaft 104 by the first biasing means 112.

The shaft 104 is positioned at least in part within the bore 162 of the sleeve 124. The shaft 104 extends through the top opening 164 of the sleeve 124 such that the first end 134 of the shaft 104 is located in the receptacle portion 118 of housing 102. The portion of the shaft 104 including the first end 134 and the hole 144 is located in the portion of the receptacle portion 118 immediately surrounding the sleeve 124, where the pivotal connections between the kickstand 106, the handle 110 and the shaft 104 are made as was previously described. The shaft 104 also passes through the central hole 150 of the bearing plate 108 with the lower bearing surface 148 of the bearing plate 108 being positioned between the pin 142 and the top end of the sleeve 124 located closest to the receptacle portion 118. The lower bearing surface 148 of the bearing plate 108 reduces the wear on the housing 102 by providing a bearing surface against which the cam lobe 166 of the handle 110 can bear as the handle 110 is alternately folded and raised. Thus, the bearing plate 108 allows the housing 102 to be manufactured from less expensive materials. However, it is also possible for the bearing plate 108 to be made in one piece with the housing 102.

The top opening 164 of the sleeve 124 has a smaller diameter than the bore 162 of the sleeve 124, thus forming the annular shoulder 168. The o-ring 170 is positioned in the bore 162 against the shoulder 168. The washer 172 is positioned in the bore 162 adjacent the o-ring 170. Both the o-ring 170 and the washer 172 surround the shaft 104. The washer 172 provides a protective surface for one end of the spring 112 to bear against while the o-ring 170 seals any gaps between the shaft 104 and the top opening 164 of the sleeve 124. The spring 112 is also positioned substantially within the bore 162 of the sleeve 124 of the housing 102 and its coils surround the shaft 104. The bushing 174 receives the lower end of the spring 112 such that the lower end of the spring 112 bears against a shoulder 176 within the bushing 174. The bushing 174 encircles the shaft 104 and lies at least in part within the bore 162 of the sleeve 124 of the housing 102. A C-clip 178 engages an annular groove 180 to keep the bushing 174 in place around the shaft 104.

Prismatic projections 182, also referred to herein as lateral projections, project from either side of the bushing 174 that is supported by the shaft 104. The sleeve 124 of the housing 102 is provided with a pair of notches or slots 184 in the end of the sleeve 124 that is distal from the receptacle portion 118 of the housing 102. The lateral projections 182 register with the pair of slots 184 when the pawl 122 is in a rotational position corresponding to the latched position of the pawl 122. In other words, the lateral projections 182 register with the pair of slots 184 only when the handle 110 is at or between the first raised position and the folded-down position. When the handle 110 is turned to rotate the pawl 122 out of the rotational position corresponding to its latched position, the projections 182 will be out of alignment with the slots 184. With the projections 182 in such a position, the projections 182 are positioned very close to the rim of the distal end of the sleeve 124. The handle 110 has at least one cam lobe 166 defining a handle cam surface 186. In the illustrated example, two cam lobes 166 are provided on either side of the kickstand 106. With the handle 110 in the first or second raised position, or in any position therebetween, the handle cam surface 186 contacts the lower bearing surface 148 of the bearing plate 108 and tends to lift the first end 134 of the shaft 104 away from the bearing plate 108 if any attempt is made to fold down the handle 110. Any such attempt brings the projections 182 into interference with the rim of the distal end of the sleeve 124, which then prevents the handle 110 from being folded down any further when the pawl 122 and the handle 110 are not in a rotational position corresponding to their latched positions. Thus, movement of the handle 110 in a manner tending toward folding down of the handle is effectively prevented when the projections 182 are not in alignment with the slots 184. When the lateral projections 182 are in registry with the pair of slots 184, which corresponds to the handle 110 being at or between the first raised position and the folded-down position, rectilinear motion of the shaft 104 and the pawl 122 to the latched position will be allowed in response to movement of the handle 110 toward the folded-down position.

As one alternative design, the end of the spring 112 closest to the second end 128 of the shaft 104 can bear against an annular collar placed around the shaft 104 and held in place by a pin passing through the shaft 104 with the collar being held between the pin and the spring 112. The ends of the pin could perform the function of the projections 182 if the pin is sufficiently long.

As yet another alternative, the collar describe with reference to the previous alternative may be provided with diametrically aligned holes that register with a hole in the shaft 104. The retaining pin would then pass through both the shaft 104 and the collar to retain the spring 112 in place around the shaft 104. Again, the ends of the retaining pin could perform the function of the projections 182 if the pin is sufficiently long.

The spring 112 is under compression and acts as a biasing means tending to bias the threaded portion 188 of the shaft 104 away from housing 102. The biasing force of the spring 112 is applied to the shaft 104 through the bushing 174 and the C-clip 178.

The second biasing means 114 is provided for biasing the handle 110 from the folded-down position toward an intermediate position between the folded-down position and the first raised position and for biasing the kickstand 106 into a latched position. The second biasing means 114 is in the form of a compression coil spring 114 provided between the handle 110 and the kickstand 106 on one side of the pivot pin 142. The spring 114 is provided on one side of the pivot pin 142 opposite the kickstand contact surface 154 of the handle 110. Accordingly, the spring 114 tends to push the handle 110 and the kick stand 106 apart on one side of the pin 142, and the spring 114 tends to push the kickstand contact surface 154 of the handle 110 into contact with the kickstand 106. A portion of the spring 114 at one of its ends is received in the cavity 192 formed in the underside of the handle 110. The other end of the spring 114 is in contact with the kickstand 106. The kickstand 106 is provided with a projection 194 that projects through one or more coils of the spring 114 near the end of the spring 114 that is in contact with the kickstand 106. The cavity 192 and the projection 194 cooperatively keep the spring 114 in the proper position.

The catch means 116 is provided for selectively securing the handle 110 in the folded-down position. Keeping the handle 110 folded down inside the receptacle portion 118 of the housing 102 reduces the vulnerability of the latch mechanism 100 to vandalism. The catch means 116 includes a sliding claw 196 supported by the housing 102 for rectilinear movement between an engaged position and a disengaged position. The catch means 116 further includes a spring 198 that biases the claw 196 toward the engaged position. The claw 196 is positioned under the grasping portion of the handle 110 and is completely hidden when the handle 110 is in the folded-down position. The claw 196 has a beveled projection 200 that has a beveled surface 202 and a catch surface 204. In the disengaged position the claw 196 registers with a cavity 206 formed in the underside of the grasping portion of the handle 110. A step 208 is formed inside the cavity 206 by the intersection of the cavity 206 and the transverse bore or opening 210. The catch surface 204 engages the step 208 to retain the handle 110 in the folded-down position. The beveled surface 202 interacts with the edge of the cavity 206 to move the claw 196 to the disengaged position to thereby allow the claw 196 to move into the cavity 206 as the handle 110 is being moved to the folded-down position. Once the handle 110 is in the folded-down position, the catch surface 204 moves under the force exerted by the spring 198 into engagement with the step 208 to retain the handle 110 in the folded-down position.

The latch mechanism 100, further includes a lock cylinder 212 that is supported by the housing 102. The lock cylinder 212 is operated by a key in the conventional manner. Once the key in inserted in the lock cylinder 212, the lock cylinder 212 can be turned about its own longitudinal axis by a user using the key. With the key inserted the lock cylinder 212 can be rotated between locked and unlocked positions. A cam projection 214 is provided at the inner end of the lock cylinder 212 in an eccentric position relative to the longitudinal axis of the lock cylinder. As the lock cylinder 212 is rotated to the unlocked position, the cam projection 214 pushes the claw 196 to the disengaged position to thereby release the handle 110 from the folded-down position. The lock cylinder 212 is rotated to the locked position to enable the removal of the key. With the key removed, the lock cylinder 212 cannot rotate and remains in the locked position. With the lock cylinder 212 in the locked position, the claw 196 is free to return to the engaged position where it can engage the handle 110 when it is returned to the folded-down position to once again retain the handle 110 in the folded-down position.

In an alternative embodiment, the lock cylinder 212 is replaced by a plug 216 that is rotationally supported by the housing 102 for rotation between locked and unlocked positions. The plug 216 has a hexagonal head for engagement with a tool having a hexagonal socket that is used for turning the plug 216. The plug 216 can of course be provided with any one of a myriad of alternative head styles that can be turned by a matching tool; slotted, Phillips, and Allen heads being among the alternative head styles. The plug 216 is also provided with an eccentric cam projection 218 that functions like the cam projection 214. For preventing unauthorized access, this embodiment relies on a padlock. Accordingly, a padlock hasp 220 supported by the housing 102 is provided in this embodiment. The hasp 220 is retractable and is movable between a retracted and an extended position. The hole 222 in the hasp 220 for the engagement of the padlock shackle is partially covered when the hasp 220 is in the retracted position. The hasp 220 must be pulled to the extended position to allow the hasp to be engaged by the padlock. The padlock hasp 220 is attached to a claw catch 224 that moves rectilinearly with the padlock hasp as the padlock hasp is moved between the retracted and extended positions. When the hasp 220 is in the extended position, the claw catch 224 is in the engaged position. When the hasp 220 is in the retracted position, the claw catch 224 is in the disengaged position. The claw catch 224 moves in a direction perpendicular to the direction of motion of the claw 196 and has a post 226 that engages a hole 228 in the claw 196 to keep the claw 196 in the engaged position when the claw catch 224 is in its engaged position. The claw 196 can be moved to its disengaged position when the claw catch 224 is in its disengaged position. The hasp 220 and the claw catch 224 are spring biased toward the retracted and the disengaged positions respectively. The hasp 220 is pulled to the extended position and is maintained there by the engagement of the padlock with the hasp 220. This locks the claw 196 and the claw catch 224 in their respective engaged positions, which in turn locks the handle 110 in the folded-down position, assuming the handle 110 was in the folded-down position when the padlock was applied. Removing the padlock disengages the claw catch 224 from the claw 196, which allows the handle 110 to be released by turning the plug 216. A protective cover 230 is provided for protecting the cylinder lock 212 or the combination of the plug 216 and the hasp 220 from the elements.

Referring to FIGS. 1, 56-59, 81 and 82, the latch mechanism 100 is mounted to an opening or hole in the door 101. The opening in the door 101 is shaped and sized to provide clearance for the side walls of the receptacle portion 118 of the housing 102 but not for the flange 120. To mount the latch mechanism 100 to the door 101, the receptacle portion 118 of the housing 102 is placed through the opening in the door 101 such that the underside of the flange 120 abuts the exterior surface of the door 101. A bracket 232 is placed over the receptacle portion 118 of the housing 102 such that the edges 234 of the bracket 232 abut the interior surface of the door 101. The dimension of the bracket 232 measured across the edges 234 is too large to clear the opening in the door 101. Four fasteners 236 are used to secure the bracket 232 to the housing 102. Thus, at least a portion of the door 101 is captured intermediate the flange 120 and the bracket 232 to secure the latch mechanism 100 to the door 101. A flange seal 238 may be provided between the flange 120 and the exterior surface of the door 101 to seal off any crevices between the housing 102 and the door 101 in applications where leak-proofing the latch is important.

Figure 2:
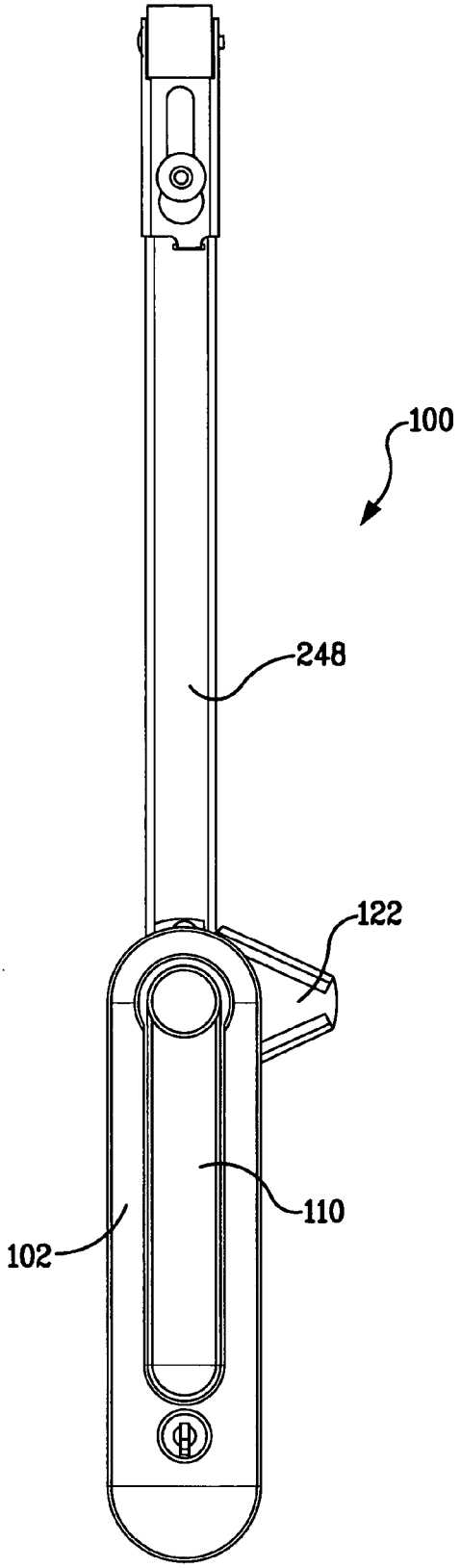
FIGS. 2-3 are views showing the compression latch mechanism according to the present invention in the latched configuration.
Figure 3:
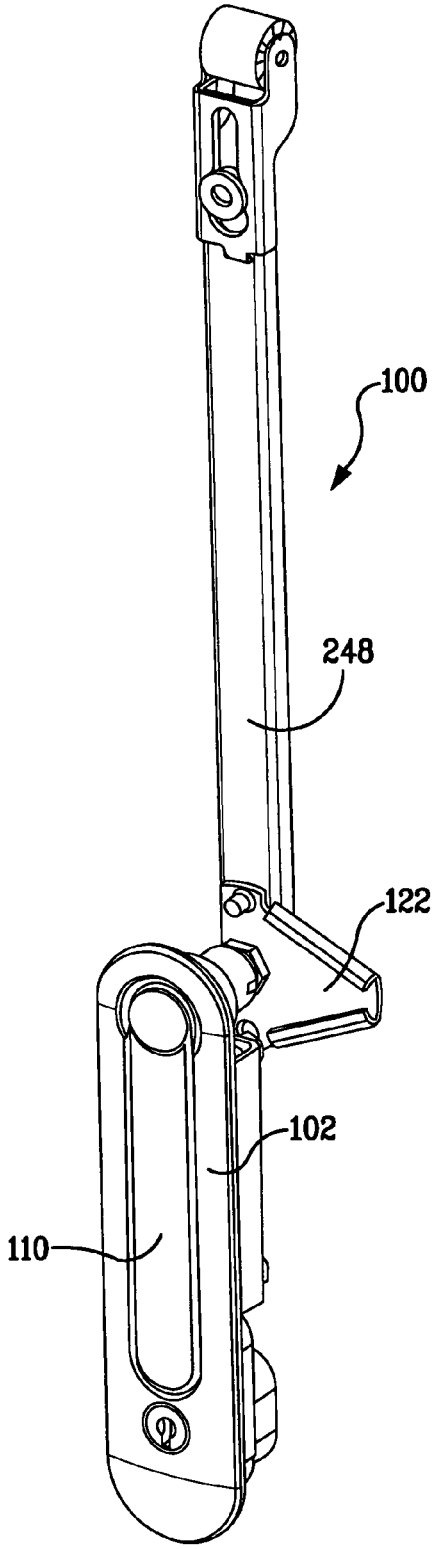

The pawl 122 has one end that is adapted for engaging the door frame 103, or a keeper, when the pawl 122 is in the latched configuration shown in FIGS. 2 and 3. The pawl 122 has a hole 240 in a location spaced apart from the end adapted to engage the doorframe 103. The hole 240 is shaped to correspond to the cross section of the threaded portion 188 of the shaft 104 and has flat sides that engage the flat sides 190 of the threaded portion of the shaft 104 such that the shaft 104 and the pawl 122 rotate together as a unit about the longitudinal axis of the shaft 104 when the threaded portion of the shaft 104 is placed through the hole 240 of the pawl 122. The pawl 122 is adjustably secured in position along the threaded portion 188 of the shaft 104 by a pair of nuts 242. The nuts 242 are engaged to the threaded portion of the shaft 104 and tightened against the pawl 122 to secure the pawl 122 in place once the pawl 122 is mounted on the threaded portion of the shaft 104. Lock washers can be provided intermediate the pawl 122 and the nuts 242 to reduce the chance of the nuts 242 becoming loose during operation and use of the latch mechanism 100.

With the compression latch mechanism 100 in the latched configuration, the handle 110 is secured in the folded-down position and the shaft 104 is in the latched position and is held there by the bearing surfaces 136 of the kickstand 106 being positioned between the first end 134 of the shaft 104 and the raised bearing surface 146. Also in this configuration, the pawl 122 is drawn or pulled up behind the doorframe 103 to thereby exert a compressive force between the door 101 and the doorframe 103.

When the catch means 116 is operated by a user to release the handle 110, for example by turning the lock cylinder 212 or the plug 216, the handle 110 moves to the intermediate position under bias provided by the second biasing means 114 without affecting the position of the kickstand 106 and the shaft 104. In the illustrated example, the handle 110 pops out to an angle of approximately 10° from the housing 102 relative to its folded-down position. The pawl 122 and the shaft 104 remain in their latched positions.

As the handle 110 is moved from the intermediate position toward the first raised position by the user, the handle 110 moves the kickstand 106 pivotally relative to the shaft 104, through contact between the kickstand contact surface 154 of the handle 110 and the kickstand 106, until the relief notches 138 register with the raised bearing surface 146 whereupon the shaft 104 moves rectilinearly in a direction coincident with the longitudinal axis under the bias of the first biasing means 112 such that the second end 128 of the shaft 104 moves toward an intermediate extended position. The intermediate extended position is intermediate the latched position and the unlatched position. The second end of the shaft 104 projects to its maximum distance from the housing 102 in the intermediate extended position. The pawl 122 also moves rectilinearly with the shaft 104 such that it moves away from behind the doorframe 103 to thereby relieve the compression applied between the door 101 and the doorframe 103.

Subsequently the handle 110 can be turned from the first raised position to the second raised position by the user to rotate the shaft 104 about its longitudinal axis to the unlatched position. During this operation, the pawl 122 is also rotated out from behind the doorframe 103, there allowing the door 101 to be opened. In the illustrated example, the handle 110 is at an angle of Approximately 45° relative to its folded-down position and projects outward from the open top of the housing 102 at about the same angle in both the first and second raised positions and at every position therebetween. The handle 110 is turned about an axis of rotation coincident with the longitudinal axis of the shaft 104 to move the handle 110 from the first raised position to the second raised position. Furthermore, the handle 110 is turned about the longitudinal axis of the shaft 104 through an angle of 60° or greater, and preferably of about 90°, to move the handle 110 from the first raised position to the second raised position.

When the compression latch mechanism 100 is in the unlatched configuration the handle 110 is in the second raised position and the shaft 104 is in the unlatched position.

Also, the pawl 122 is out from behind the doorframe 103 and does not overlap any part of the doorframe 103.

To latch the door 101 in the closed position the door is first moved to an approximately closed position relative to the door frame 103. Then the handle 110 is turned from the second raised position to the first raised position by the user by rotating the handle 110 about the longitudinal axis of the shaft 104. Turning the handle 110 from the second raised position to the first raised position causes the shaft 104 to rotate about its longitudinal axis from the unlatched position to the intermediate extended position. At this time the pawl 122 is also rotated behind the doorframe 103 such that the pawl 122 now overlaps the doorframe 103.

The handle 110 can then be moved from the first raised position to the folded-down position to draw up the pawl 122 behind the doorframe 103 and thus generate a compressive force between the door 101 and the doorframe 103 to thereby tightly secure the door 101 in the closed position and compress any sealing gasket that may be present between the door 101 and the doorframe 103. As the handle 110 is moved from the first raised position toward the folded-down position by the user, a portion of the underside of the handle 110 located intermediate the grasping portion and the pivotal connection between the handle 110 and the shaft 104 contacts the first bearing surface 130 of the housing 102 such that the first bearing surface 130 of the housing 102 defines a fulcrum point and the handle 110 acts as a lever to lift the kickstand 106 and the first end 134 of the shaft 104 away from the bearing plate 108 to thereby increasingly elevate the kickstand 106 and the first end of the shaft 104 above the bearing plate 108. Once the raised bearing surface 146 of the bearing plate 108 completely clears the relief notches 138, the kickstand 106 moves pivotally relative to the shaft 104 under a biasing force provided by the second biasing means 114 such that the bearing surfaces 136 of the kickstand 106 are positioned between the first end 134 of the shaft 104 and the raised bearing surface 146 to thereby maintain the shaft 104 in the latched position. The pawl 122 is also now in the latched position and maintained there by the bearing surfaces 136 of the kickstand 106 being positioned between the first end 134 of the shaft 104 and the raised bearing surface 146. Also, once the handle 110 reaches the folded-down position, the catch means 116 secures the handle 110 in the folded-down position. The padlock can now be applied or the key removed from the lock cylinder 212 to thereby prevent unauthorized opening of the door 101.

Referring to FIGS. 1-5, the latch mechanism 100 also has provision for multi-point latching, i.e. latching the door to the doorframe simultaneously at multiple points along the doorframe. This capability is achieved by further providing for the pawl 122 to have first and second holes 244 and 246 in addition to the hole 240 for the attachment of remote latching rods 248 (only one is shown). The first and second holes 244 and 246 are positioned on either side of the shaft 104 and the hole 240. Each of the first and second holes 244 and 246 have a center, with the shaft 104 and the hole 240 being positioned at about the midpoint of a line extending from the center of the first hole 244 to the center of the second hole 246.

First and second remote latching rods 248 may be attached to the pawl 122 using various types of fasteners placed through a respective one of the holes 244 and 246. In the illustrated example, the holes 244 and 246 are threaded and rod mounting screws 250 are used to pivotally attach the rod 248 to the pawl 122. Also in the illustrated example, only the first rod 248 is shown and is described in detail given that the second remote latching rod will be identical to the first except that it will be mounted to the hole 246.

The remote latching rod 248 is an elongated rod formed from sheet metal and has a cross section in the form of a rectangular channel that is open on one side. The remote latching rod 248 has a first end 252 and a second end 254. The first end 252 is the proximal end being closer to the pawl 122, and the second end 254 is the distal end being farthest from the pawl 122. The remote latching rod 248 has a first hole 256 near its proximal end that is placed in registry with a hole 244 or 246. A fastener 250 is then positioned to extend through the hole 256 and is threadedly engaged to the hole 244 or 246 to attach the rod 248 to the pawl 122. The remote latching rod 248 supports a freely rotating roller 258 at its distal end. The rod 248 is pivotally supported near its distal end by the interior surface of the door 101 in a manner that will be described later.

The pawl 122 rotates about the longitudinal axis of the shaft 104. The holes 244 and 246 are located eccentrically relative to the longitudinal axis of the shaft 104. Accordingly, as the pawl 122 rotates between the unlatched position and a rotational position where it is in line with its latched position, the distal end of the rod 248 moves substantially rectilinearly. The latch mechanism 100 is installed to the door 101 such that as the pawl 122 rotates from the unlatched position to a rotational position where it is in line with its latched position, the roller 258 rides over the backside of the doorframe 103 to latch the door 101 to the doorframe 103 at a point spaced apart from the location where the pawl 122 engages the doorframe 103. Thus the rod 248 provides for multipoint latching of the door to the doorframe. Furthermore, as the pawl 122 rotates from the rotational position where it is in line with its latched position to the unlatched position, the roller 258 is withdrawn from behind the doorframe 103 to allow the door 101 to be opened.

The grip of the roller 258 is defined by the distance between the roller 258 and the plane defined by the back side of the door 101 measured in a direction perpendicular to the plane defined by the back side of the door. The rod 248 of the present invention provides for this grip to be adjustable to accommodate doorframes of varying thickness. The rod 248 has a first slot 260 that has a pair of parallel elongated sides. A rod guide 262 is provided that is in the form of a sleeve having a threaded bore 264 and a pair of annular flanges 266 and 268 that are spaced apart from one another. The first pair of parallel elongated sides of the slot 260 are spaced apart a distance that is less than the diameter of the annular flanges 266 and 268, and the first pair of parallel elongated sides of the slot 260 fit between the annular flanges 266 and 268 such that the distal end of the rod 248 can move rectilinearly and pivotally relative to the rod guide 262 while being properly constrained and guided in its movements by the rod guide 262. One end of the slot 260 that is outside the normal range of relative movement between the distal end of the rod 248 and the rod guide 262 after installation, is enlarged to allow the flanges 266 and 268 to clear the slot 260 to allow for the assembly of the rod guide 262 to the distal end of the rod 248. One portion of the sleeve forming part of the rod guide 262 and not intermediate the flanges 266 and 268 is faceted and is provided with facets 270 to allow the use of a tool such as a wrench in rotating the rod guide 262. In use, the first pair of parallel elongated sides of the slot 260 are positioned between the pair of annular flanges 266 and 268 of the rod guide 262 with a portion of the sleeve of the rod guide extending through the slot 260 to is thereby guide the movements of the rod 248.

The rod guide 262 is capable of engaging a threaded post 272 that projects from the back side of the door 101 by a threaded engagement. The threaded engagement between the rod guide 262 and the threaded post 272 allows for adjustment of the grip of the roller 258, because rotating the rod guide 262 relative to the post 272 changes the height of the rod guide 262 above the interior surface of the door 101 and thus varies the grip of the roller 258.

When greater adjustment is needed, the rod 248 is made such that the roller 258 is supported by an interchangeable piece that can be exchanged for another piece providing a different grip that can be supplied as part of a kit. Thus the roller 258 is supported by an interchangeable rod end stamping 274 that is connected to the rod 248 near its distal end. The interchangeable rod end stamping 274 includes a stamped sheet metal base having two side walls 276 and a connecting wall 278 bridging the gap between the side walls 276. The side walls 276 are approximately perpendicular to the connecting wall 278. A shaft or rivet 280 extends between sidewalls 276 and supports the roller 258 for free rotational movement. A tab 282 extends from one end of the connecting wall 278 and has a series of two substantially right angle bends in opposite directions to give the tab a stepped profile. The tab 282 engages the slot 284 in the rod 248. The connecting wall 278 also has a slot 286 that is identical in outline to the slot 260. The slot 286 and the slot 260 are superimposed after assembly. The pair of parallel elongated sides 288 and 290 of both slots 260 and 286, respectively, are positioned between the pair of annular flanges 266 and 268 of the rod guide 262 after assembly. Thus the tab 282 and the rod guide 262 cooperate to keep the rod 248 and the stamping 274 together. The geometry of the sidewalls 276 can be changed to vary the grip of the roller.

Figure 99:
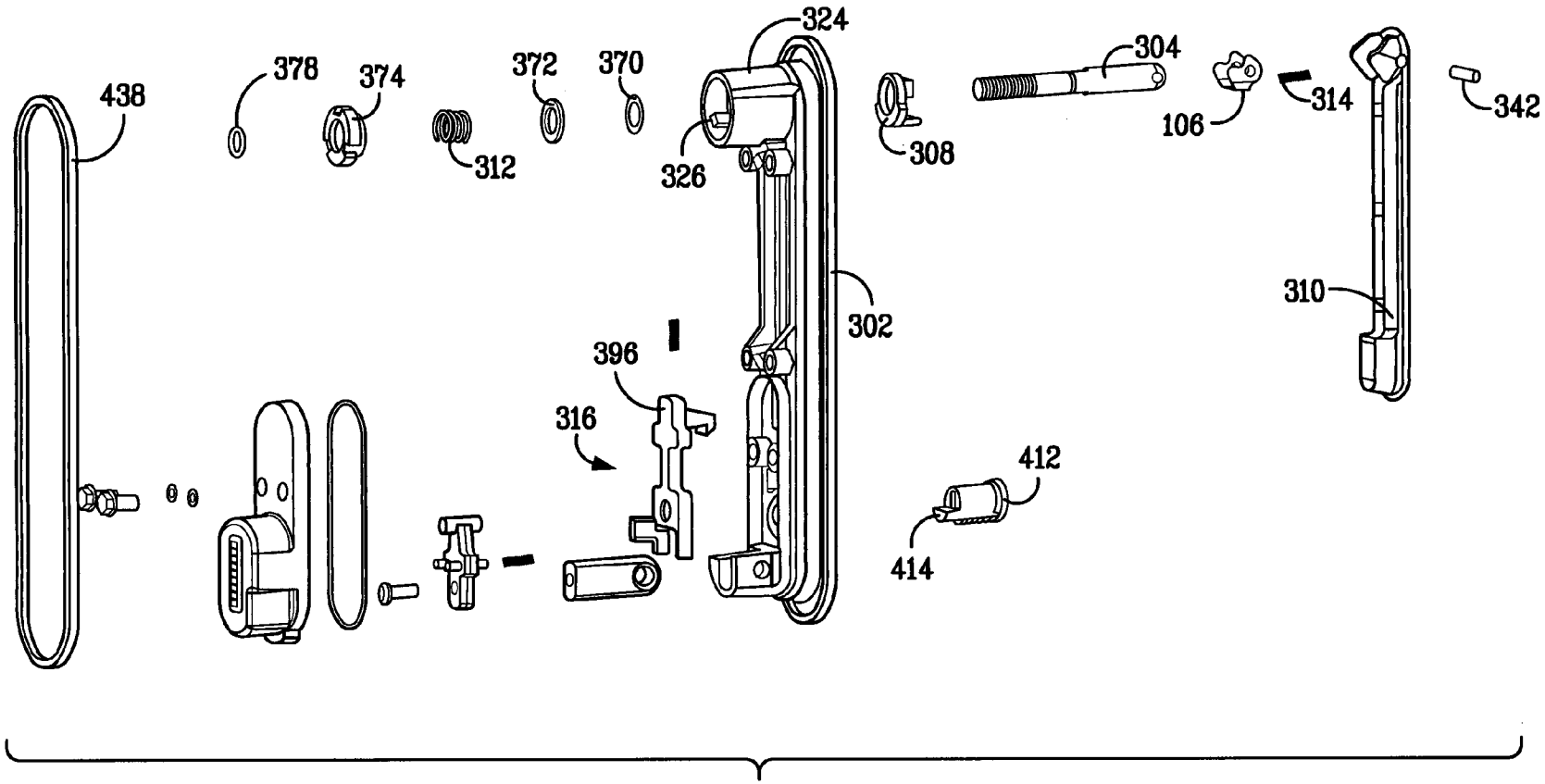
FIG. 99 is an exploded view showing the second embodiment of the compression latch mechanism according to the present invention.
Figure 100:
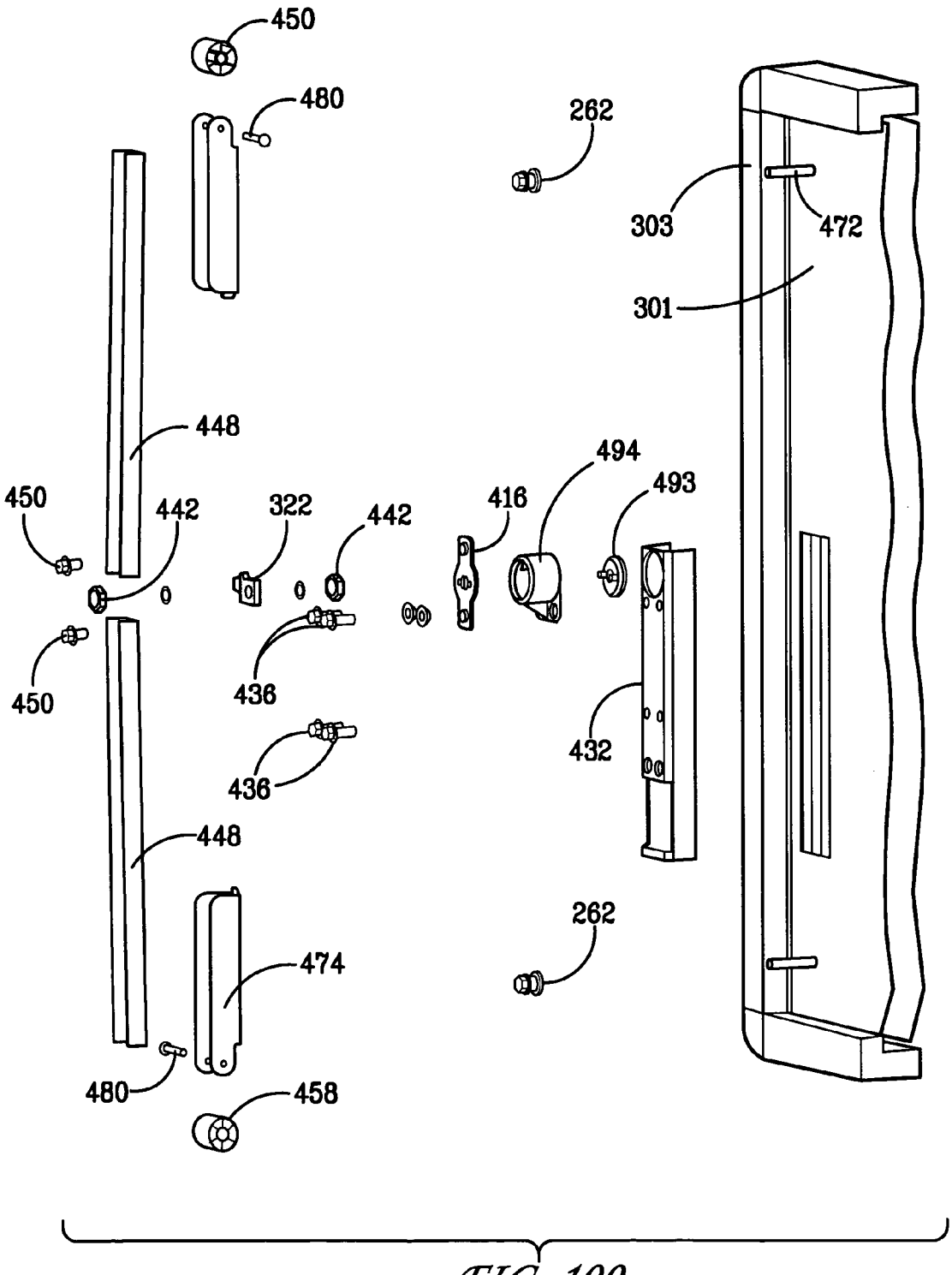
FIG. 100 is an exploded view of the mounting bracket and the remote latching components of the second embodiment of the compression latch mechanism according to the present invention.
Figure 101:
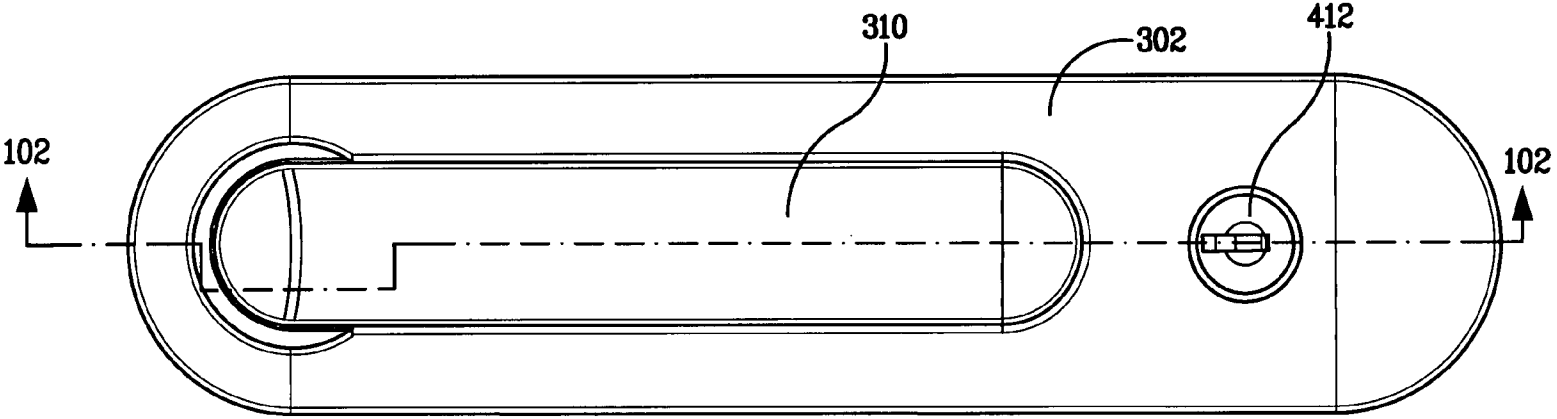
FIGS. 101-102 are views of the second embodiment of the compression latch mechanism according to the present invention in the latched configuration.
Figure 203:
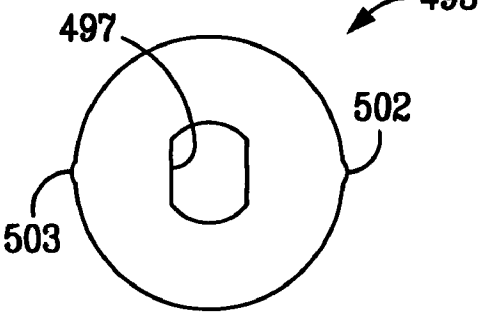

Referring to FIGS. 99-203, a second embodiment 300 of the compression latch mechanism of the present invention can be seen. The compression latch mechanism 300 of the present invention in general comprises a housing 302, a shaft 304, a kickstand 106, a bearing plate 308, a handle 310, first biasing means 312, second biasing means 314, and catch means 316. The compression latch mechanism 300 is used for releasably securing a first member such as a door 301 to a second member such as a doorframe 303.

The housing 302 is adapted for attachment to the first member or door 301. The housing has a receptacle portion 318 for receiving the handle 310 in the folded down position such that the projection of the latch handle 310 above the exterior surface of the door 301 is minimized in the folded-down position. The latch housing 302 is adapted to be mounted in an opening in the door 301 such that the latch housing 302 projects to only a small height above the exterior surface of the door 301 when the latch housing is mounted in the door. This small height is equivalent to the thickness of a flange or bezel 320 that surrounds the open top of the receptacle portion 318 of the latch housing 302. Desirably, the latch handle 310 is substantially flush with the flange or bezel 320 of the receptacle portion 318 of the latch housing 302 when the latch handle 310 is in the folded-down position. The receptacle portion 318 of the latch housing 302 is roughly in the shape of a trough and is sized and shaped to correspond with the outline of the latch handle 310 in plan view such that the handle 310 can only be folded down to be received in the receptacle portion 318 when the pawl 322 is in a rotational position corresponding to the latched position of the pawl 322. Any attempt to fold down the latch handle 310 will fail when the pawl 322 is not in a rotational position corresponding to the latched position of the pawl 322, because portions of the latch handle 310 will be out of alignment with the open top of the receptacle portion 318 of the latch housing 302 and thus the latch handle 310 cannot fold down into the receptacle portion 318 of the latch housing 302.

The housing 302 has a sleeve 324 through which the shaft 304 passes and the sleeve 324 has three evenly spaced ribs 326 that project radially inward toward the center axis of the sleeve 324 and extend for a predetermined distance along the inner surface of the sleeve 324 in the axial direction, i.e. parallel to the center axis of the sleeve 324. The ribs 326 extend from a location near the end of the sleeve 324 that is closest to the second end 328 of the shaft 304. The housing 302 also has a first bearing surface 330. In the illustrated example, the housing 302 has a partition wall 332 that separates the portion of the receptacle portion 318 immediately surrounding the sleeve 324 from the rest of the receptacle portion 318. The top surface of the partition wall 332 defines the first bearing surface 330.

The shaft 304 has a longitudinal axis, a first end 334 and a second end 328. The shaft 304 is supported for rotation about its longitudinal axis and for rectilinear motion in a direction coincident with its longitudinal axis. The shaft 304 moves between a latched position and an unlatched position as the compression latch mechanism 300 is operated between a latched configuration and an unlatched configuration. The operation of the compression latch mechanism 300 from the latched configuration to the unlatched configuration and then back to the latched configuration constitutes the operating cycle of the compression latch mechanism.

The kickstand 106 is pivotally connected to the shaft 304 proximate the first end 334 of the shaft 304. The kickstand 106 has at least one bearing surface 136 and at least one relief notch 138. In the illustrated embodiment, a pair of bearing surfaces 136 and a pair of relief notches 138 are provided, one being positioned on each side of the shaft 304. The kickstand 106 also has a pair of holes 140 that are in alignment with each other and are used to pivotally connect the kickstand 106 to the shaft 304. The kickstand 106 moves pivotally relative to the shaft 304 about a pivot axis fixed in position relative to the shaft 304 during at least a portion of the operating cycle of the compression latch mechanism. This pivot axis is defined by the pivot shaft 342 that passes through the hole 344 that extends through the shaft 304 near the first end 334 and through the holes 140 to pivotally connect the kickstand 106 to the shaft 304.

The bearing plate 308 is positioned between the first end 334 of the shaft 304 and the second end 328 of the shaft 304. The bearing plate 308 is supported by the housing 302 and in particular by the portion of the receptacle portion 318 immediately surrounding the sleeve 324. The bearing plate 308 has at least a raised bearing surface 346 and at least a lower bearing surface 348. The bearing plate 308 also has a center hole 350 that registers with the bore of the sleeve 324.

Figure 122:
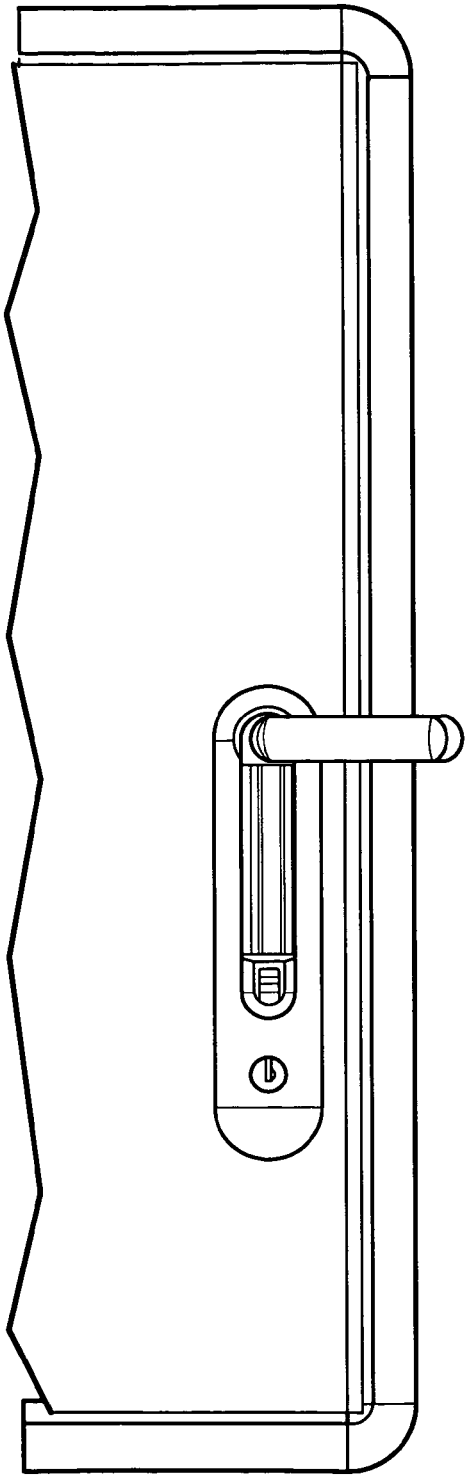
FIGS. 122-126 are environmental views of the second embodiment of the compression latch mechanism according to the present invention in the unlatched configuration.
Figure 125:
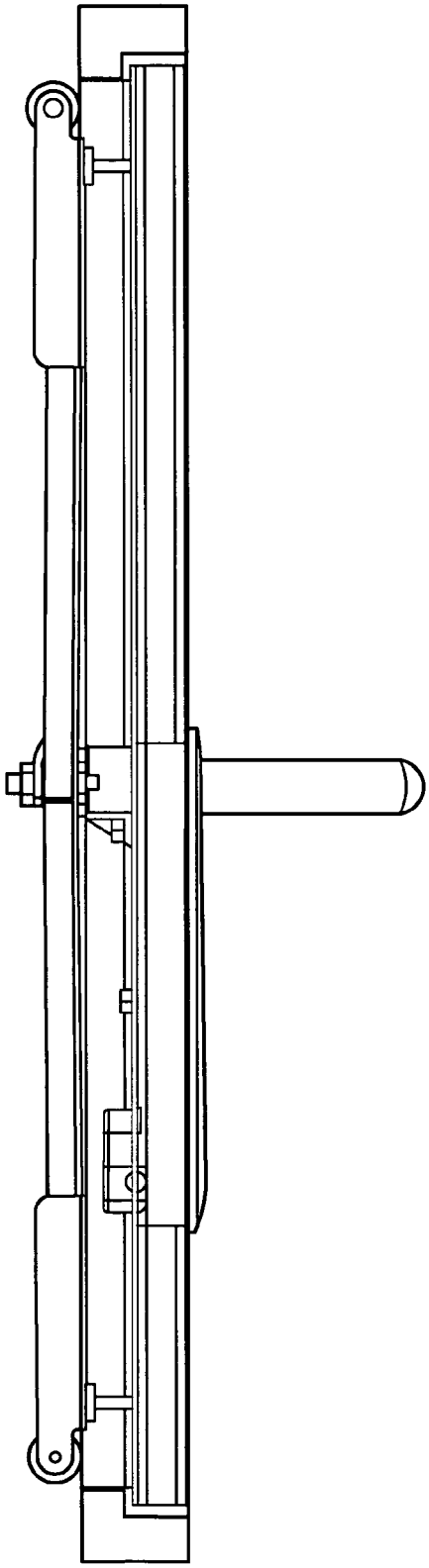
Figure 126:
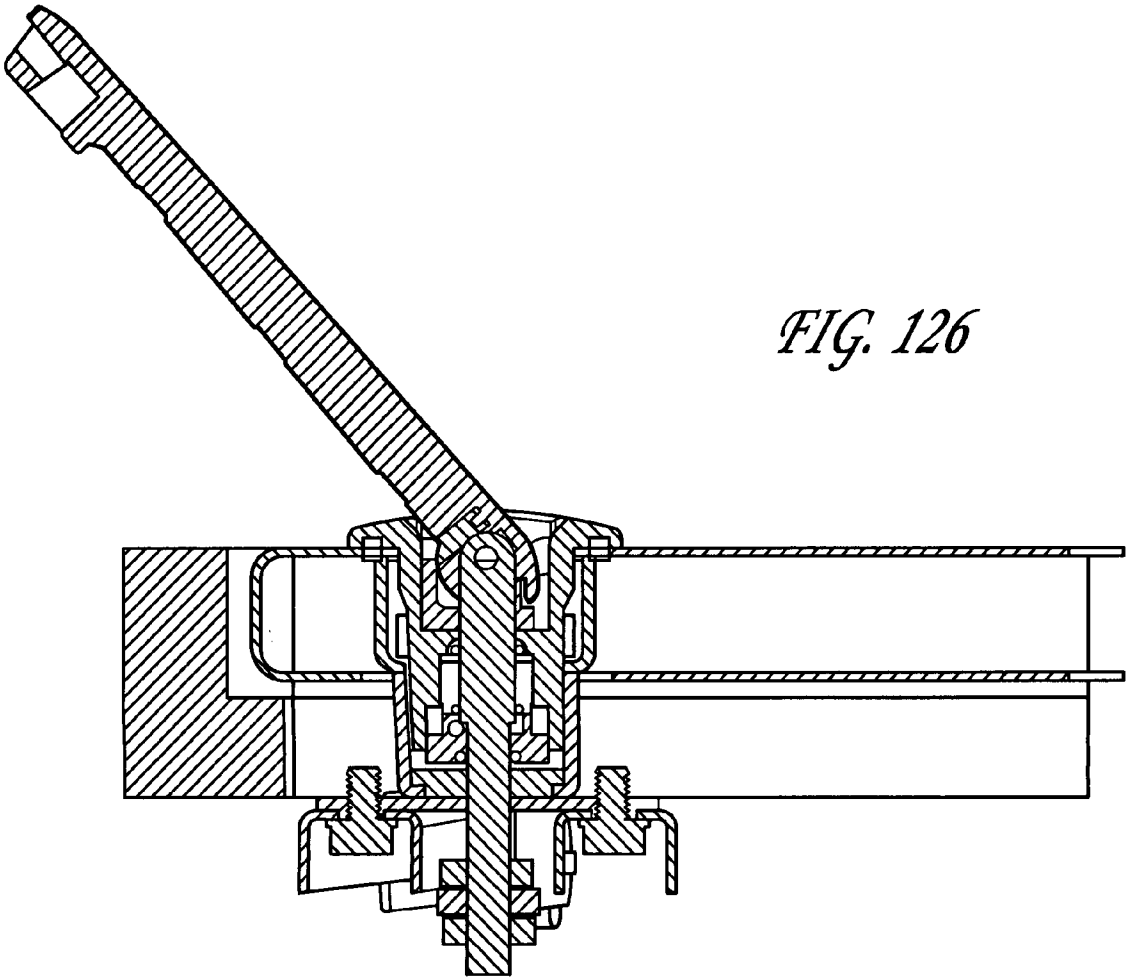
Figure 127:
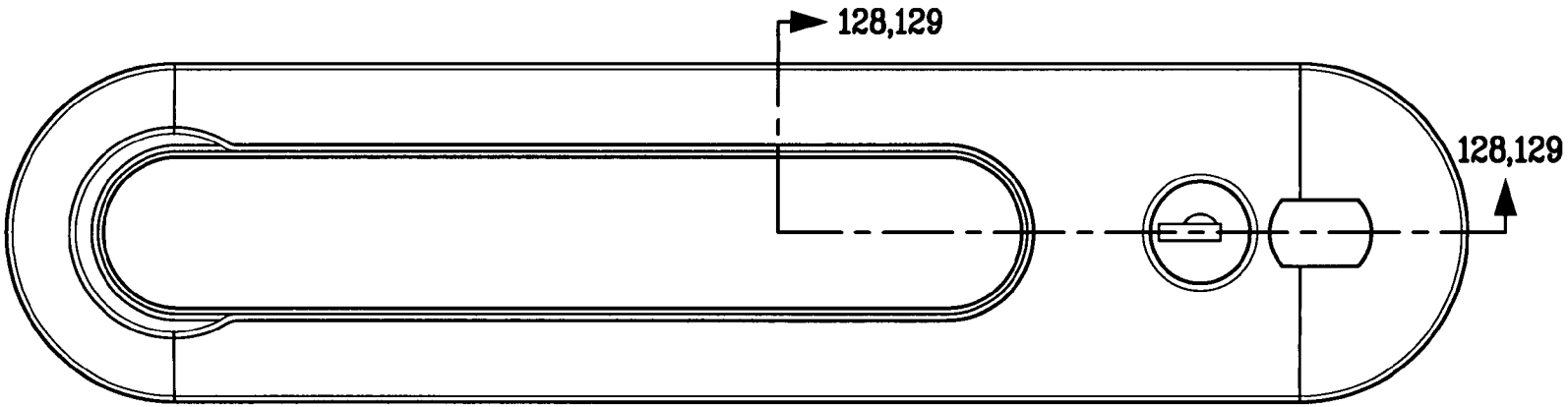
FIGS. 127-129 are views of the second embodiment of the compression latch mechanism according to the present invention equipped with a padlock hasp.
Figure 129:
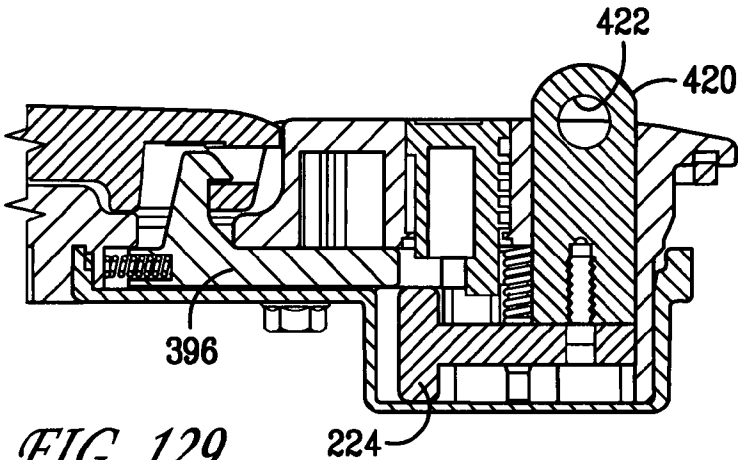
Figure 128:
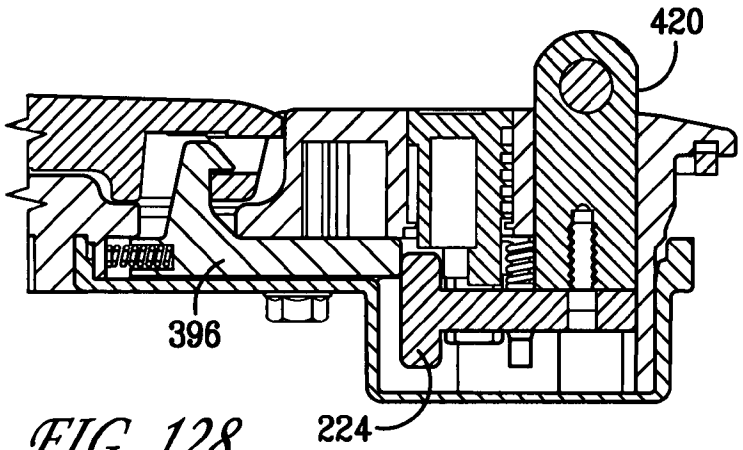
Figure 131:
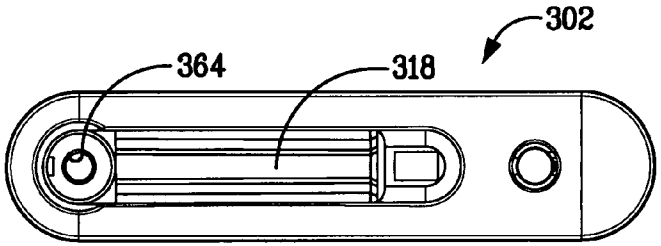
FIGS. 130-135 are views showing the housing of the second embodiment of the compression latch mechanism according to the present invention.
Figure 130:
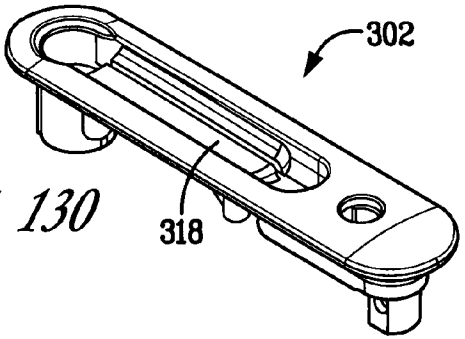
Figure 133:
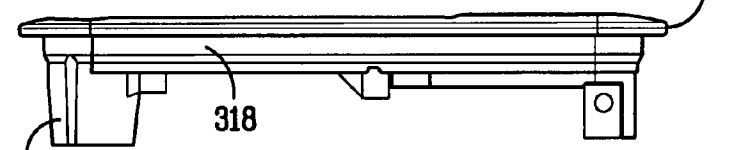
Figure 134:
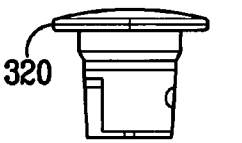
Figure 132:
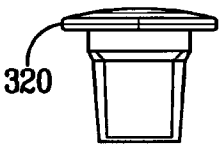
Figure 135:
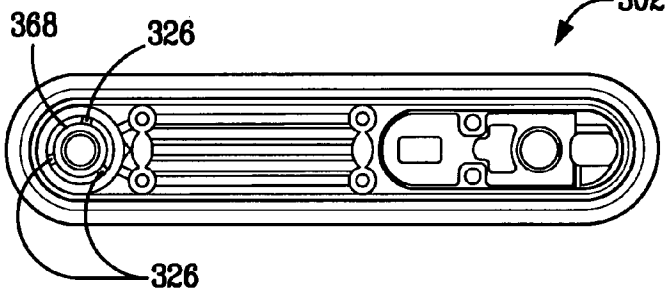
Figure 140:
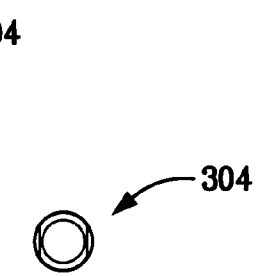
FIGS. 136-140 are views showing the shaft of the second embodiment of the compression latch mechanism according to the present invention.
Figure 139:
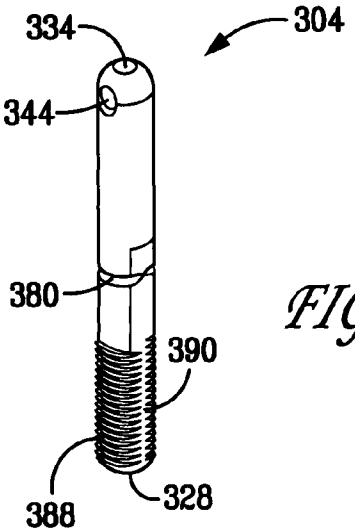
Figure 138:
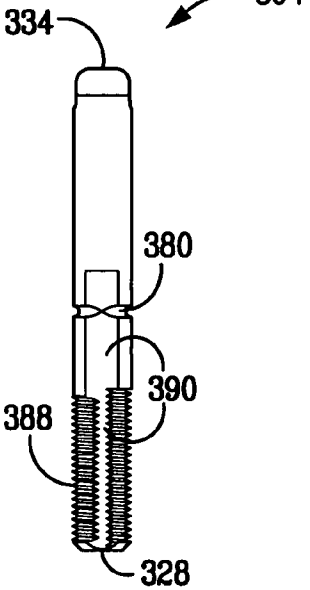
Figure 137:
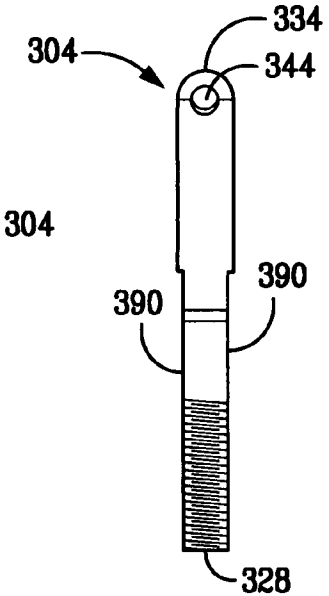
Figure 136:
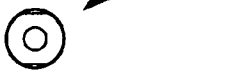
Figure 141:
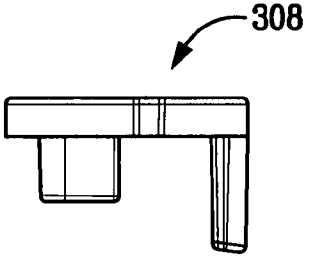
FIGS. 141-147 are views showing the bearing plate of the second embodiment of the compression latch mechanism according to the present invention.
Figure 142:
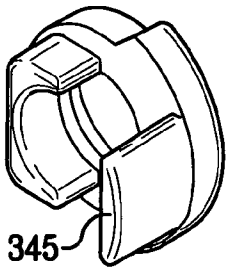
Figure 143:
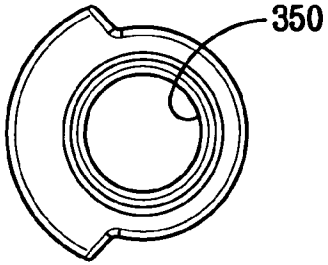
Figure 144:
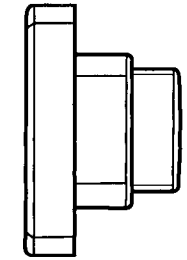
Figure 145:
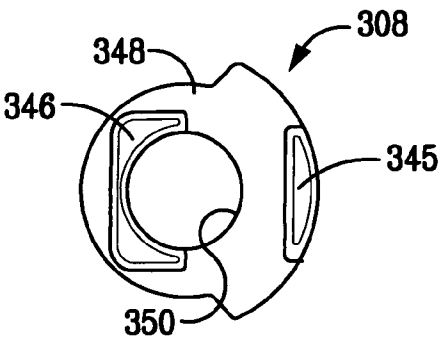
Figure 146:
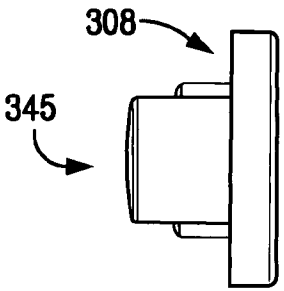
Figure 147:
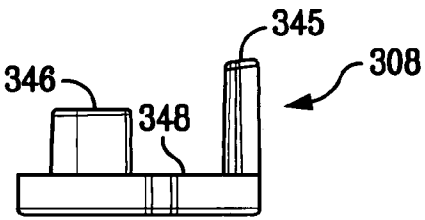
Figure 150:
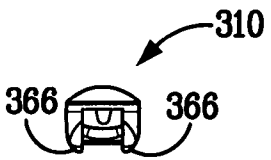
FIGS. 148-153 are views showing the handle of the second embodiment of the compression latch mechanism according to the present invention.
Figure 149:
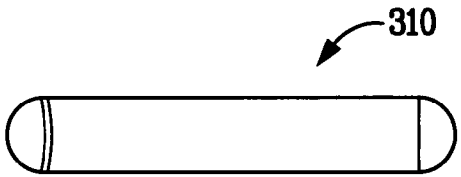
Figure 148:
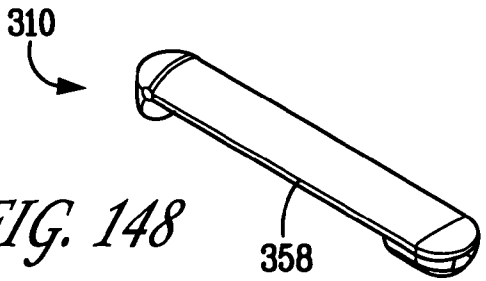
Figure 153:
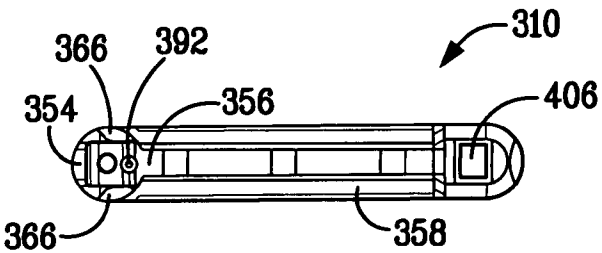
Figure 152:
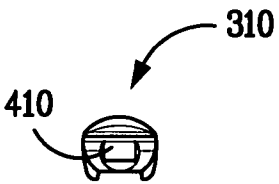
Figure 151:
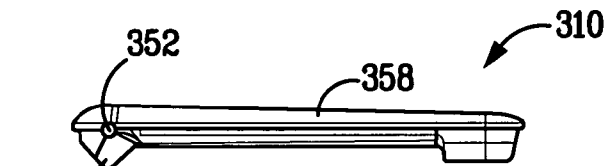
Figure 156:
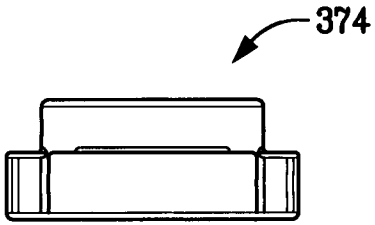
FIGS. 154-159 are views showing the bushing of the second embodiment of the compression latch mechanism according to the present invention.
Figure 159:
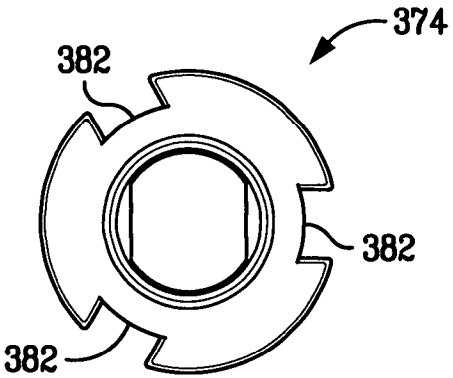
Figure 155:
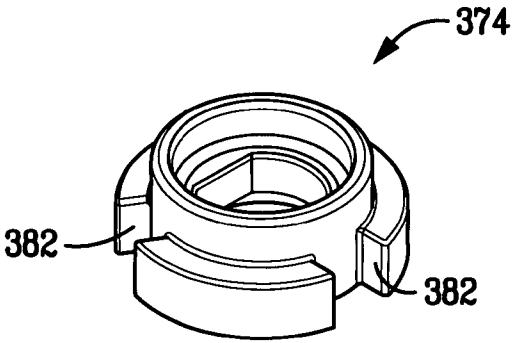
Figure 158:
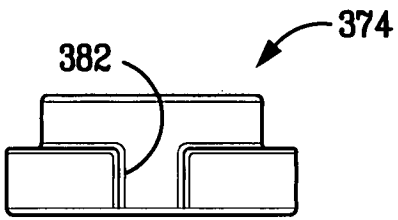
Figure 154:
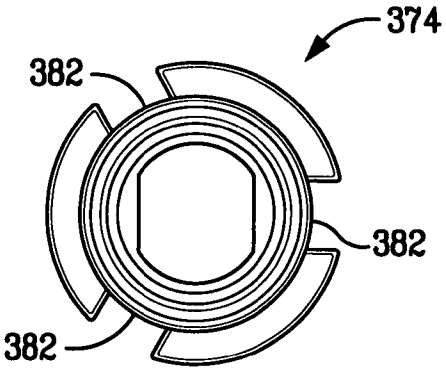
Figure 157:
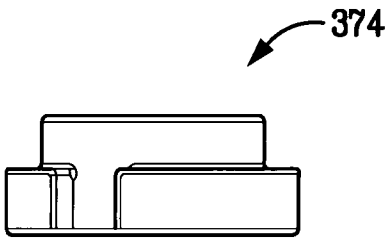
Figure 162:
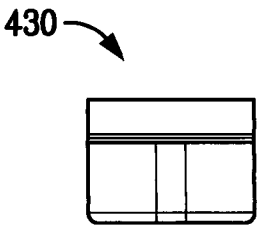
FIGS. 160-165 are views showing the handle lock mechanism cover of the second embodiment of the compression latch mechanism according to the present invention.
Figure 161:
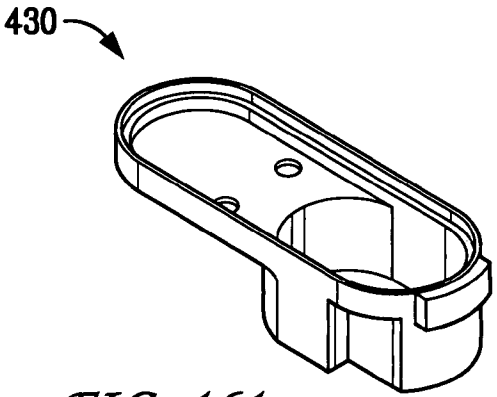
Figure 160:
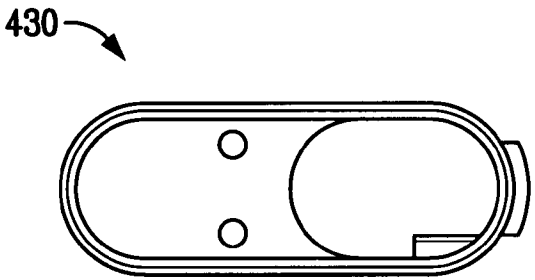
Figure 165:
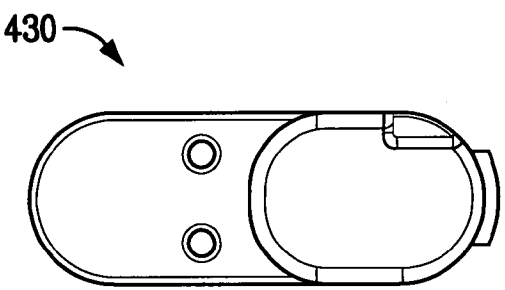
Figure 164:
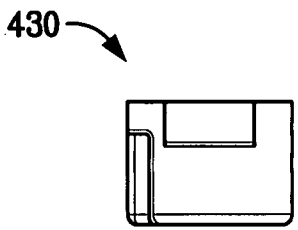
Figure 163:
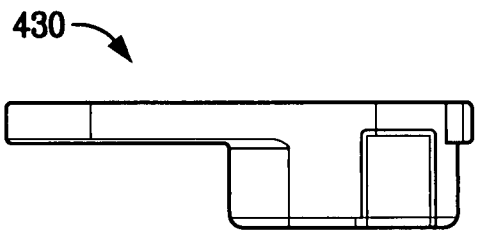
Figure 167:
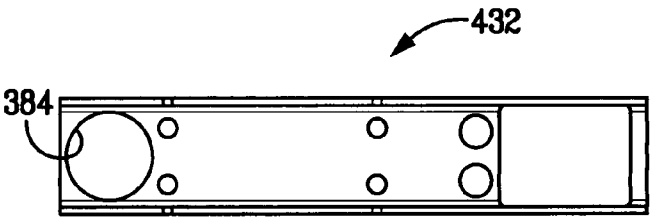
FIGS. 166-171 are views showing the mounting bracket of the second embodiment of the compression latch mechanism according to the present invention.
Figure 166:
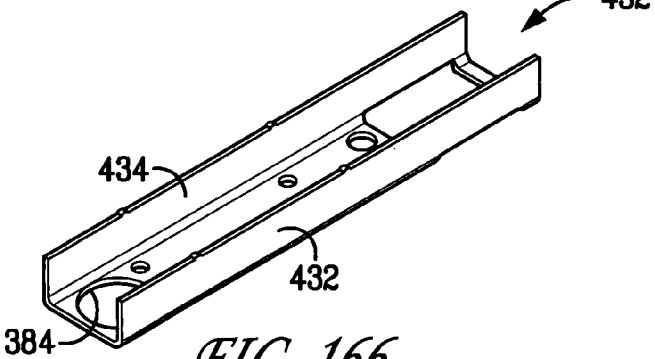
Figure 170:
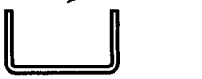
Figure 169:
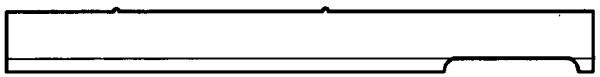
Figure 168:
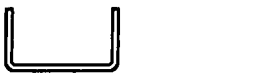
Figure 171:
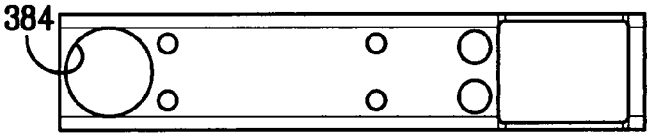
Figure 174:
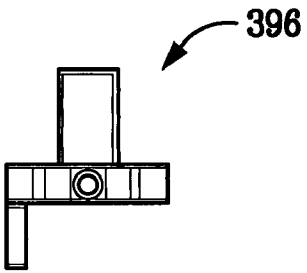
FIGS. 172-177 are views showing the handle retaining claw of the second embodiment of the compression latch mechanism according to the present invention.
Figure 177:
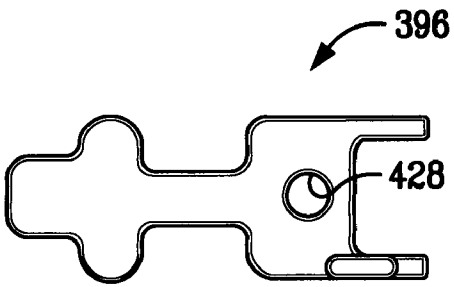
Figure 173:
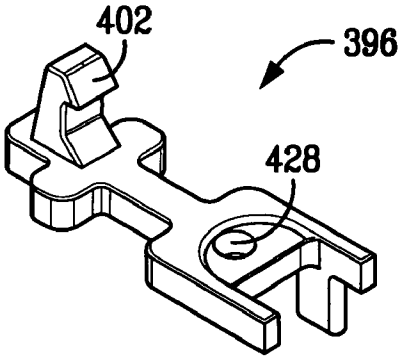
Figure 176:
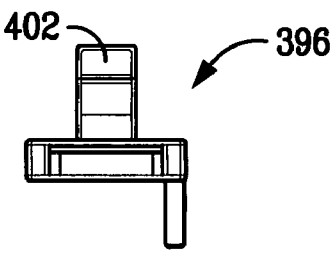
Figure 172:
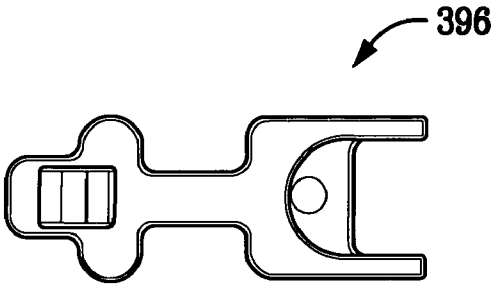
Figure 175:
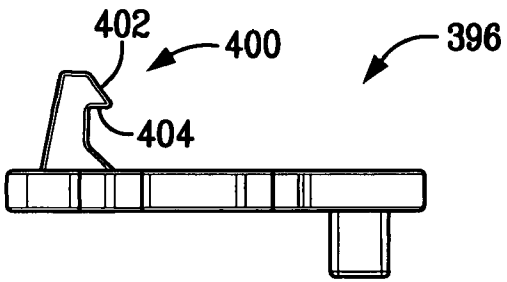
Figure 178:
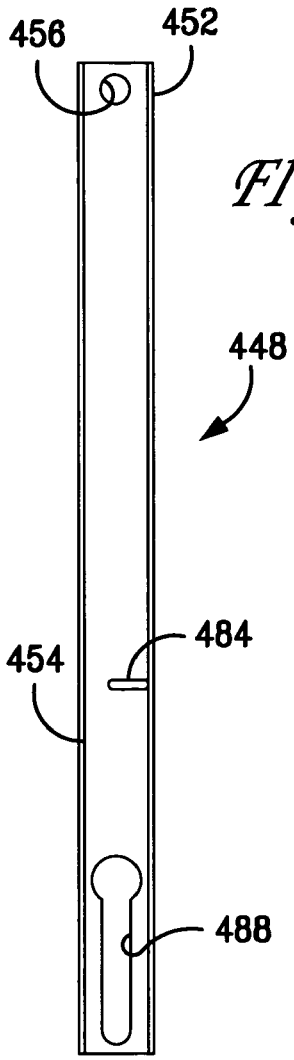
FIGS. 178-180 are views showing the remote latching rod of the second embodiment of the compression latch mechanism according to the present invention.
Figure 179:
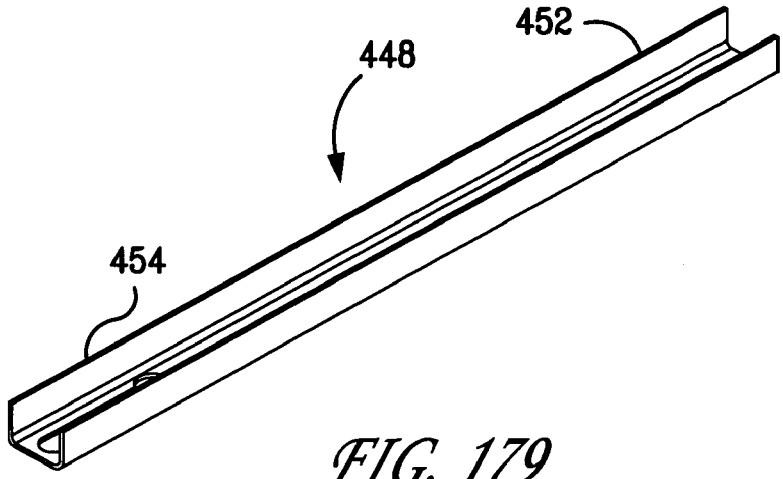
Figure 180:
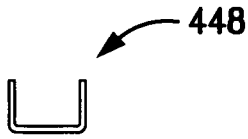
Figure 182:
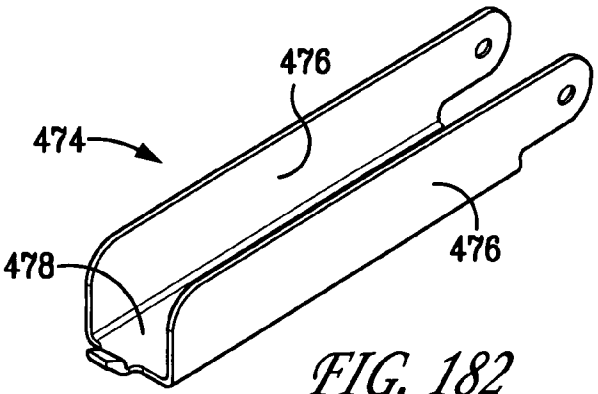
FIGS. 181-184 are views showing the rod end stamping of the second embodiment of the compression latch mechanism according to the present invention.
Figure 181:
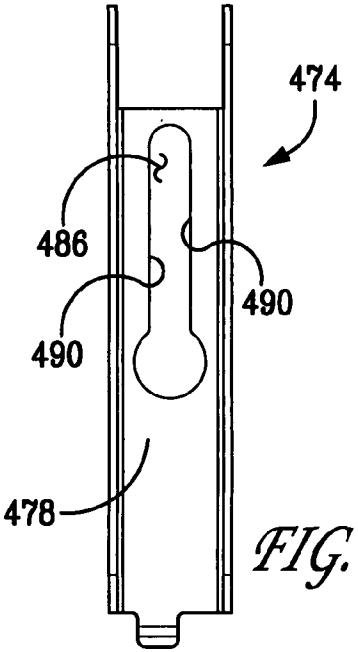
Figure 184:
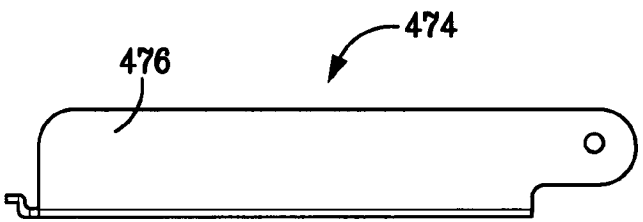
Figure 183:
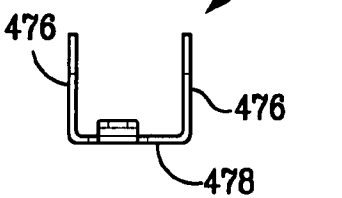
Figure 185:
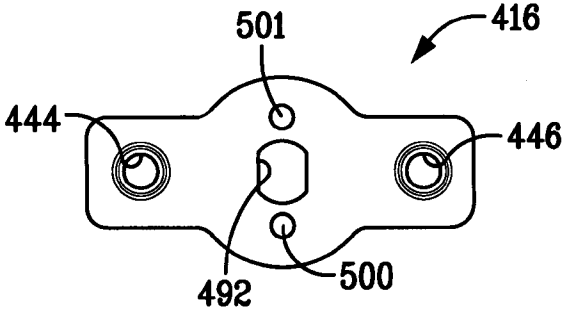
FIGS. 185-190 are views showing the rod actuator of the second embodiment of the compression latch mechanism according to the present invention.
Figure 186:
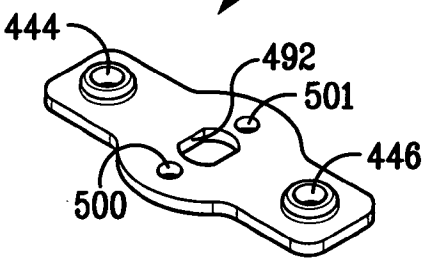
Figure 187:
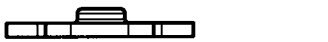
Figure 188:
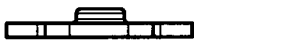
Figure 189:
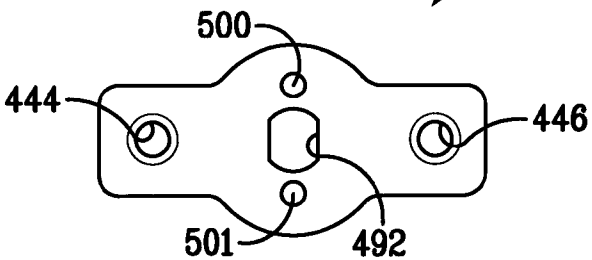
Figure 190:
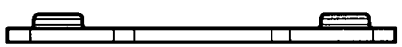
Figure 192:
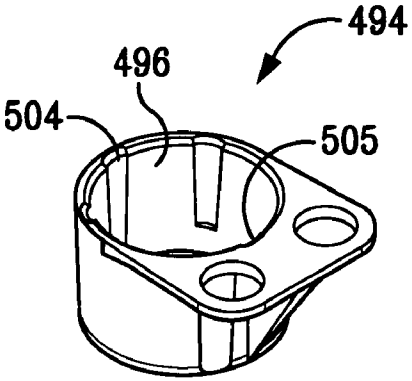
FIGS. 191-196 are views showing the actuator hub housing of the second embodiment of the compression latch mechanism according to the present invention.
Figure 191:
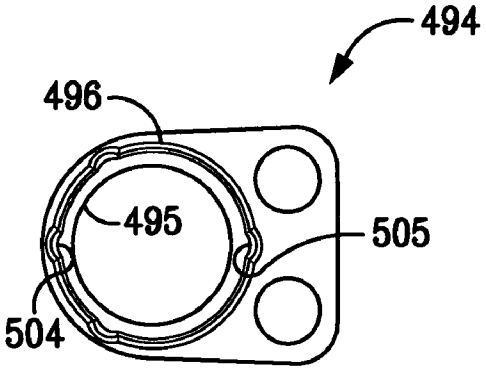
Figure 193:
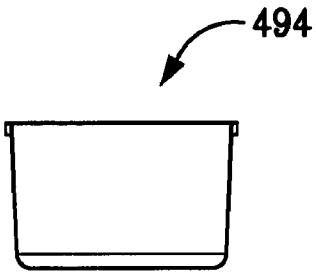
Figure 194:
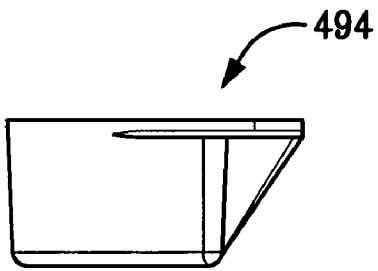
Figure 195:
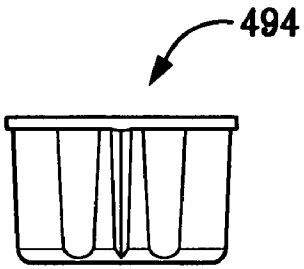
Figure 196:
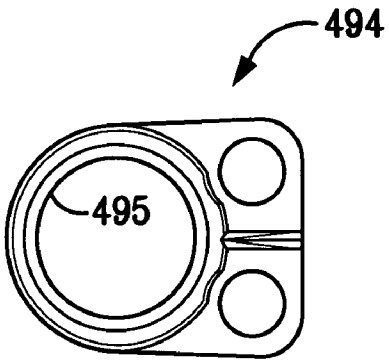
Figure 197:
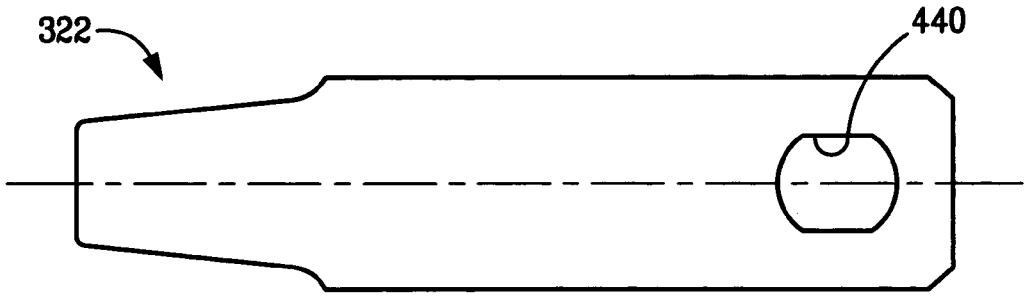
FIG. 197 is a plan view showing the pawl of the second embodiment of the compression latch mechanism according to the present invention.
Figure 198:
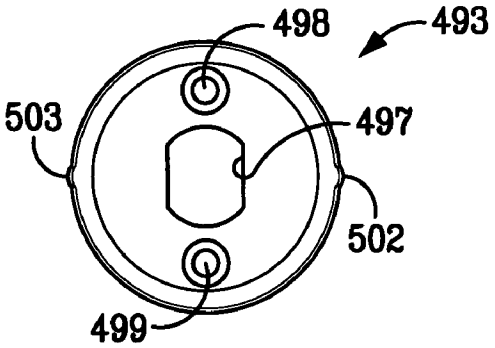
FIGS. 198-203 are views showing the actuator hub of the second embodiment of the compression latch mechanism according to the present invention.
Figure 199:
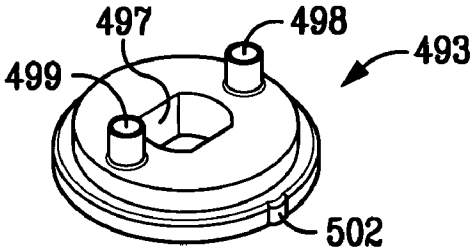
Figure 200:
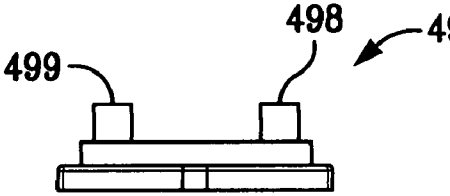
Figure 201:
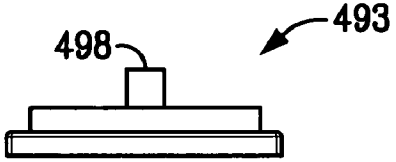
Figure 202:
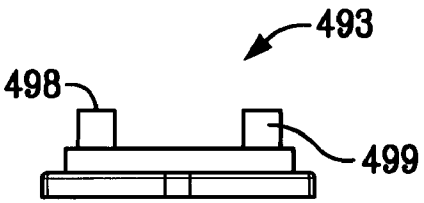

The handle 310 is pivotally connected to the shaft 304 proximate the first end 334 of the shaft 304. The handle 310 also has a pair of holes 352 that are in alignment with each other and are used to pivotally connect the handle 310 to the shaft 304 to form the pivotal connection between the handle 310 and the shaft 304. The same pivot pin 342 that passes through the holes 344 and 140 also passes through the holes 352 to pivotally connect the kickstand 106, the handle 310 and the shaft 304 to one another about the same common pivot axis. The handle 310 moves pivotally relative to the shaft 304 about the pivot axis defined by the pivot pin 342 as the handle 310 is moved between the folded-down position and the first raised position. The handle 310 has a kickstand contact surface 354. The kickstand 106 and the handle 310 are pivotally movable relative to one another over a predetermined range of pivotal movement that is limited on one side of the pivot pin 342 by the kickstand contact surface 354. The handle 310 is also capable of being turned to a second raised position, as shown in FIGS. 122, 125 and 126, to place the compression latch mechanism 300 in the unlatched configuration. The handle 310 also has an underside 356 and a grasping portion 358.

As best seen in FIGS. 136-140, the shaft 304 has a portion 388 that has threads that are interrupted by flat sides 390 on either side of the threaded portion 388. The threaded portion 388 includes the second end 328 of the shaft 304. The shaft 304 is provided with a hole 344 that passes through the shaft 304, transverse to the longitudinal axis of the shaft 304, at a location near the first end 334 of the shaft 304. The shaft 304 is provided with an annular groove 380 for engagement by the C-clip 378. The annular groove 380 is located near the top end of the threaded portion 388 of the shaft 304.

Figure 102:
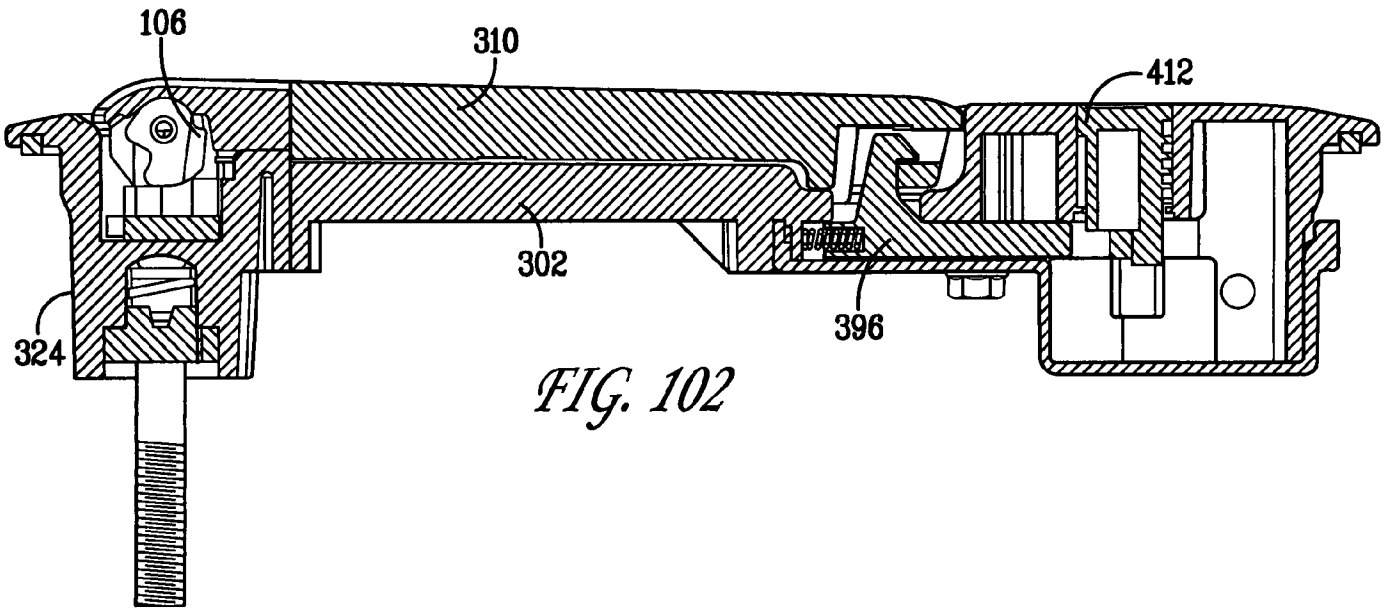
Figure 103:
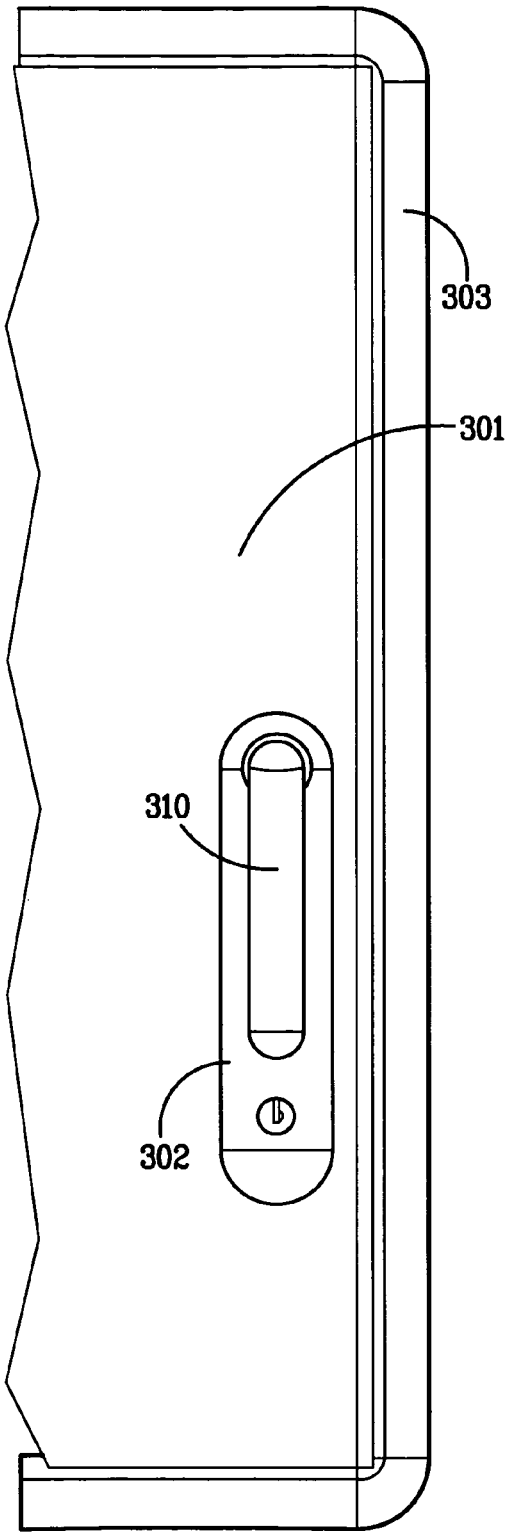
FIGS. 103-107 are environmental views of the second embodiment of the compression latch mechanism according to the present invention in the latched configuration.
Figure 116:
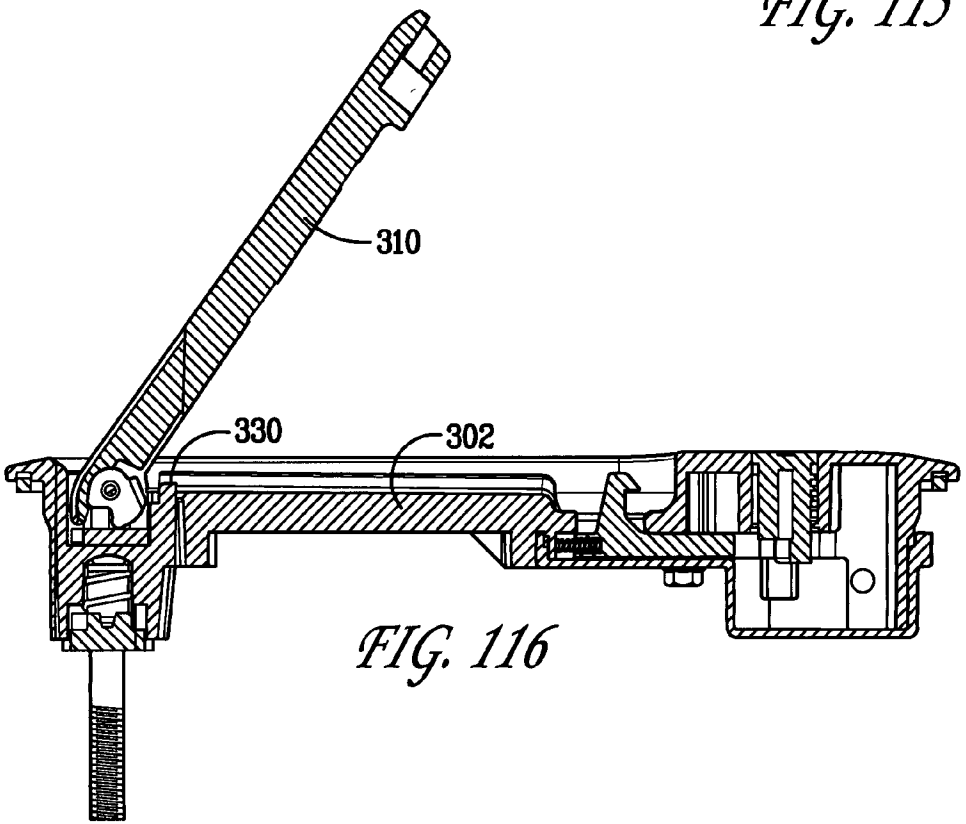
Figure 117:
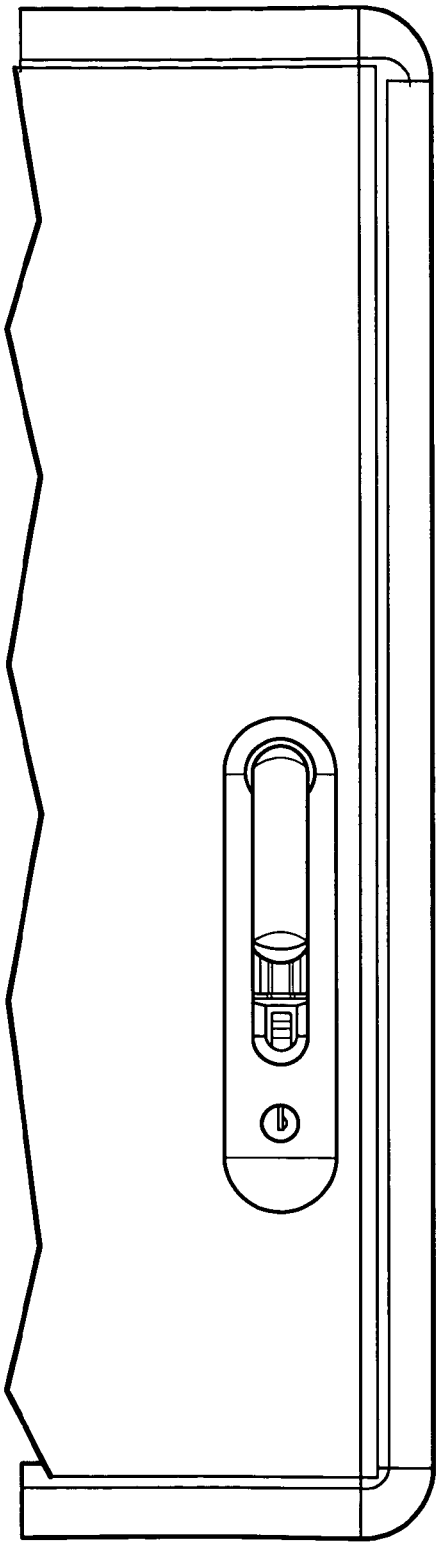
FIGS. 117-121 are environmental views of the second embodiment of the compression latch mechanism according to the present invention shown with the handle in the first raised position.
Figure 118:
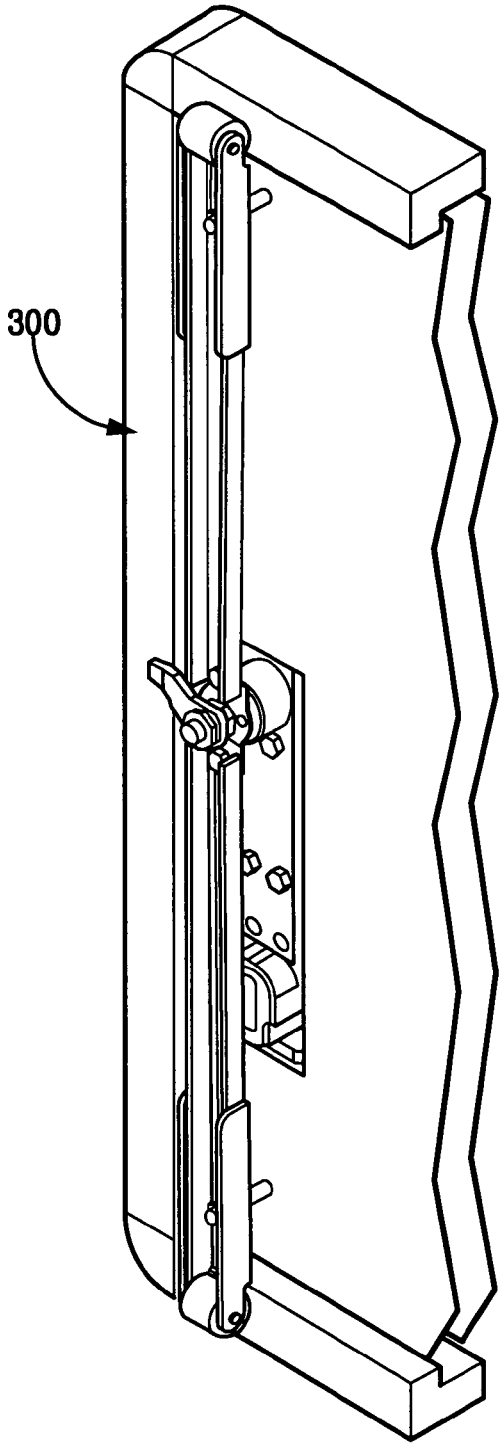
Figure 119:
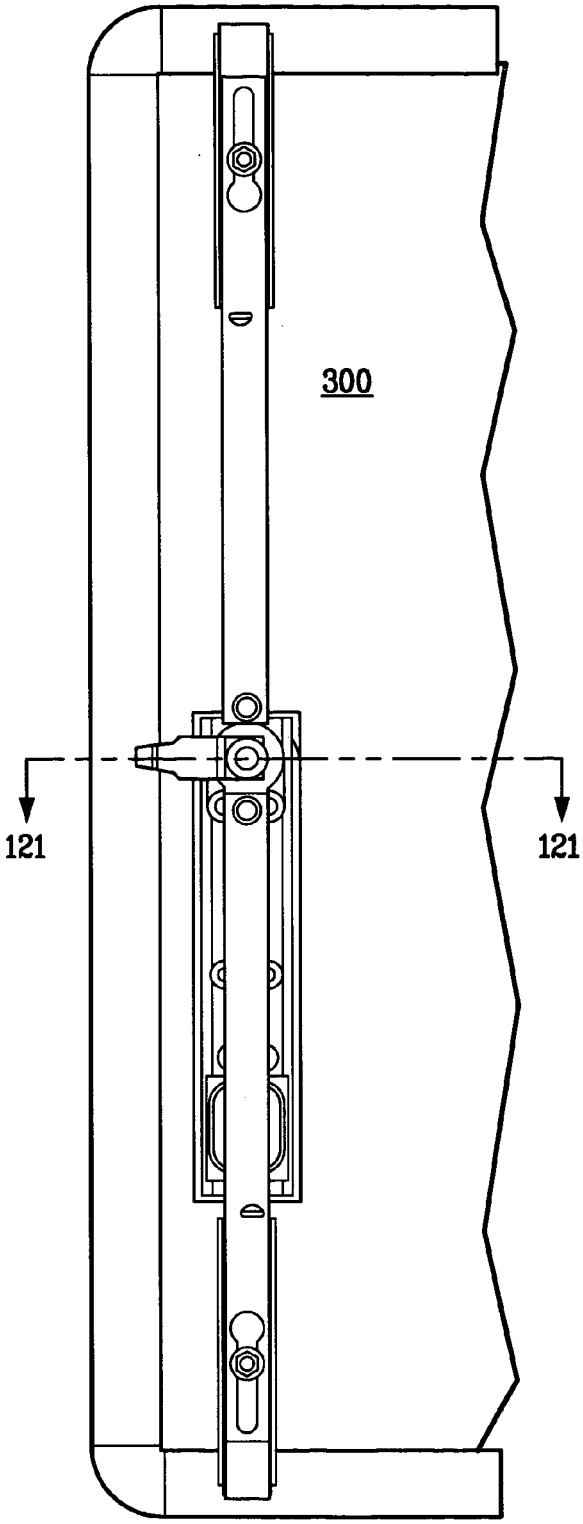
Figure 120:
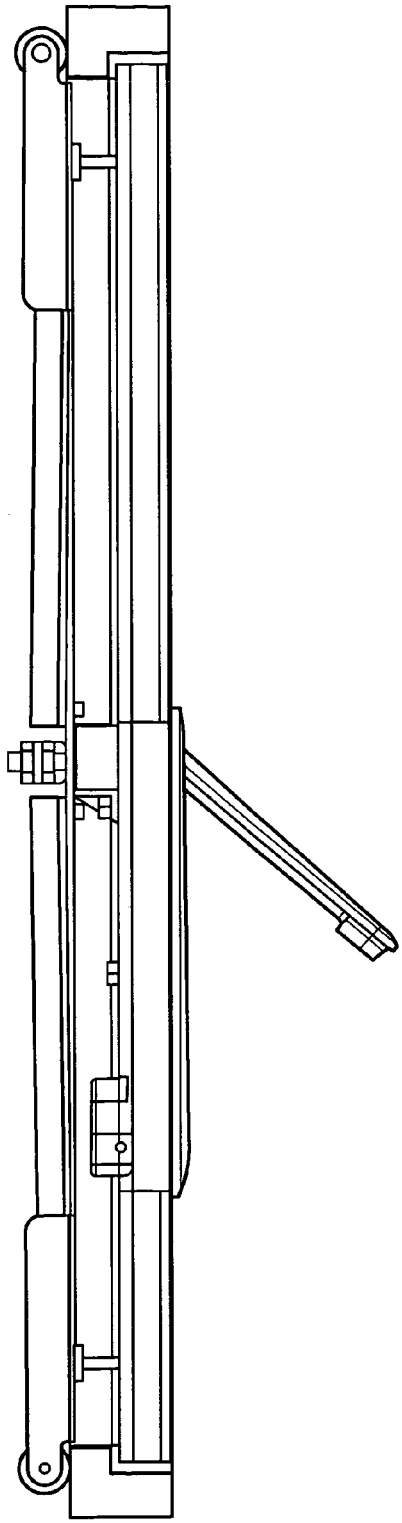
Figure 121:
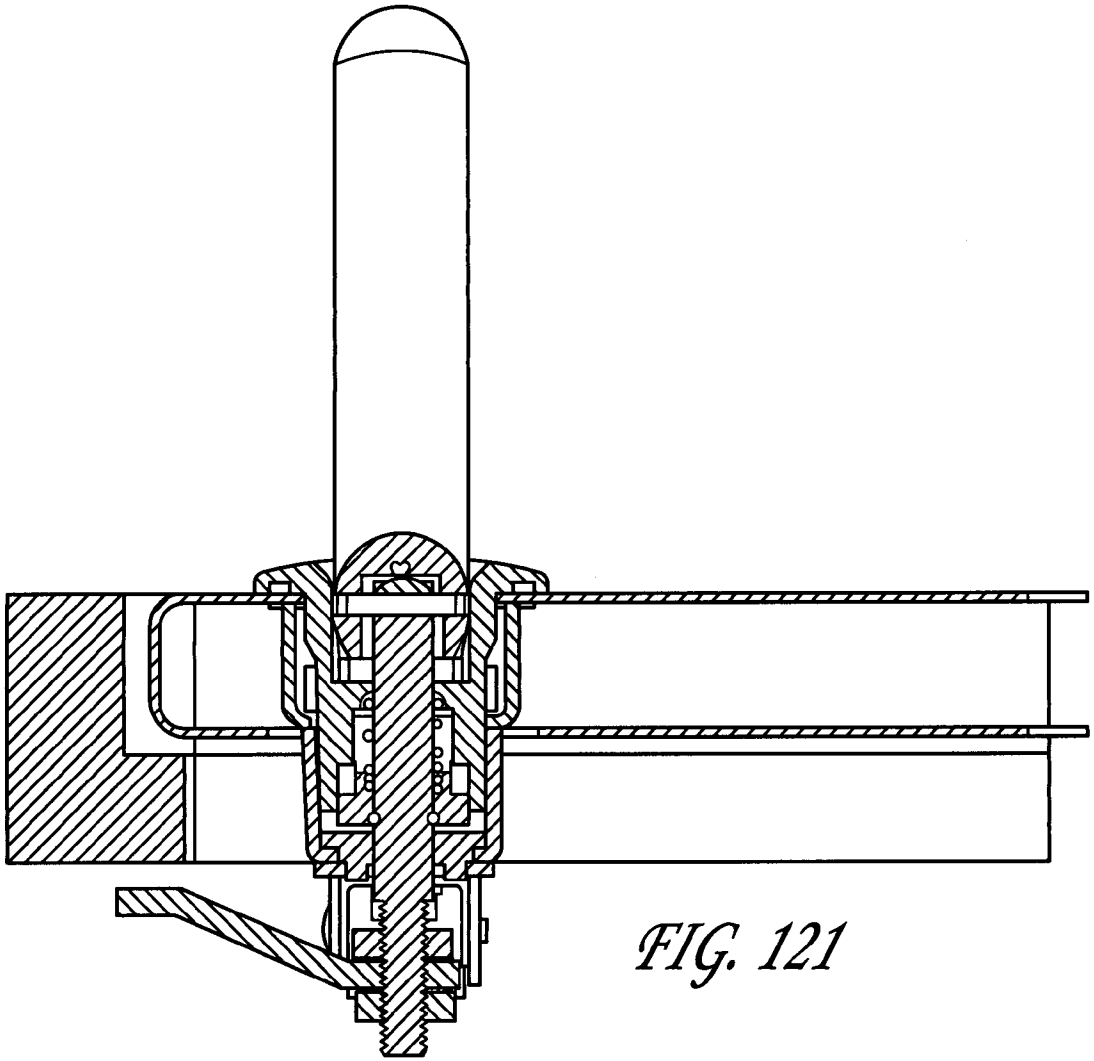
Figure 123:
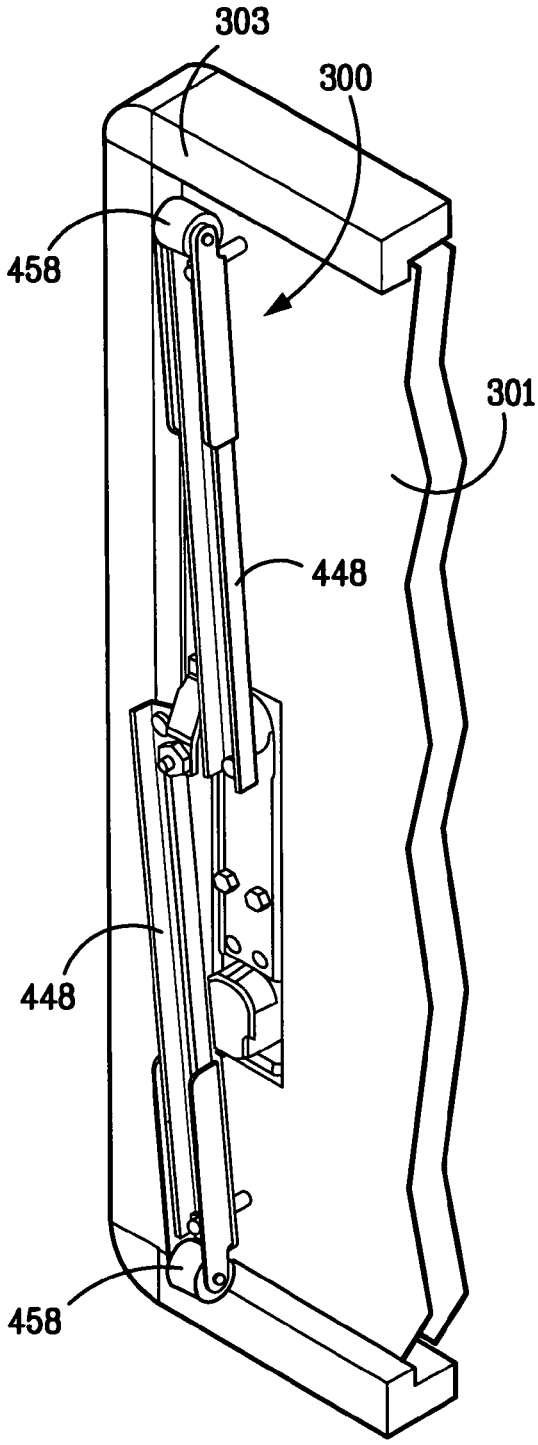
Figure 124:
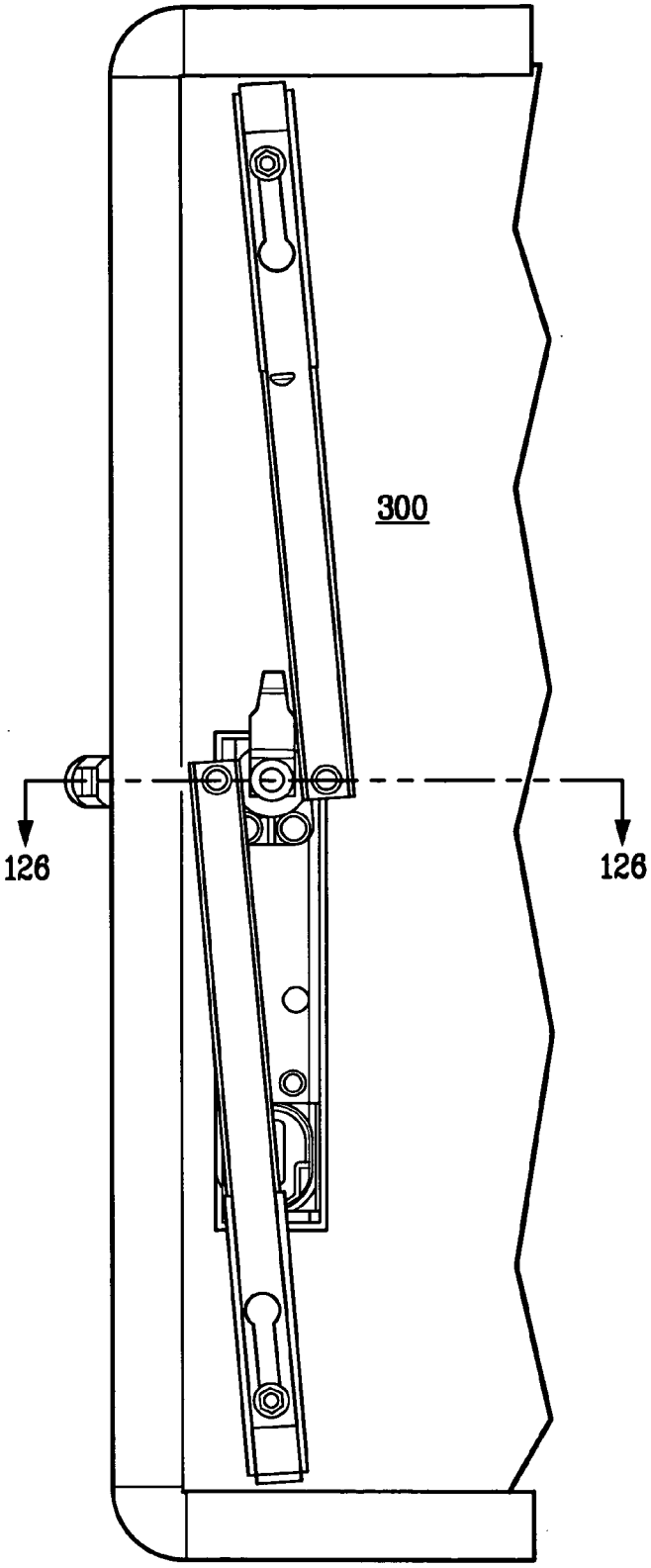

A pawl 322 is provided for engaging the doorframe 303 to thereby secure the door 301 in the closed position and apply a compressive force between the door and the door frame as the shaft 304 is moved from the unlatched position to the latched position. The pawl 322 is mounted to the shaft 304 intermediate the second end of the shaft 304 and the housing 302. More particularly, the pawl 322 is mounted to the shaft 304 along the threaded portion 388 of the shaft 304. The pawl 322 is mounted to the shaft 304 such that at least a portion of the pawl 322 is positioned behind a structure fixed to or forming a part of the doorframe 303 when the compression latch mechanism is mounted to the door 301 and the shaft 304 is in one of the latched position (shown in FIG. 102) and the intermediate extended position (shown in FIG. 116). The pawl 322 moves between latched and unlatched positions (shown in FIGS. 104 and 123, respectively) that correspond to the latched and unlatched positions of the shaft 304, respectively. The pawl 322 moves with the shaft 304 as a unit.

The first biasing means 312 is in the form of a compression coil spring and is provided for biasing the shaft 304 such that the second end 328 of the shaft 304 tends to project to a greater distance from the housing 302, and in particular from the sleeve 324, under the bias imparted to the shaft 304 by the first biasing means 312.

The shaft 304 is positioned at least in part within the bore 362 of the sleeve 324. The shaft 304 extends through the top opening 364 of the sleeve 324 such that the first end 334 of the shaft 304 is located in the receptacle portion 318 of housing 302. The portion of the shaft 304 including the first end 334 and the hole 344 is located in the portion of the receptacle portion 318 immediately surrounding the sleeve 324, where the pivotal connections between the kickstand 106, the handle 310 and the shaft 304 are made as was previously described. The shaft 304 also passes through the central hole 350 of the bearing plate 308 with the lower bearing surface 348 of the bearing plate 308 being positioned between the pin 342 and the top end of the sleeve 324 located closest to the receptacle portion 318. The lower bearing surface 348 of the bearing plate 308 reduces the wear on the housing 302 by providing a bearing surface against which the cam lobe 366 of the handle 310 can bear as the handle 310 is alternately folded and raised. Thus, the bearing plate 308 allows the housing 302 to be manufactured from less expensive materials. However, it is also possible for the bearing plate 308 to be made in one piece with the housing 302.

The top opening 364 of the sleeve 324 has a smaller diameter than the bore 362 of the sleeve 324, thus forming the annular shoulder 368. The o-ring 370 is positioned in the bore 362 against the shoulder 368. The washer 372 is positioned in the bore 362 adjacent the o-ring 370. Both the o-ring 370 and the washer 372 surround the shaft 304. The washer 372 provides a protective surface for one end of the spring 312 to bear against while the o-ring 370 seals any gaps between the shaft 304 and the top opening 364 of the sleeve 324. The spring 312 is also positioned substantially within the bore 362 of the sleeve 324 of the housing 302 and its coils surround the shaft 304. The bushing 374 receives the lower end of the spring 312 such that the lower end of the spring 312 bears against a shoulder 376 within the bushing 374. The bushing 374 encircles the shaft 304 and lies at least in part within the bore 362 of the sleeve 324 of the housing 302. A C-clip 378 engages an annular groove 380 to keep the bushing 374 in place around the shaft 304.

A plurality of slots 382, in this case three, are provided in the outer peripheral surface of the bushing 374 that is supported by the shaft 304. The sleeve 324 of the housing 302 is provided with a plurality of ribs 326, three in the illustrated example, that were described previously. The slots 382 register with the ribs 326 when the pawl 322 is in a rotational position corresponding to the latched position of the pawl 322. In other words, the slots 382 register with the ribs 326 only when the handle 310 is at or between the first raised position and the folded-down position. When the handle 310 is turned to rotate the pawl 322 out of the rotational position corresponding to its latched position, the slots 382 will be out of alignment with the ribs 326. With the slots 382 in such a position, the slots 382 are positioned very close to the rim of the distal end of the sleeve 324. The handle 310 has at least one cam lobe 366 defining a handle cam surface 386. In the illustrated example, two cam lobes 366 are provided on either side of the kickstand 106. With the handle 310 in the first or second raised position, or in any position therebetween, the handle cam surface 386 contacts the lower bearing surface 348 of the bearing plate 308 and tends to lift the first end 334 of the shaft 304 away from the bearing plate 308 if any attempt is made to fold down the handle 310. Any such attempt brings the bushing 374 into interference with the terminal ends of the ribs 326, which then prevents the handle 310 from being folded down any further when the pawl 322 and the handle 310 are not in a rotational position corresponding to their latched positions. Thus, movement of the handle 310 in a manner tending toward folding down of the handle is effectively prevented when the slots 382 are not in alignment with the ribs 326. When the slots 382 are in registry with the ribs 326, which corresponds to the handle 310 being at or between the first raised position and the folded-down position, rectilinear motion of the shaft 304 and the pawl 322 to the latched position will be allowed in response to movement of the handle 310 toward the folded-down position.

The spring 312 is under compression and acts as a biasing means tending to bias the threaded portion 388 of the shaft 304 away from housing 302. The biasing force of the spring 312 is applied to the shaft 304 through the bushing 374 and the C-clip 378.

The second biasing means 314 is provided for biasing the handle 310 from the folded-down position toward an intermediate position between the folded-down position and the first raised position and for biasing the kickstand 106 into a latched position. The second biasing means 314 is in the form of a compression coil spring 314 provided between the handle 310 and the kickstand 106 on one side of the pivot pin 342. The spring 314 is provided on one side of the pivot pin 342 opposite the kickstand contact surface 354 of the handle 310. Accordingly, the spring 314 tends to push the handle 310 and the kick stand 106 apart on one side of the pin 342, and the spring 314 tends to push the kickstand contact surface 354 of the handle 310 into contact with the kickstand 106. A portion of the spring 314 at one of its ends is received in the cavity 392 formed in the underside of the handle 310. The other end of the spring 314 is in contact with the kickstand 106. The kickstand 106 is provided with a projection 194 that projects through one or more coils of the spring 314 near the end of the spring 314 that is in contact with the kickstand 106. The cavity 392 and the projection 194 cooperatively keep the spring 314 in the proper position.

The catch means 316 is provided for selectively securing the handle 310 in the folded-down position. Keeping the handle 310 folded down inside the receptacle portion 318 of the housing 302 reduces the vulnerability of the latch mechanism 300 to vandalism. The catch means 316 includes a sliding claw 396 supported by the housing 302 for rectilinear movement between an engaged position and a disengaged position. The catch means 316 further includes a spring 398 that biases the claw 396 toward the engaged position. The claw 396 is positioned under the grasping portion of the handle 310 and is completely hidden when the handle 310 is in the folded-down position. The claw 396 has a beveled projection 400 that has a beveled surface 402 and a catch surface 404. In the disengaged position the claw 396 registers with a cavity 406 formed in the underside of the grasping portion of the handle 310. A step 408 is formed inside the cavity 406 by the intersection of the cavity 406 and the transverse bore or opening 410. The catch surface 404 engages the step 408 to retain the handle 310 in the folded-down position. The beveled surface 402 interacts with the edge of the cavity 406 to move the claw 396 to the disengaged position to thereby allow the claw 396 to move into the cavity 406 as the handle 310 is being moved to the folded-down position. Once the handle 310 is in the folded-down position, the catch surface 404 moves under the force exerted by the spring 398 into engagement with the step 408 to retain the handle 310 in the folded-down position.

The latch mechanism 300, further includes a lock cylinder 412 that is supported by the housing 302. The lock cylinder 412 is operated by a key in the conventional manner. Once the key in inserted in the lock cylinder 412, the lock cylinder 412 can be turned about its own longitudinal axis by a user using the key. With the key inserted the lock cylinder 412 can be rotated between locked and unlocked positions. A cam projection 414 is provided at the inner end of the lock cylinder 412 in an eccentric position relative to the longitudinal axis of the lock cylinder. As the lock cylinder 412 is rotated to the unlocked position, the cam projection 414 pushes the claw 396 to the disengaged position to thereby release the handle 310 from the folded-down position. The lock cylinder 412 is rotated to the locked position to enable the removal of the key. With the key removed, the lock cylinder 412 cannot rotate and remains in the locked position. With the lock cylinder 412 in the locked position, the claw 396 is free to return to the engaged position where it can engage the handle 310 when it is returned to the folded-down position to once again retain the handle 310 in the folded-down position.

In an alternative embodiment, the lock cylinder 412 may be replaced by a tool driven plug 216 as has been described previously.

For greater resistance to vandalism, this embodiment may also be provided with the facility for the use of a padlock. Accordingly, a padlock hasp 420 supported by the housing 302*a* is provided in this embodiment. The housing 302*a* differs from the housing 302 only in that a hole is provided in the face plate of the housing 302*a* to allow the padlock hasp 420 to extend therethrough. The hasp 420 is retractable and is movable between a retracted and an extended position. The hole 422 in the hasp 420 for the engagement of the padlock shackle is partially covered when the hasp 420 is in the retracted position. The hasp 420 must be pulled to the extended position to allow the hasp to be engaged by the padlock. The padlock hasp 420 is attached to a claw catch 224 that moves rectilinearly with the padlock hasp as the padlock hasp is moved between the retracted and extended positions. When the hasp 420 is in the extended position, the claw catch 224 is in the engaged position. When the hasp 420 is in the retracted position, the claw catch 224 is in the disengaged position. The claw catch 224 moves in a direction perpendicular to the direction of motion of the claw 396 and has a post 226 that engages a hole 428 in the claw 396 to keep the claw 396 in the engaged position when the claw catch 224 is in its engaged position. The claw 396 can be moved to its disengaged position when the claw catch 224 is in its disengaged position. The hasp 420 and the claw catch 224 are spring biased toward the retracted and the disengaged positions respectively. The hasp 420 is pulled to the extended position and is maintained there by the engagement of the padlock with the hasp 420. This locks the claw 396 and the claw catch 224 in their respective engaged positions, which in turn locks the handle 310 in the folded-down position, assuming the handle 310 was in the folded-down position when the padlock was applied. Removing the padlock disengages the claw catch 224 from the claw 396, which allows the handle 310 to be released by turning the lock cylinder 412. A protective cover 430 is provided for protecting the cylinder lock 412 or the combination of the lock cylinder 412 and the hasp 420 from the elements.

Referring to FIGS. 104, 114, and 166-171, the latch mechanism 300 is mounted to an opening or hole in the door 301. The opening in the door 301 is shaped and sized to provide clearance for the side walls of the receptacle portion 318 of the housing 302 but not for the flange 320. To mount the latch mechanism 300 to the door 301, the receptacle portion 318 of the housing 302 is placed through the opening in the door 301 such that the underside of the flange 320 abuts the exterior surface of the door 301. A bracket 432 is placed over the receptacle portion 318 of the housing 302 such that the edges 434 of the bracket 432 abut the interior surface of the door 301. The dimension of the bracket 432 measured across the edges 434 is too large to clear the opening in the door 301. Four fasteners 436 are used to secure the bracket 432 to the housing 302. Thus, at least a portion of the door 301 is captured intermediate the flange 320 and the bracket 432 to secure the latch mechanism 300 to the door 301. A flange seal 438 may be provided between the flange 320 and the exterior surface of the door 301 to seal off any crevices between the housing 302 and the door 301 in applications where leak-proofing the latch is important.

The bracket 432 is much larger than the bracket 232 and extends nearly for the full length of the housing 302 for added resistance to vandalism. Accordingly, an opening 384 has been provided in the bracket 432 to allow the shaft 304 to extend through the bracket 432 without any interference from the bracket 432.

Figure 104:
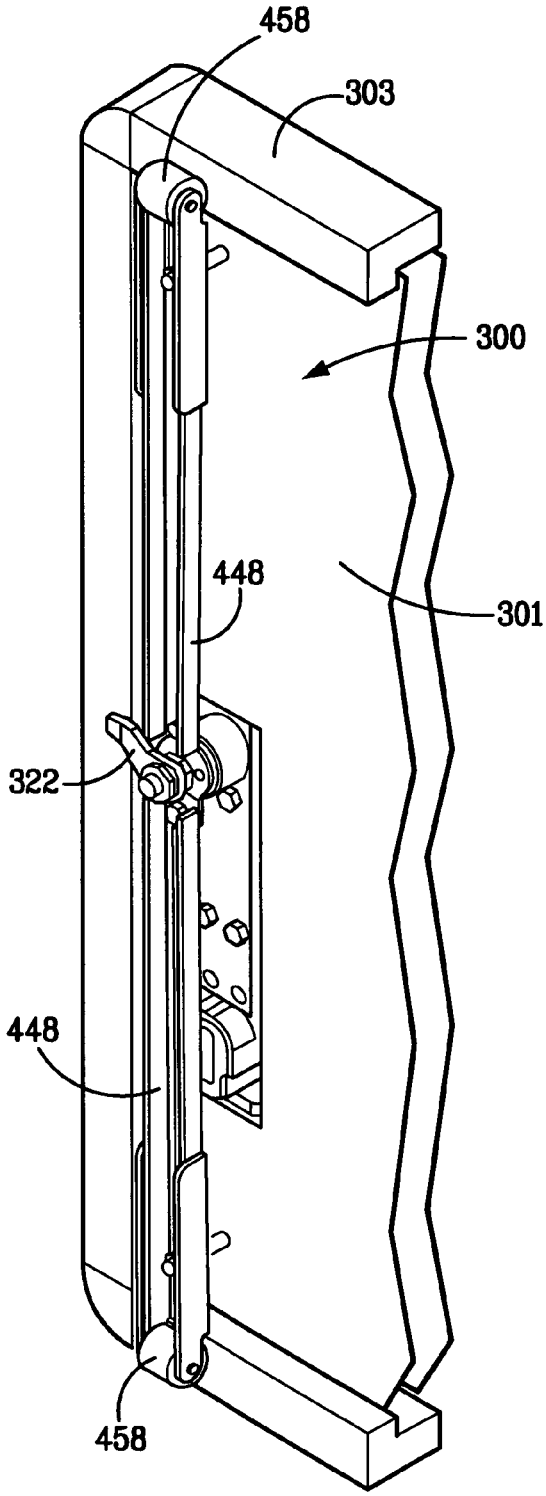

The pawl 322 has one end that is adapted for engaging the door frame 303, or a keeper, when the pawl 322 is in the latched configuration shown in FIG. 104. The pawl 322 has a hole 440 in a location spaced apart from the end adapted to engage the doorframe 303. The hole 440 is shaped to correspond to the cross section of the threaded portion 388 of the shaft 304 and has flat sides that engage the flat sides 390 of the threaded portion of the shaft 304 such that the shaft 304 and the pawl 322 rotate together as a unit about the longitudinal axis of the shaft 304 when the threaded portion of the shaft 304 is placed through the hole 440 of the pawl 322. The pawl 322 is adjustably secured in position along the threaded portion 388 of the shaft 304 by a pair of nuts 442. The nuts 442 are engaged to the threaded portion of the shaft 304 and tightened against the pawl 322 to secure the pawl 322 in place once the pawl 322 is mounted on the threaded portion of the shaft 304. Lock washers can be provided intermediate the pawl 322 and the nuts 442 to reduce the chance of the nuts 442 becoming loose during operation and use of the latch mechanism 300.

With the compression latch mechanism 300 in the latched configuration, the handle 310 is secured in the folded-down position and the shaft 304 is in the latched position and is held there by the bearing surfaces 136 of the kickstand 106 being positioned between the first end 334 of the shaft 304 and the raised bearing surface 346. Also in this configuration, the pawl 322 is drawn or pulled up behind the doorframe 303 to thereby exert a compressive force between the door 301 and the doorframe 303.

When the catch means 316 is operated by a user to release the handle 310, for example by turning the lock cylinder 412, the handle 310 moves to the intermediate position under bias provided by the second biasing means 314 without affecting the position of the kickstand 106 and the shaft 304. In the illustrated example, the handle 310 pops out to an angle of approximately 30° from the housing 302 relative to its folded-down position. The pawl 322 and the shaft 304 remain in their latched positions.

As the handle 310 is moved from the intermediate position toward the first raised position by the user, the handle 310 moves the kickstand 106 pivotally relative to the shaft 304, through contact between the kickstand contact surface 354 of the handle 310 and the kickstand 106, until the relief notches 138 register with the raised bearing surface 346 whereupon the shaft 304 moves rectilinearly in a direction coincident with the longitudinal axis under the bias of the first biasing means 312 such that the second end 328 of the shaft 304 moves toward an intermediate extended position. The intermediate extended position is intermediate the latched position and the unlatched position. The second end of the shaft 304 projects to its maximum distance from the housing 302 in the intermediate extended position. The pawl 322 also moves rectilinearly with the shaft 304 such that it moves away from behind the doorframe 303 to thereby relieve the compression applied between the door 301 and the doorframe 303.

Subsequently the handle 310 can be turned from the first raised position to the second raised position by the user to rotate the shaft 304 about its longitudinal axis to the unlatched position. During this operation, the pawl 322 is also rotated out from behind the doorframe 303, there allowing the door 301 to be opened. In the illustrated example, the handle 310 is at an angle of Approximately 45° relative to its folded-down position and projects outward from the open top of the housing 302 at about the same angle in both the first and second raised positions and at every position therebetween. The handle 310 is turned about an axis of rotation coincident with the longitudinal axis of the shaft 304 to move the handle 310 from the first raised position to the second raised position. Furthermore, the handle 310 is turned about the longitudinal axis of the shaft 304 through an angle of 60° or greater, and preferably of about 90°, to move the handle 310 from the first raised position to the second raised position.

When the compression latch mechanism 300 is in the unlatched configuration the handle 310 is in the second raised position and the shaft 304 is in the unlatched position. Also, the pawl 322 is out from behind the doorframe 303 and does not overlap any part of the doorframe 303.

To latch the door 301 in the closed position the door is first moved to an approximately closed position relative to the door frame 303. Then the handle 310 is turned from the second raised position to the first raised position by the user by rotating the handle 310 about the longitudinal axis of the shaft 304. Turning the handle 310 from the second raised position to the first raised position causes the shaft 304 to rotate about its longitudinal axis from the unlatched position to the intermediate extended position. At this time the pawl 322 is also rotated behind the doorframe 303 such that the pawl 322 now overlaps the doorframe 303.

The handle 310 can then be moved from the first raised position to the folded-down position to draw up the pawl 322 behind the doorframe 303 and thus generate a compressive force between the door 301 and the doorframe 303 to thereby tightly secure the door 301 in the closed position and compress any sealing gasket that may be present between the door 301 and the doorframe 303. As the handle 310 is moved from the first raised position toward the folded-down position by the user, a portion of the underside of the handle 310 located intermediate the grasping portion and the pivotal connection between the handle 310 and the shaft 304 contacts the first bearing surface 330 of the housing 302 such that the first bearing surface 330 of the housing 302 defines a fulcrum point and the handle 310 acts as a lever to lift the kickstand 106 and the first end 334 of the shaft 304 away from the bearing plate 308 to thereby increasingly elevate the kickstand 106 and the first end of the shaft 304 above the bearing plate 308. Once the raised bearing surface 346 of the bearing plate 308 completely clears the relief notches 138, the kickstand 106 moves pivotally relative to the shaft 304 under a biasing force provided by the second biasing means 314 such that the bearing surfaces 136 of the kickstand 106 are positioned between the first end 334 of the shaft 304 and the raised bearing surface 346 to thereby maintain the shaft 304 in the latched position. The pawl 322 is also now in the latched position and maintained there by the bearing surfaces 136 of the kickstand 106 being positioned between the first end 334 of the shaft 304 and the raised bearing surface 346. Also, once the handle 310 reaches the folded-down position, the catch means 316 secures the handle 310 in the folded-down position. The padlock can now be applied and/or the key removed from the lock cylinder 412 to thereby prevent unauthorized opening of the door 301.

Figure 105:
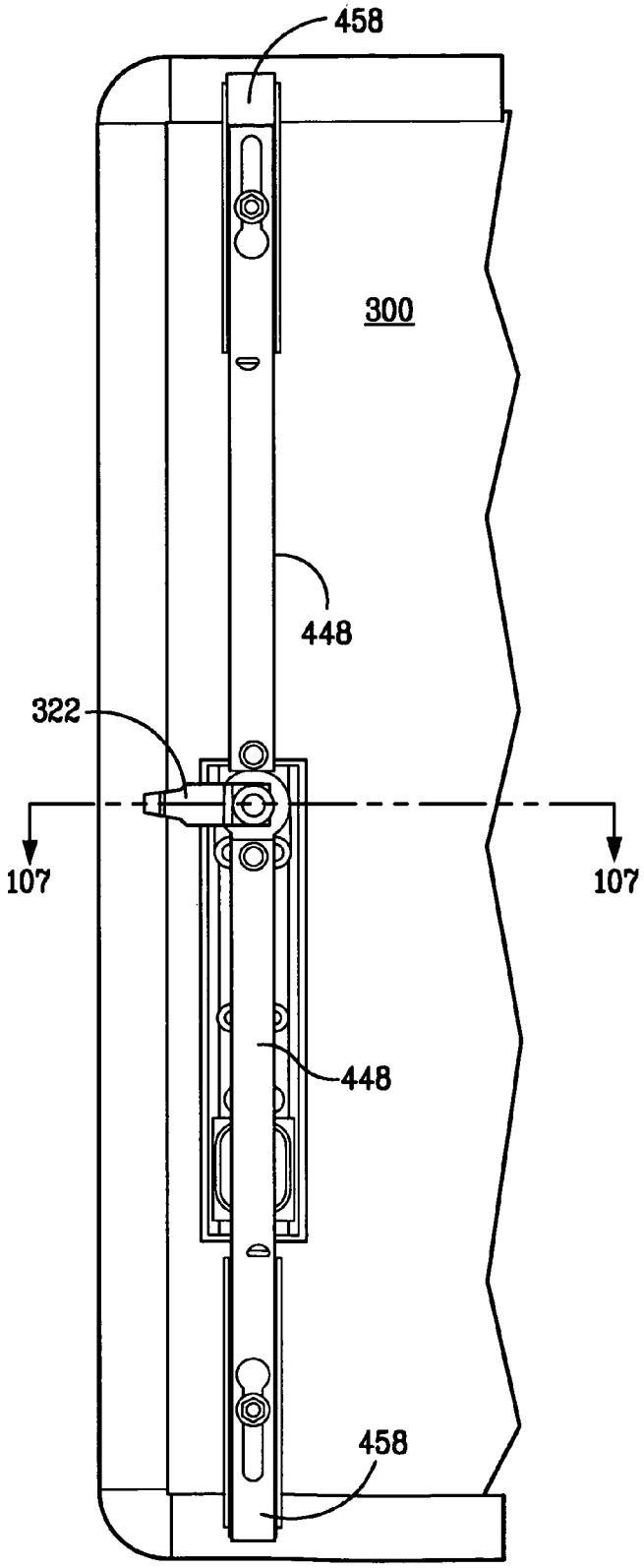
Figure 106:
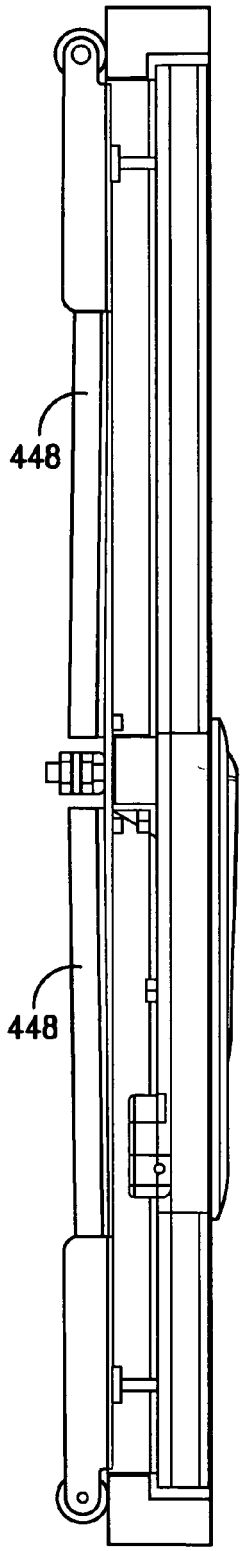
Figure 107:
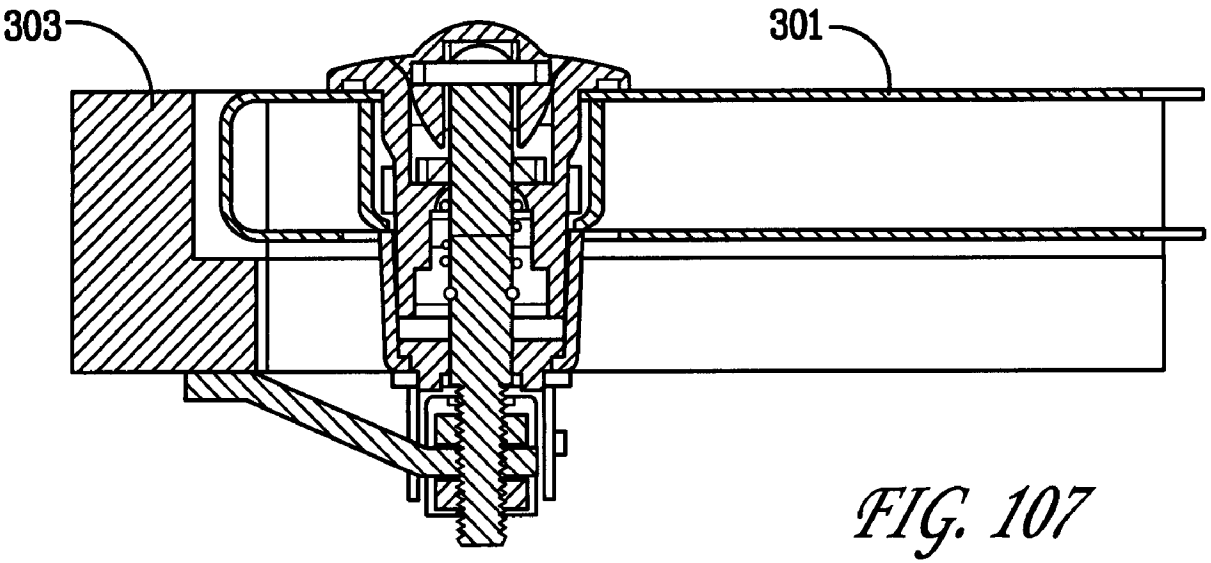
Figure 108:
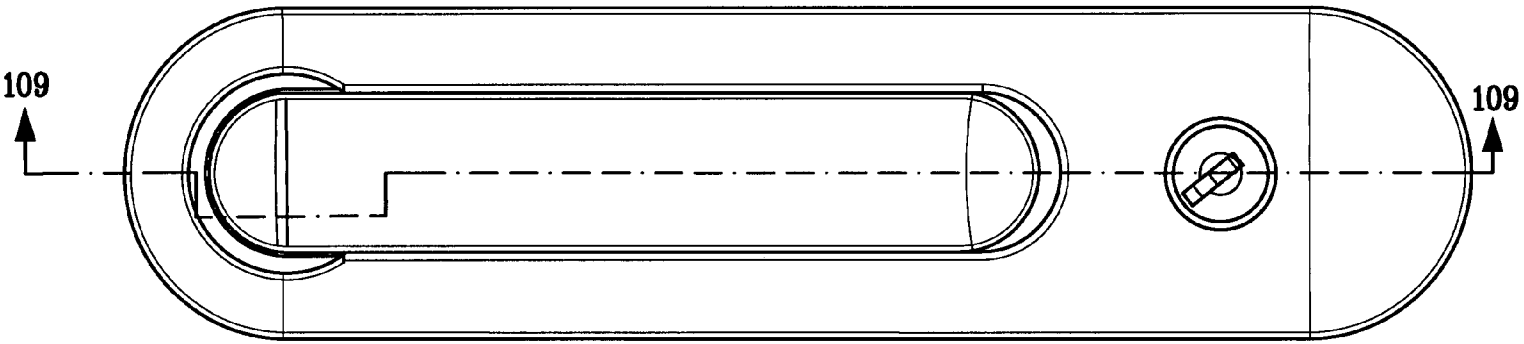
FIGS. 108-109 are views of the second embodiment of the compression latch mechanism according to the present invention shown with the handle in an intermediate raised position.
Figure 109:
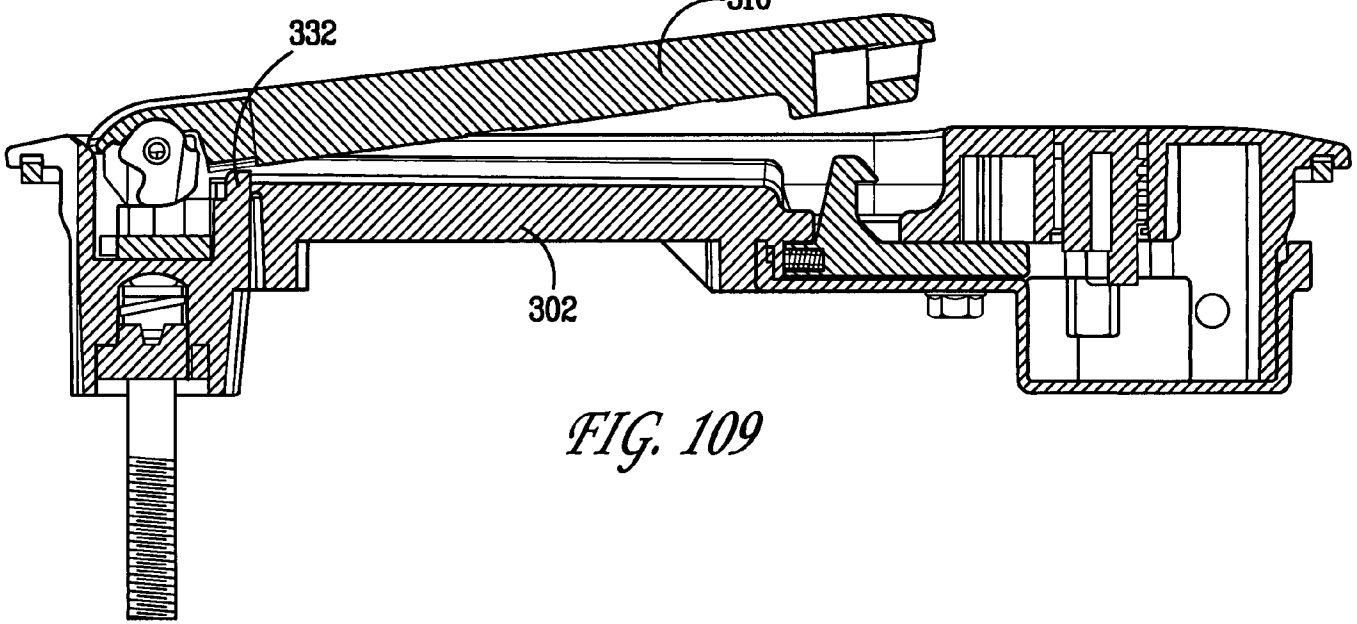
Figure 110:
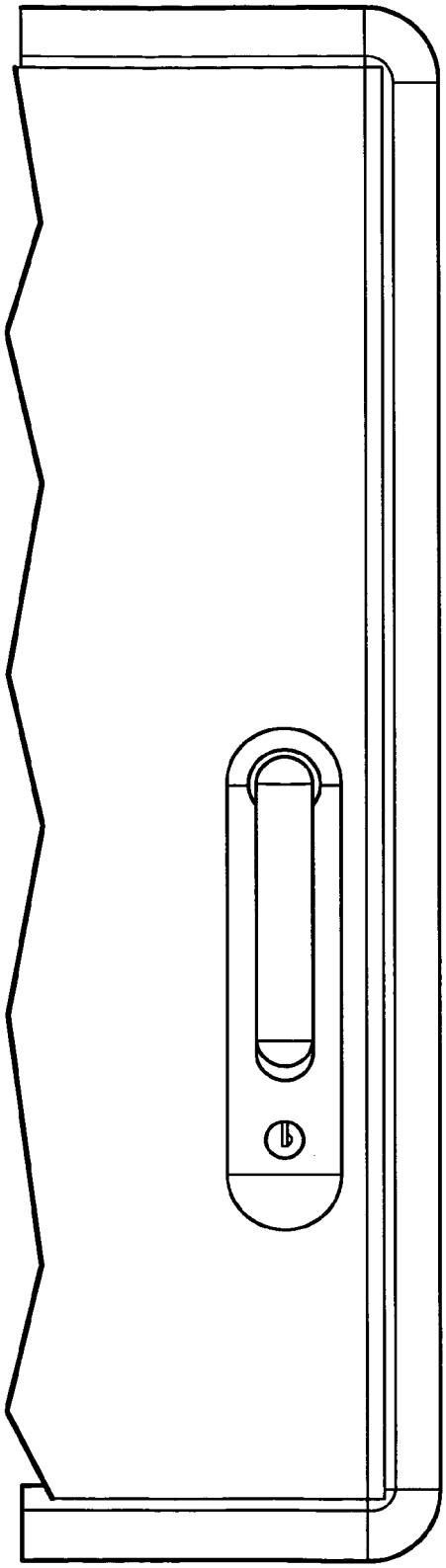
FIGS. 110-114 are environmental views of the second embodiment of the compression latch mechanism according to the present invention shown with the handle in an intermediate raised position.
Figure 111:
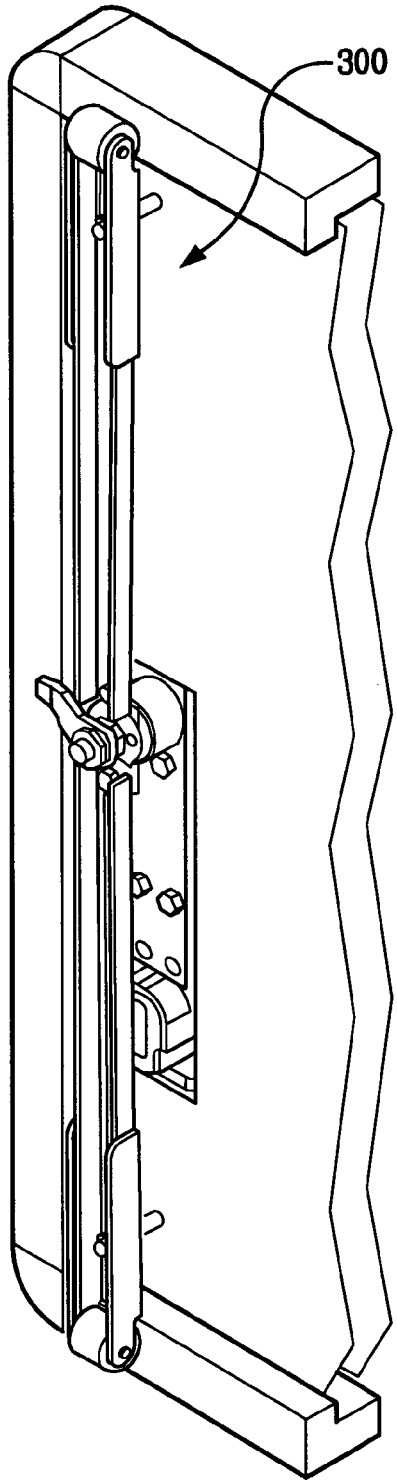
Figure 112:
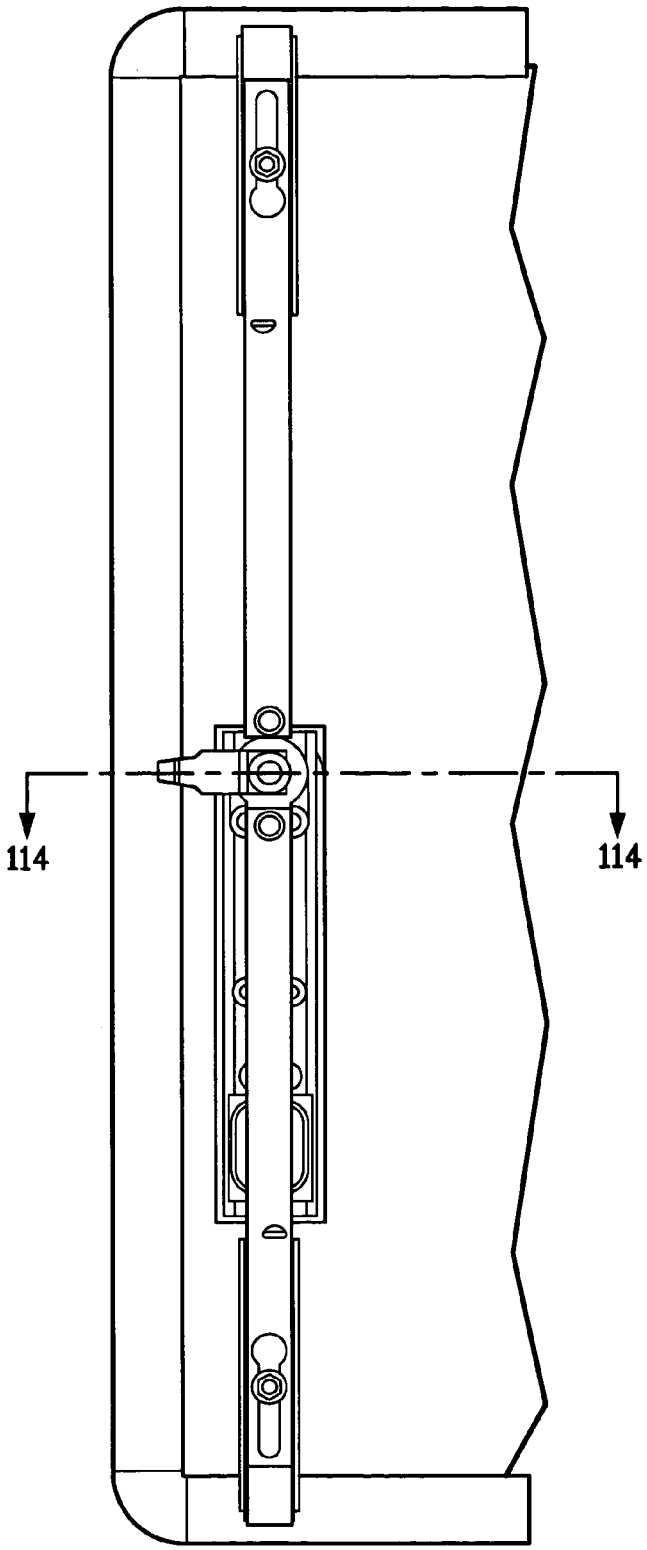
Figure 113:
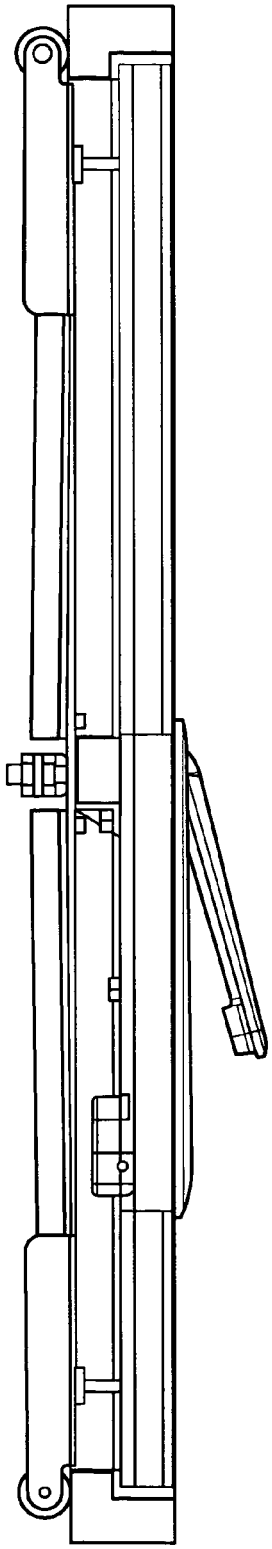
Figure 114:
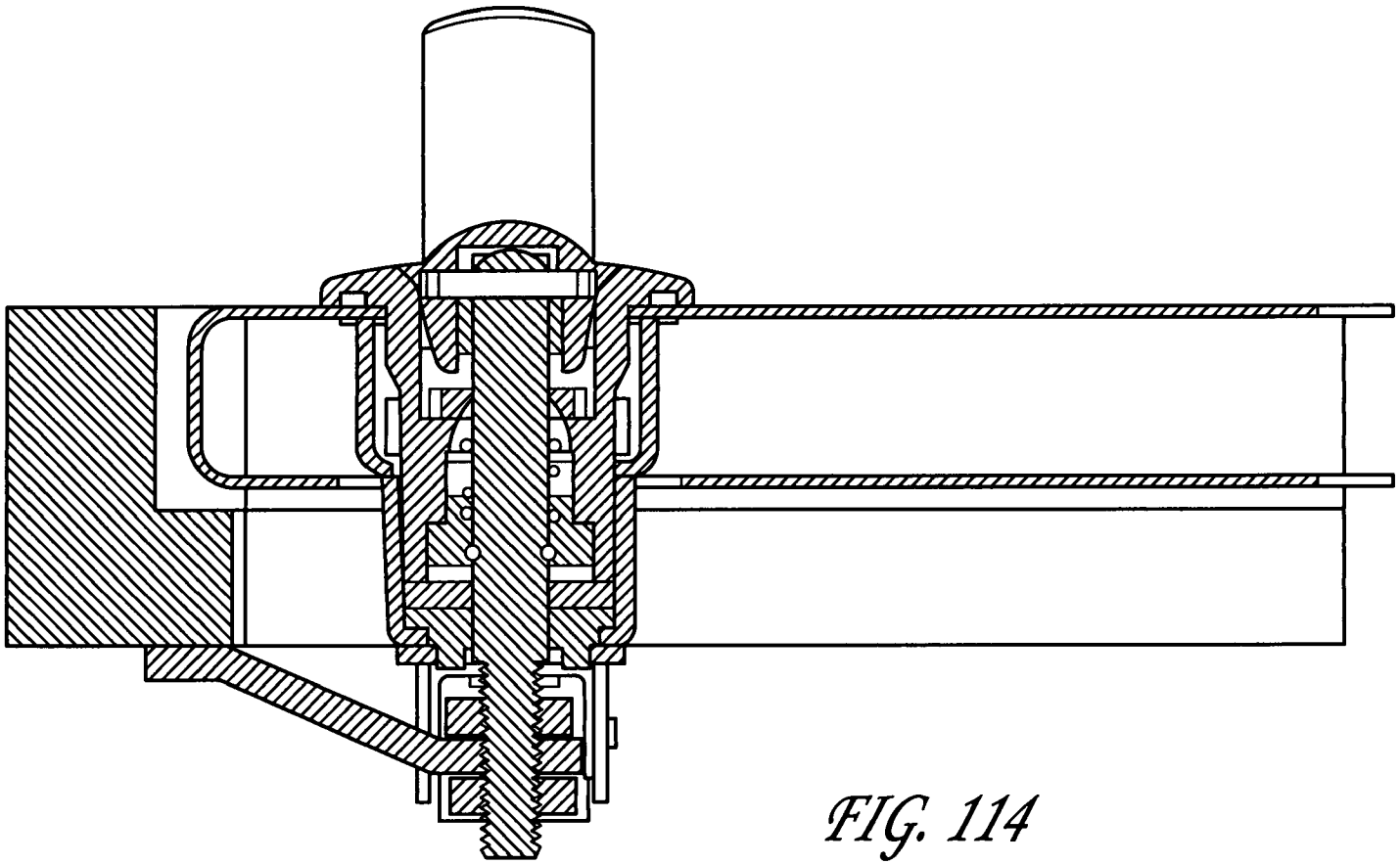
Figure 115:
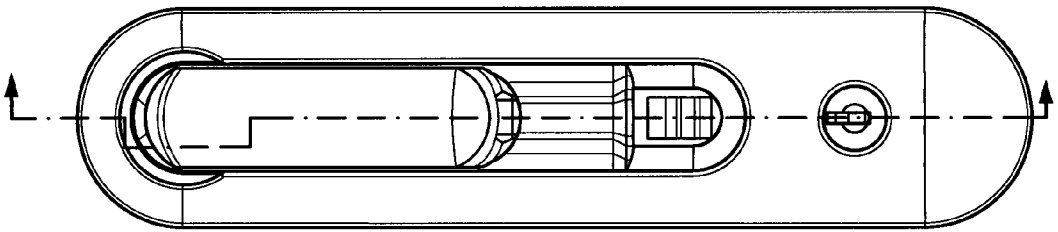
FIGS. 115-116 are views of the second embodiment of the compression latch mechanism according to the present invention shown with the handle in the first raised position.

Referring to FIGS. 104-106, the latch mechanism 300 also has provision for multi-point latching, i.e. latching the door to the doorframe simultaneously at multiple points along the doorframe. This capability is achieved by further providing a rod actuator 416 that is rotationally supported relative to the bracket 432. The rod actuator 416 moves rotationally in response to the rotational movement of the shaft 304 about the longitudinal axis of the shaft 304. The shaft 304 is however capable of being moved rectilinearly in the direction of its longitudinal axis relative to the rod actuator 416 without interference from the rod actuator 416. The rod actuator 416 has a first hole 492 to allow the shaft 304 to extend through the rod actuator 416. The rod actuator 416 also has arms that extend on either side of the first hole 492. The rod actuator 416 has second and third holes 444 and 446, in addition to the hole 492, for the attachment of remote latching rods 448. The first and second holes 444 and 446 are positioned on either side of the shaft 304 and the hole 492. Each of the first and second holes 444 and 446 have a center, with the shaft 304 and the hole 492 being positioned at about the midpoint of a line extending from the center of the first hole 444 to the center of the second hole 446. In the illustrated embodiment, each of the first and second holes 444 and 446 is located near the end of a respective one of the arms of the rod actuator 416.

The latch mechanism 300 also includes an actuator hub 493 and an actuator hub housing 494. The actuator hub 493 fits inside the actuator hub housing 494 and is rotationally supported therein. The actuator hub housing 494 is attached to the bracket 432 by two of the fasteners 436 that are used to secure the bracket 432 to the housing 302. The actuator hub housing 494 has openings 495, 496 on both sides in order to allow the shaft 304 to extend through the actuator hub housing 494 without interference from the actuator hub housing 494. The actuator hub 493 has a center hole 497 that registers with the hole 492 of the rod actuator 416 and allows the shaft 304 to extend through the actuator hub 493. The shaft 304 is capable of being moved rectilinearly in the direction of its longitudinal axis relative to the actuator hub 493 without interference from the actuator hub 493. The actuator hub 493 has two pegs 498 and 499 on opposite sides of the hole 497 that engage holes 500 and 501, respectively, provided in the rod actuator 416 on either side of the hole 492 such that the actuator hub 493 and the rod actuator 416 rotate as a unit. The pegs 498 and 499 extend through the opening 495 of the actuator hub housing 494 on opposite sides of the shaft 304. One or both of the holes 497 and 492, of the actuator hub 493 and the rod actuator 416 respectively, is shaped to correspond to the non-circular cross section of the threaded portion 388 of the shaft 304 and has flat sides that engage the flat sides 390 of the threaded portion of the shaft 304 such that the actuator hub 493 and the rod actuator 416 rotate with and in response to the rotation of the shaft 304 about the longitudinal axis of the shaft 304, while the shaft 304 remains capable of being moved rectilinearly in the direction of its longitudinal axis relative to the actuator hub 493 and the rod actuator 416 without interference from either the actuator hub 493 or the rod actuator 416.

First and second remote latching rods 448 may be attached to the rod actuator 416 using various types of fasteners placed through a respective one of the holes 444 and 446. In the illustrated example, the holes 444 and 446 are threaded and rod mounting screws 450 are used to pivotally attach the rods 448 to the rod actuator 416. Also in the illustrated example, only the first rod 448 is described in detail given that the second remote latching rod 448 will be identical to the first except that it will be mounted to the hole 446.

The remote latching rod 448 is an elongated rod formed from sheet metal and has a cross section in the form of a rectangular channel that is open on one side, i.e. an approximately U-shaped channel. The remote latching rod 448 has a first end 452 and a second end 454. The first end 452 is the proximal end being closer to the pawl 322, and the second end 454 is the distal end being farthest from the pawl 322. The remote latching rod 448 has a first hole 456 near its proximal end that is placed in registry with a respective one of hole 444 or 446. A fastener 450 is then positioned to extend through the hole 456 and is threadedly engaged to the hole 444 or 446 to attach the rod 448 to the rod actuator 416. The remote latching rod 448 supports a freely rotating roller 458 at its distal end. The rod 448 is pivotally supported near its distal end by the interior surface of the door 301 in a manner that will be described later.

The rod actuator 416 rotates about the longitudinal axis of the shaft 304 with the shaft 304. The holes 444 and 446 are located eccentrically relative to the longitudinal axis of the shaft 304. Accordingly, as the pawl 322 rotates between the unlatched position and a rotational position where it is in line with its latched position, the rod actuator 416 also rotates with the result that the distal ends of the rods 448 move substantially rectilinearly in opposite directions away from the longitudinal axis of the shaft 304. The latch mechanism 300 is installed to the door 301 such that as the pawl 322 rotates from the unlatched position to a rotational position where it is in line with its latched position, the rollers 458 ride over the backside of the doorframe 303 to latch the door 301 to the doorframe 303 at a point spaced apart from the location where the pawl 322 engages the doorframe 303. Thus the rods 448 provide for multipoint latching of the door to the doorframe. Furthermore, as the pawl 322 rotates from the rotational position where it is in line with its latched position to the unlatched position, the rollers 458 are withdrawn from behind the doorframe 303 to allow the door 301 to be opened. In addition, as the handle 310 is moved from the first raised position toward the folded-down position by the user, the pawl 322 and the threaded portion of the shaft 304 are pulled up toward the housing 302 to their final latched positions without affecting the rods 448 or the rod actuator 416. This arrangement has the advantage that high compression forces on, for example, a gasket between the door and doorframe will not impede the rectilinear movement of the shaft 304 under the bias of spring 312. In the embodiment 100 very high reaction forces on the rollers 258 would tend to push the pawl 122 and the threaded portion of the shaft 104 back toward the housing 102, thus impeding the rectilinear movement of the shaft 104 under the bias of spring 112.

The grip of the roller 458 is defined by the distance between the roller 458 and the plane defined by the back side of the door 301 measured in a direction perpendicular to the plane defined by the back side of the door. The rod 448 of the present invention provides for this grip to be adjustable to accommodate doorframes of varying thickness. The rod 448 has a first slot 460 that has a pair of parallel elongated sides. A rod guide 262 is provided that is in the form of a sleeve having a threaded bore 264 and a pair of annular flanges 266 and 268 that are spaced apart from one another. The first pair of parallel elongated sides of the slot 460 are spaced apart a distance that is less than the diameter of the annular flanges 266 and 268, and the first pair of parallel elongated sides of the slot 460 fit between the annular flanges 266 and 268 such that the distal end of the rod 448 can move rectilinearly and pivotally relative to the rod guide 262 while being properly constrained and guided in its movements by the rod guide 262. One end of the slot 460 that is outside the normal range of relative movement between the distal end of the rod 448 and the rod guide 262 after installation, is enlarged to allow the flanges 266 and 268 to clear the slot 460 to allow for the assembly of the rod guide 262 to the distal end of the rod 448. One portion of the sleeve forming part of the rod guide 262 and not intermediate the flanges 266 and 268 is faceted and is provided with facets 270 to allow the use of a tool such as a wrench in rotating the rod guide 262. In use, the first pair of parallel elongated sides of the slot 460 are positioned between the pair of annular flanges 266 and 268 of the rod guide 262 with a portion of the sleeve of the rod guide extending through the slot 460 to thereby guide the movements of the rod 448.

The rod guide 262 is capable of engaging a threaded post 472 that projects from the back side of the door 301 by a threaded engagement. The threaded engagement between the rod guide 262 and the threaded post 472 allows for adjustment of the grip of the roller 458, because rotating the rod guide 262 relative to the post 472 changes the height of the rod guide 262 above the interior surface of the door 301 and thus varies the grip of the roller 458.

When greater adjustment is needed, the rod 448 is made such that the roller 458 is supported by an interchangeable piece that can be exchanged for another piece providing a different grip that can be supplied as part of a kit. Thus the roller 458 is supported by an interchangeable rod end stamping 474 that is connected to the rod 448 near its distal end. The interchangeable rod end stamping 474 includes a stamped sheet metal base having two side walls 476 and a connecting wall 478 bridging the gap between the side walls 476. The side walls 476 are approximately perpendicular to the connecting wall 478. A shaft or rivet 480 extends between sidewalls 476 and supports the roller 458 for free rotational movement. A tab 482 extends from one end of the connecting wall 478 and has a series of two substantially right angle bends in opposite directions to give the tab a stepped profile. The tab 482 engages the slot 484 in the rod 448. The connecting wall 478 also has a slot 486 that is identical in outline to the slot 460. The slot 486 and the slot 460 are superimposed after assembly. The pair of parallel elongated sides 488 and 490 of both slots 460 and 486, respectively, are positioned between the pair of annular flanges 266 and 268 of the rod guide 262 after assembly. Thus the tab 482 and the rod guide 262 cooperate to keep the rod 448 and the stamping 474 together. The geometry of the sidewalls 476 can be changed to vary the grip of the roller.

The outer periphery of the actuator hub 493 has two small protrusions 502 and 503 that drag along the inside surface of the actuator hub housing 494 when the actuator hub 493 rotates during operation. The inside surface of the actuator hub housing 494 has two small depressions 504 and 505 that receive the flange protrusions 502 and 503, respectively when the handle 310 is in position where it can be folded down. This feature provides a tactile indication to the user that the handle is correctly aligned with the housing 302 for the handle 310 to be folded down.

As another alternative, the second raised bearing surface 345 of the bushing 374 can be made high enough to perform the function of bearing surface 330 in order to reduce wear of the housing 302. A similar modification applies to embodiment 100.

It is to be understood that the present invention is not limited to the embodiments described above, but includes any and all embodiments within the scope of the appended claims. Furthermore, it is to be understood that the embodiments of the present invention disclosed above are susceptible to various modifications, changes and adaptations by those skilled in the art, without departing from the spirit and scope of the invention.

The invention claimed is:

1. A compression latch mechanism for releasably securing a first member to a second member, the compression latch mechanism comprising:

a housing adapted for attachment to the first member;

a shaft having a longitudinal axis, a first end and a second end, said shaft being supported for rotation about said longitudinal axis and for rectilinear motion in a direction coincident with said longitudinal axis, said shaft moving between a latched position and an unlatched position as the compression latch mechanism is operated between a latched configuration and an unlatched configuration, operation of the compression latch mechanism from said latched configuration to said unlatched configuration and then back to said latched configuration constituting an operating cycle of the compression latch mechanism;

a kickstand pivotally connected to said shaft proximate said first end of said shaft, said kick stand having at least one bearing surface and at least one relief notch, said kickstand moving pivotally relative to said shaft about a pivot axis fixed in position relative to said shaft during at least a portion of said operating cycle of the compression latch mechanism;

a bearing plate positioned between said first end of said shaft and said second end of said shaft, said bearing plate being supported by said housing and having at least a raised bearing surface and at least a lower bearing surface;

a handle pivotally connected to said shaft proximate said first end of said shaft thereby defining a pivotal connection, said handle moving pivotally relative to said shaft about said pivot axis as said handle is moved between a folded-down position and a first raised position, said handle having a kickstand contact surface, said kickstand and said handle being pivotally movable relative to one another over a predetermined range of pivotal movement, said handle being capable of being turned to a second raised position to place the compression latch mechanism in said unlatched configuration, said handle having an underside and a grasping portion;

first biasing means for biasing said shaft such that said second end of said shaft tends to project to a greater distance from said housing under bias imparted to said shaft by said first biasing means;

second biasing means for biasing said handle from said folded-down position toward an intermediate position between said folded-down position and said first raised position and for biasing said kickstand into a latched position; and catch means for selectively securing said handle in said folded-down position, wherein with the compression latch mechanism in the latched configuration said handle is secured in said folded down position and said shaft is in said latched position and is held there by said bearing surface of said kickstand being positioned between said first end of said shaft and said raised bearing surface, wherein when said catch is operated by a user to release said handle, said handle moves to said intermediate position under bias provided by said second biasing means without affecting the position of said kickstand and said shaft, wherein as said handle is moved from said intermediate position toward said first raised position by a user, said handle moves said kickstand pivotally relative to said shaft, through contact between said first kickstand contact surface of said handle and said kickstand, until said relief notch registers with said raised bearing surface whereupon said shaft moves rectilinearly in a direction coincident with said longitudinal axis under the bias of said first biasing means such that said second end of said shaft moves toward an intermediate extended position, intermediate said latched position and said unlatched position, where said second end of said shaft projects to its maximum distance from said housing, and wherein subsequently said handle can be turned from said first raised position to said second raised position by the user to rotate said shaft about its longitudinal axis to said unlatched position.

2. The compression latch mechanism according to claim 1, wherein the compression latch mechanism further comprises a first bearing surface provided for contacting said underside of said handle, wherein when the compression latch mechanism is in said unlatched configuration said handle is in said second raised position and said shaft is in said unlatched position, said handle can be turned from said second raised position to said first raised position by the user to rotate said shaft about its longitudinal axis from said unlatched position to said intermediate extended position, wherein as said handle is moved from said first raised position toward said folded-down position by the user, a portion of said underside of said handle located intermediate said grasping portion and said pivotal connection between said handle and said shaft contacts said first bearing surface such that said first bearing surface defines a fulcrum point and said handle acts as a lever to lift said kickstand and said first end of said shaft away from said bearing plate to thereby increasingly elevate said kickstand and said first end of said shaft above said bearing plate, wherein once said raised bearing surface of said bearing plate completely clears said relief notch, said kickstand moves pivotally relative to said shaft under a biasing force provided by said second biasing means such that said bearing surface of said kickstand is positioned between said first end of said shaft and said raised bearing surface to thereby maintain said shaft in said latched position, and wherein upon said handle reaching said folded-down position, said catch means secures said handle in said folded-down position.

3. The compression latch mechanism according to claim 2, wherein the first member is a door and the second member is a doorframe, the compression latch mechanism further comprising a pawl mounted to said shaft intermediate said second end of said shaft and said housing, and said pawl mounted to said shaft such that at least a portion of said pawl is positioned behind a structure fixed to or forming a part of the door-frame when the compression latch mechanism is mounted to the door and said shaft is in one of said latched position and said intermediate extended position, said pawl moving between latched and unlatched positions corresponding to latched and unlatched positions of said shaft respectively, said pawl moving with said shaft as a unit.

4. The compression latch mechanism according to claim 3, wherein a compressive force tending to draw the door and the doorframe together is applied to the door and the doorframe as the handle is moved from the first raised position to the folded-down position to thereby move said shaft from said intermediate extended position to said latched position.

5. The compression latch mechanism according to claim 4, wherein said pawl has first and second holes positioned on either side of said shaft, each of said first and second holes having a center, with said shaft being positioned at about the midpoint of a line extending from said center of said first hole to said center of said second hole, the compression latch mechanism further comprising:

a first rod pivotally attached to said pawl by a fastener engaging said first hole, said first rod supporting a first roller at an end thereof distal from said pawl, said first rod causing said first roller to move substantially rectilinearly responsive to rotation of said pawl; and a second rod pivotally attached to said pawl by a fastener engaging said second hole, said second rod supporting a second roller at an end thereof distal from said pawl, said second rod causing said second roller to move substantially rectilinearly responsive to rotation of said pawl, wherein said first rod causes said first roller to move behind the doorframe when said pawl is moved to said latched position, at a first location spaced apart from the location where said pawl is positioned behind the doorframe, and said first rod withdraws said first roller from behind the doorframe when said pawl is rotated to the unlatched position, wherein said second rod causes said second roller to move behind the doorframe when said pawl is moved to said latched position, at a second location spaced apart from the location where said pawl is positioned behind the doorframe, and said second rod withdraws said second roller from behind the doorframe when said pawl is rotated to the unlatched position, to thereby provide for multipoint latching of the door to the doorframe.

6. The compression latch mechanism according to claim 5, wherein the door has a back side, and wherein said first rod has a first slot having a first pair of parallel elongated sides and said second rod has a second slot having a second pair of parallel elongated sides, the compression latch mechanism further comprising:

a first rod guide in the form of a sleeve having a threaded bore and a pair of annular flanges that are spaced apart from one another, said first pair of parallel elongated sides being positioned between said pair of annular flanges of said first rod guide with a portion of said sleeve of said first rod guide extending through said first slot to thereby guide the movements of said first rod, said first rod guide being capable of engaging a first threaded post projecting from the back side of the door by a threaded engagement, said first roller having a grip defined by the distance between said first roller and the plane defined by the back side of the door in a direction perpendicular to the plane defined by the back side of the door, the threaded engagement between said first rod guide and the first threaded post allowing for adjustment of the grip of said first roller; and a second rod guide in the form of a sleeve having a threaded bore and a pair of annular flanges that are spaced apart from one another, said second pair of parallel elongated sides being positioned between said pair of annular flanges of said second rod guide with a portion of said sleeve of said second rod guide extending through said second slot to thereby guide the movements of said second rod, said second rod guide being capable of engaging a second threaded post projecting from the back side of the door by a threaded engagement, said second roller having a grip defined by the distance between said second roller and the plane defined by the back side of the door in a direction perpendicular to the plane defined by the back side of the door, the threaded engagement between said second rod guide and the second threaded post allowing for adjustment of the grip of said second roller.

7. The compression latch mechanism according to claim 5, wherein the door has a back side, wherein said first roller is supported by a first interchangeable rod end stamping connected to said first rod, said first roller having a grip defined by the distance between said first roller and the plane defined by the back side of the door in a direction perpendicular to the plane defined by the back side of the door, said first interchangeable rod end stamping being replaced by another interchangeable rod end stamping to vary the grip of said first roller, and wherein said second roller is supported by a second interchangeable rod end stamping connected to said second rod, said second roller having a grip defined by the distance between said second roller and the plane defined by the back side of the door in a direction perpendicular to the plane defined by the back side of the door, said second interchangeable rod end stamping being replaced by another interchangeable rod end stamping to vary the grip of said second roller.

8. The compression latch mechanism according to claim 2, wherein said handle has at least one cam lobe defining a handle cam surface, said handle cam surface contacting said lower bearing surface of said bearing plate to lift said first end of said shaft away from said lower bearing surface of said bearing plate in response to movement of said handle toward said folded-down position.

9. The compression latch mechanism according to claim 2, wherein said housing has a sleeve through which said shaft passes and said sleeve has a pair of slots at an end thereof closest to said second end of said shaft, the compression latch mechanism further comprising:

lateral projections projecting from either side of said shaft or from either side of a bushing supported by said shaft, said lateral projections registering with said pair of slots when said handle is at or between said first raised position and said folded-down position.

10. The compression latch mechanism according to claim 2, wherein said bearing plate is provided with a first raised bearing surface and a second raised bearing surface, wherein said first bearing surface provided for contacting said underside of said handle is formed by said second raised bearing surface, wherein as said handle is moved from said first raised position toward said folded-down position by the user, a portion of said underside of said handle located intermediate said grasping portion and said pivotal connection between said handle and said shaft contacts said second raised bearing surface such that said second raised bearing surface defines a fulcrum point and said handle acts as a lever to lift said kickstand and said first end of said shaft away from said bearing plate to thereby increasingly elevate said kickstand and said first end of said shaft above said lower bearing surface of said bearing plate, and wherein once said first raised bearing surface of said bearing plate completely clears said relief notch, said kickstand moves pivotally relative to said shaft under a biasing force provided by said second biasing means such that said bearing surface of said kickstand is positioned between said first end of said shaft and said first raised bearing surface to thereby maintain said shaft in said latched position.

11. The compression latch mechanism according to claim 10, wherein the first member is a door and the second member is a doorframe, the compression latch mechanism further comprising a pawl mounted to said shaft intermediate said second end of said shaft and said housing, and said pawl mounted to said shaft such that at least a portion of said pawl is positioned behind a structure fixed to or forming a part of the doorframe when the compression latch mechanism is mounted to the door and said shaft is in one of said latched position and said intermediate extended position, said pawl moving between latched and unlatched positions corresponding to latched and unlatched positions of said shaft respectively, said pawl moving with said shaft as a unit.

12. The compression latch mechanism according to claim 11, wherein a compressive force tending to draw the door and the doorframe together is applied to the door and the doorframe as the handle is moved from the first raised position to the folded-down position to thereby move said shaft from said intermediate extended position to said latched position.

13. The compression latch mechanism according to claim 12, the compression latch mechanism further comprising:

a rod actuator positioned on said shaft intermediate said pawl and said housing, said rod actuator moving rotationally in response to rotational movement of said shaft about said longitudinal axis of said shaft, said shaft being capable of being moved rectilinearly in the direction of said longitudinal axis of said shaft relative to said rod actuator, said rod actuator having a first hole to allow said shaft to extend through said rod actuator, said rod actuator having second and third holes positioned on either side of said shaft;

a first rod pivotally attached to said rod actuator by a fastener engaging said second hole, said first rod supporting a first roller at an end thereof distal from said rod actuator, said first rod causing said first roller to move into or out of engagement with a structure fixed to or forming a part of the doorframe in response to rotation of said shaft; and a second rod pivotally attached to said rod actuator by a fastener engaging said third hole, said second rod supporting a second roller at an end thereof distal from said rod actuator, said second rod causing said second roller to move into or out of engagement with a structure fixed to or forming a part of the doorframe in response to rotation of said shaft, to thereby provide for multipoint latching of the door to the doorframe.

14. The compression latch mechanism according to claim 13, wherein the door has a back side, and wherein said first rod has a first slot having a first pair of parallel elongated sides and said second rod has a second slot having a second pair of parallel elongated sides, the compression latch mechanism further comprising:

a first rod guide in the form of a sleeve having a threaded bore and a pair of annular flanges that are spaced apart from one another, said first pair of parallel elongated sides being positioned between said pair of annular flanges of said first rod guide with a portion of said sleeve of said first rod guide extending through said first slot to thereby guide the movements of said first rod, said first rod guide being capable of engaging a first threaded post projecting from the back side of the door by a threaded engagement, said first roller having a grip defined by the distance between said first roller and the plane defined by the back side of the door in a direction perpendicular to the plane defined by the back side of the door, the threaded engagement between said first rod guide and the first threaded post allowing for adjustment of the grip of said first roller; and a second rod guide in the form of a sleeve having a threaded bore and a pair of annular flanges that are spaced apart from one another, said second pair of parallel elongated sides being positioned between said pair of annular flanges of said second rod guide with a portion of said sleeve of said second rod guide extending through said second slot to thereby guide the movements of said second rod, said second rod guide being capable of engaging a second threaded post projecting from the back side of the door by a threaded engagement, said second roller having a grip defined by the distance between said second roller and the plane defined by the back side of the door in a direction perpendicular to the plane defined by the back side of the door, the threaded engagement between said second rod guide and the second threaded post allowing for adjustment of the grip of said second roller.

15. The compression latch mechanism according to claim 13, wherein the door has a back side, wherein said first roller is supported by a first interchangeable rod end stamping connected to said first rod, said first roller having a grip defined by the distance between said first roller and the plane defined by the back side of the door in a direction perpendicular to the plane defined by the back side of the door, said first interchangeable rod end stamping being replaced by another interchangeable rod end stamping to vary the grip of said first roller, and wherein said second roller is supported by a second interchangeable rod end stamping connected to said second rod, said second roller having a grip defined by the distance between said second roller and the plane defined by the back side of the door in a direction perpendicular to the plane defined by the back side of the door, said second interchangeable rod end stamping being replaced by another interchangeable rod end stamping to vary the grip of said second roller.

16. The compression latch mechanism according to claim 10, wherein said handle has at least one cam lobe defining a handle cam surface, said handle cam surface contacting said lower bearing surface of said bearing plate to lift said first end of said shaft away from said bearing plate in response to movement of said handle toward said folded-down position.

17. The compression latch mechanism according to claim 10, wherein said housing has a sleeve through which said shaft passes and said sleeve has a plurality of ribs at an end thereof closest to said second end of said shaft, the compression latch mechanism further comprising:

a bushing supported by said shaft, said bushing having a plurality of slots, said plurality of slots registering with respective ones of said plurality of ribs when said handle is at or between said first raised position and said folded-down position.

18. The compression latch mechanism according to claim 13, wherein said shaft has a portion with a non-circular cross section, the compression latch mechanism further comprising:

an actuator hub; and an actuator hub housing provided at a fixed location relative to said housing adapted for attachment to the first member, said actuator hub fitting inside said actuator hub housing and being rotationally supported therein, said actuator hub housing having openings on both sides such that said shaft extends through said actuator hub housing without interference from said actuator hub housing, said actuator hub having a center hole that registers with said first hole of said rod actuator and allows said shaft to extend through said actuator hub, said shaft being capable of being moved rectilinearly in the direction of its longitudinal axis relative to said actuator hub without interference from said actuator hub, said actuator hub engaging said rod actuator such that said actuator hub and said rod actuator rotate as a unit, wherein one or both of said center hole of said actuator hub and said first hole of said rod actuator is shaped to correspond to said non-circular cross section of said portion of said shaft such that said actuator hub and said rod actuator rotate with and in response to rotation of said shaft about said longitudinal axis of said shaft, while said shaft remains capable of being moved rectilinearly in said direction coincident with said longitudinal of said shaft relative to said actuator hub and said rod actuator without interference from either said actuator hub or said rod actuator.

* * * * *